US008426093B2

(12) United States Patent
Yamada et al.

(10) Patent No.: US 8,426,093 B2
(45) Date of Patent: Apr. 23, 2013

(54) ELECTROPHOTOGRAPHIC PHOTORECEPTOR, PROCESS CARTRIDGE AND IMAGE-FORMING APPARATUS

(75) Inventors: Wataru Yamada, Kanagawa (JP); Katsumi Nukada, Kanagawa (JP); Masahiro Iwasaki, Kanagawa (JP); Kazuhiro Koseki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 999 days.

(21) Appl. No.: 11/905,375

(22) Filed: Sep. 28, 2007

(65) Prior Publication Data

US 2008/0220356 A1 Sep. 11, 2008

(30) Foreign Application Priority Data

Mar. 6, 2007 (JP) ..... 2007-056365

(51) Int. Cl.
*G03G 5/04* (2006.01)

(52) U.S. Cl.
USPC ..... 430/60; 430/108.2; 430/108.9

(58) Field of Classification Search ..... 430/60, 430/69, 108.2, 108.9, 58.05, 58.85, 59.1
See application file for complete search history.

(56) References Cited

U.S. PATENT DOCUMENTS

| | | | | |
|---|---|---|---|---|
| 4,007,043 | A * | 2/1977 | Stolka et al. | 430/58.05 |
| 2002/0160294 | A1* | 10/2002 | Okuno et al. | 430/124 |
| 2006/0057479 | A1* | 3/2006 | Niimi et al. | 430/59.4 |
| 2006/0140648 | A1* | 6/2006 | Takegawa | 399/12 |
| 2007/0042281 | A1* | 2/2007 | Orito et al. | 430/59.5 |
| 2008/0220356 | A1 | 9/2008 | Yamada et al. | |

FOREIGN PATENT DOCUMENTS

| | | |
|---|---|---|
| JP | A-47-30330 | 11/1972 |
| JP | A-04-189873 | 7/1992 |
| JP | A-05-043813 | 2/1993 |
| JP | A-05-98181 | 4/1993 |
| JP | A-05-140472 | 6/1993 |
| JP | A-05-140473 | 6/1993 |

(Continued)

OTHER PUBLICATIONS

Katsumi Dalmon et al.; "A New Polymorph of Hydroxygallium Phthalocyanine and Its Application in a Photoreceptor."; *Journal of Imaging Science and Technology*; vol. 40, No. 3; May/Jun. 1996; pp. 249-253.

(Continued)

*Primary Examiner* — Mark F Huff
*Assistant Examiner* — Rachel Zhang
(74) *Attorney, Agent, or Firm* — Oliff & Berridge, PLC

(57) ABSTRACT

An electrophotographic photoreceptor including a photosensitive layer provided including a first functional layer including a compound represented by the following Formula (I). In Formula (I), F represents an n-valent organic group having hole transportation ability; $R_1$, $R_2$, and $R_3$ each independently represents a hydrogen atom, a halogen atom, or a monovalent organic group; L represents a divalent organic group; n represents an integer of 1 to 4; and j represents an integer of 0 or 1.

(I)

16 Claims, 20 Drawing Sheets

FOREIGN PATENT DOCUMENTS

| | | | |
|---|---|---|---|
| JP | A-05-263007 | | 10/1993 |
| JP | A-05-279591 | | 10/1993 |
| JP | A-07-053892 | | 2/1995 |
| JP | A-08-176293 | | 7/1996 |
| JP | A-08-208820 | | 8/1996 |
| JP | A 2002-82469 | | 3/2002 |
| JP | A 2003-186234 | | 7/2003 |
| JP | 2005239642 | A * | 9/2005 |
| JP | A-2007-052255 | | 3/2007 |
| KR | 10-2008-0081798 | | 9/2008 |

OTHER PUBLICATIONS

Mar. 9, 2011 Office Action issued in Korean Application No. 10-2007-0114173 (with translation).

* cited by examiner

TYPE-I HYDROXYGALLIUM PHTHALOCYANINE X-RAY DIFFRACTION SPECTRUM

TYPE-V HYDROXYGALLIUM PHTHALOCYANINE HPC-1 X-RAY DIFFRACTION SPECTRUM

SPECTRAL ABSORPTION SPECTRUM FOR TYPE-V HYDROXYGALLIUM PHTHALOCYANINE HPC-1

TYPE-V HYDROXYGALLIUM PHTHALOCYANINE HPC-2 X-RAY DIFFRACTION SPECTRUM

SPECTRAL ABSORPTION SPECTRUM FOR TYPE-V HYDROXYGALLIUM PHTHALOCYANINE HPC-2

TYPE-V HYDROXYGALLIUM PHTHALOCYANINE HPC-3 X-RAY DIFFRACTION SPECTRUM

SPECTRAL ABSORPTION SPECTRUM FOR TYPE-V HYDROXYGALLIUM PHTHALOCYANINE HPC-3

IR SPECTRUM OF COMPOUND I-7

IR SPECTRUM OF COMPOUND I-11

IR SPECTRUM OF COMPOUND I-29

IR SPECTRUM OF COMPOUND I-30

IR SPECTRUM OF COMPOUND I-31

ELECTROPHOTOGRAPHIC PHOTORECEPTOR, PROCESS CARTRIDGE AND IMAGE-FORMING APPARATUS

CROSS-REFERENCE TO RELATED APPLICATIONS

This application is based on and claims priority under 35 USC 119 from Japanese Patent Application No. 2007-56365 filed Mar. 6, 2007.

BACKGROUND

1. Technical Field

This invention relates to an electrophotographic photoreceptor, a process cartridge, and an image-forming apparatus.

2. Related Art

Recently, xerographic method image-forming apparatuses, having an electrophotographic photoreceptor (sometimes referred to later as a "photoreceptor"), a charging device, a light exposure device, a developing device, a transfer device, and a fixing device, have achieved much higher speeds and longer life-spans due to technical progress with each of the members and in the system itself. In connection with this, the requirements for high-speed response characteristics of each subsystem, and high-reliability thereof, are higher than before. Photoreceptors used for writing images thereto, and cleaning members which clean the photoreceptor, especially, receive considerably stress compared with other members due to mutual sliding therebetween, and image defects due to scratches, abrasion, defects and the like tend to readily develop, so there are even stronger requirements for high-speed response characteristics and high-reliability.

The requirements for higher image definition are also increasing. In order to full-fill these requirements, decreasing toner particles size, uniformalization of particle size distributions, and sphericalization, and the like are being achieved, and, as a process for manufacturing toner which fulfills these quality requirements, the development of toners manufactured in solvents using water as a principal component, called chemical toners, is actively progressing. As a result, these days, it has become possible to obtain photographic image quality.

SUMMARY

According to a first aspect of the invention, there is provided an electrophotographic photoreceptor including: a conductive substrate; and a photosensitive layer provided on or above the conductive substrate, the photosensitive layer including a first functional layer including a compound represented by the following Formula (I).

(I)

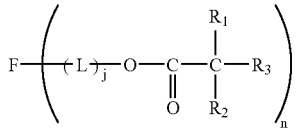

In Formula (I), F represents an n-valent organic group having hole transportation ability; $R_1$, $R_2$, and $R_3$ each independently represent a hydrogen atom, a halogen atom, or a monovalent organic group; L represents a divalent organic group; n represents an integer of 1 to 4; and j represents an integer of 0 or 1.

BRIEF DESCRIPTION OF THE DRAWINGS

Exemplary embodiments of the present invention will be described in detail based on the following figures, wherein.

DETAILED DESCRIPTION

Figure 1:
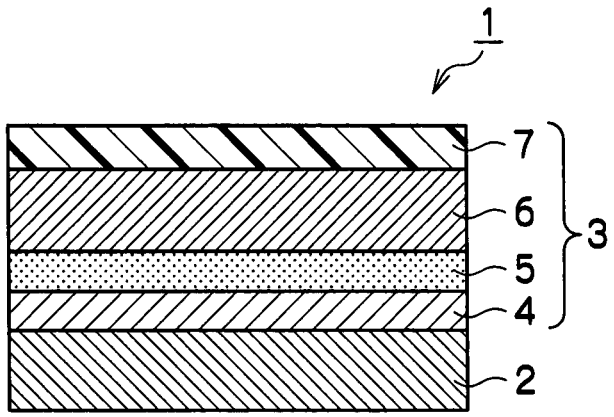
FIG. 1 is a schematic cross-section showing an electrophotographic photoreceptor according to an exemplary embodiment.

Hereinafter, exemplary embodiments will be described in detail. In the present specification " . . . to . . . " represents a range including the numeral values represented before and after "to" as a minimum value and a maximum value, respectively.

(Electrophotographic Photoreceptor)

The electrophotographic photoreceptor according to an exemplary embodiment of the invention includes a photosensitive layer, including the first functional layer, provided on or above a conductive substrate, and the first functional layer includes the compound represented by Formula (I), described later. The compound represented by Formula (I) is a compound that may be used as a charge transporting property compound in an electrophotographic photoreceptor, and also it is a compound that hardens on its own by heating, with the addition of a catalyst or the like as required, and has the characteristics of displaying stable electrical properties.

Furthermore, regarding the compound represented by Formula (I), it is preferable that it is a compound that is also represented by Formula (II), described later. The compound represented by Formula (II) is a compound that may be used as a charge transporting property compound in an electrophotographic photoreceptor, and also it is a compound that hardens on its own by heating, with the addition of a catalyst or the like as required, and has the characteristics of displaying stable electrical properties.

It is preferable that the above first functional layer is the outermost surface layer, disposed in a photosensitive layer at the side furthest from the conductive substrate.

A cured resin that is obtained by curing the compound represented by above Formula (I) may be used.

A cross-linking resin may be used with the compound represented by above Formula (I).

Also, for the photosensitive layer, it is preferable to have a second functional layer containing a hydroxygallium phthalocyanine pigment which has maximum absorption wavelength in the range of from 810 nm to 839 nm in the spectral absorption spectrum in the wavelength band of from 600 nm to 900 nm. This second functional layer may be the same layer as the first functional layer, or may be a different layer. When there are two or more absorption maxima that exist in the spectral absorption spectrum in the wavelength band of from 600 nm to 900 nm, by the above maximum absorption wavelength is meant the absorption maximum wavelength which shows the greatest degree of absorption.

Conventionally, various investigations have been made in order to try and improve the electrophotographic properties of photo conductive materials used for electrophotographic photoreceptors. In particular, regarding phthalocyanine compounds, there are many reports about the relationship between the crystal form thereof and their accompanying electrophotographic properties. Generally, it is known that phthalocyanine compounds may be divided into plural crystal forms according to differences in the manufacturing methods thereof, or treatment methods thereof, and it is known that the photoelectric conversion characteristics of phthalocyanine compounds change with the differences in crystal form. Regarding the crystal forms of phthalocyanine compounds, for example, for non-metal phthalocyanine crystals there are known crystal forms such as alpha-type, beta-type, pi-type, gamma-type, and X-type. Many reports have also been made about the crystal form and electrophotographic properties regarding gallium phthalocyanine pigments. In particular, for such hydroxygallium phthalocyanine pigments, when hydroxygallium phthalocyanine pigments having a maximum absorption wavelength in the range of from 810 nm to 839 nm in the spectral absorption spectrum in the wavelength band of from 600 nm to 900 nm are applied to an electrophotographic photoreceptor, since such hydroxygallium phthalocyanine pigments express superior performance as photo conductive materials for electrophotographic photoreceptors and can suppress dark decay to a low level, charging potential attenuation of a photoreceptor is further suppressed. An image-forming apparatus and a process cartridge provided with such a photoreceptor may suppress the development of image defects, such as fogging, black spots/white spots, a phenomenon in which an image appears from a still remaining previously formed image (sometimes referred to below as a "ghost" or "ghosting"), and unevenness in density, and with such an image-forming apparatus or process cartridge stable image quality may be obtained over a long period of time.

Details of exemplary embodiments of this invention will now be described, with reference to the drawings. FIG. 1 is a schematic cross-section showing an electrophotographic photoreceptor according to an exemplary embodiment. Electrophotographic photoreceptor 1 as shown in FIG. 1 is a functionally separated photoreceptor (or layered photoreceptor), and has a structure where an undercoating layer 4, a charge generating layer 5, a charge transport layer 6, and a protective layer 7 are stacked (layered) one by one onto a conductive substrate 2. In the electrophotographic photoreceptor 1, the photosensitive layer 3 is configured by the undercoating layer 4, the charge generating layer 5, the charge transport layer 6, and the protective layer 7. Also, in the electrophotographic photoreceptor 1 shown in FIG. 1, the protective layer 7 is the outermost surface layer disposed at the side furthest from the conductive substrate 2, and the protective layer 7 is the first functional layer containing the compound represented by above Formula (I).

Now, each element configuring the electrophotographic photoreceptor as shown in FIG. 1 will be explained. The conductive substrate 2 may be configured with, for example, a metal plate, a metal drum, or a metal belt or the like, using a metal or alloy, such as aluminum, copper, zinc, stainless steel, chromium, nickel, molybdenum, vanadium, indium, gold, and platinum. Other materials that may be used as the conductive substrate 2 include: conductive compounds, such as a conductive polymer or indium oxide; paper, plastic films, or belts or the like coated, vapor-deposited or laminated thereon with a metal or an alloy, such as aluminum, palladium, or gold. Here, "conductivity" means that the volume resistivity is less than $10^{13}$ Ωcm.

It is preferable to carry out surface roughening to the surface of the conductive substrate 2, in order to prevent interference fringes being produced when irradiating with a laser beam, to from a ten point average roughness height (Rz) of about 0.04 μm to about 0.5 μm by. By using non-interfering light as a light source, the need for surface roughening for the prevention of interference fringes is not particularly necessary, and since the development of defects due to irregularities in the conductive substrate 2 surface can be prevented, a configuration such as this is more suitable for extending the life-span thereof.

Preferable examples of methods of surface roughening include wet honing performed by spraying water with a suspended abrasive compound onto a substrate, or pressing a support to a rotating grinding stone, centerless grinding which is continuous grinding process, anodizing treatment or the like.

Furthermore, as another preferable method of surface roughening that may be used, without carrying out surface roughening to the surface of the conductive substrate 2, conductive or semiconducting fine particles may be distributed in a resin, and a layer formed on a substrate surface, to thereby carry out surface roughening due to the particles distributed within the layer.

In the above anodizing treatment an oxide film is formed on an aluminum surface by using aluminum as an anode and anodizing in an electrolytic solution. As such an electrolytic solution, a sulfuric acid solution, an oxalic acid solution, or the like may be used. However, as it is, a porous oxide film on an anode is chemically active, it is readily soiled, and the resistance change thereof due to the environment is also large. Therefore, a sealing treatment may be carried out which closes the pores of the oxide film on the anode with cubical expansion due to a hydration reaction under pressurized steam or in boiling water (a metal salt, such as nickel, may be added), changing the oxide into a more stable hydrated oxide.

The film thickness of the oxide film on the anode is preferably from about 0.3 μm to about 15 μm.

Furthermore, the conductive substrate 2 may be treated with by aqueous acids or with a boehmite treatment. Treatment with an acid treatment liquid containing phosphoric acid, chromic acid, and fluoric acid is carried out as follows. First, the acid treatment liquid is prepared. The blending ratio of phosphoric acid, chromic acid, and fluoric acid in the acid treatment liquid is: phosphoric acid in the range of from about 10 weight % to about 11 weight %; chromic acid in the range of from about 3 weight % to about 5 weight %; and, fluoric acid in the range from about 0.5 weight % to about 2 weight %. The total concentration of these acids has the preferable range of from about 13.5 weight % to about 18 weight %. The treatment temperature is preferably from about 42° C. to about 48° C., and by keeping the treatment temperature high, compared with when the treatment temperature is low, a coating film may be formed more quickly and thickly. The coating film thickness preferably is from about 0.3 μm to about 15 μm.

Boehmite treatment is performed by immersing in pure water for about 5 minutes to about 60 minutes at 90° C. to 100° C., or by contacting with heated steam at 90° C. to 120° C. for about 5 minutes to about 60 minutes. The film thickness of such a coat is preferably from about 0.1 μm to about 5 μm. Anodizing of such a film may be further carried out using a low electrolytic solution that has the ability to dissolve the coating film (such as adipic acid, boric acid, borate salt, phosphate salt, phthalate salt, maleate salt, benzoate salt, tartrate salt, citrate salt, and the like).

The undercoating layer 4 is formed on the conductive substrate 2. The undercoating layer 4 is, for example, configured to include at least an organometallic compound and/or a binder resin.

Organometallic compounds that may be used include: organic zirconium compounds such as zirconium chelate compounds, zirconium alkoxide compounds, and zirconium coupling agents; organic titanium compounds, such as titanium chelate compounds, titanium alkoxide compounds and titanate coupling agents; organoaluminum compounds, such as aluminum chelate compounds and aluminum coupling agent; antimony alkoxide compounds; germanium alkoxide compounds; indium alkoxide compounds; indium chelate compounds; manganese alkoxide compounds; manganese chelate compounds; tin alkoxide compounds; tin chelate compounds; aluminum silicon alkoxide compounds; aluminum titanium alkoxide compounds; and aluminum zirconium alkoxide compounds.

In order to display good electrophotographic properties with low residual potential, organic zirconium compounds, organic titanyl compounds, and organoaluminum compounds are especially preferably used as such organometallic compounds.

As such a binder resin, known materials may be used, examples thereof including: polyvinyl alcohols, polyvinyl methyl ethers, poly-N-vinylimidazole, polyethylene oxides, ethyl celluloses, methyl celluloses, ethylene-acrylic acid copolymers, polyamides, polyimides, caseins, gelatins, polyethylene, polyesters, phenol resins, vinyl chloride-vinyl acetate copolymers, epoxy resins, polyvinyl pyrrolidone, polyvinyl pyridine, polyurethanes, polyglutamic acid, and polyacrylic acid. When used in combinations of two or more, the mixing ratio is set according to the requirements.

In the undercoating layer 4, silane coupling agents may be included, such as vinyl trichlorosilane, vinyltrimetoxysilane, vinyltriethoxysilane, vinyltris(2-methoxyethoxy) silane, vinyltriacetoxysilane, γ-glycidoxypropyltrimethoxysilane, γ-methacryloxpropyltrimethoxysilane, γ-aminopropyltriethoxysilane, γ-chloropropyltrimetoxysilane, γ-(2-aminoethyl)-aminopropyl trimethoxysilane, γ-mercaptopropyltrimethoxysilane, γ-ureidopropyltriethoxysilane, and β-3,4-epoxycyclohexyl trimethoxysilane.

Furthermore, from the viewpoint of reducing the residual potential, and of environmental stability, a pigment with electron transporting ability may be used mixed/dispersed in the undercoating layer 4. As such a pigment with electron transporting ability, examples include: organic pigments, such as a perylene pigment, a bisbenzimidazole perylene pigment, a polycyclic quinone pigment, an indigo pigment, or a quinacridone pigment described in JP-A No. S47-30330; and organic pigments such as bisazo pigments and phthalocyanine pigments which have a substituent group with electron accepting characteristics, such as a cyano group, a nitro group, a nitroso group, or a halogen atom; inorganic pigments such as zinc oxide, and titanium oxide.

Among these pigments, a perylene pigment, a bisbenzimidazole perylene pigment, a polycyclic quinone pigment, zinc oxide, or titanium oxide are preferably used, since electron mobility is high compared with other pigments.

Also, surface treatment may be carried out to the surface of these pigments by the above coupling agents, binder resins, or the like, in order to control the dispersibility and charge transporting properties thereof.

Since too much pigment with electron transporting ability will reduce the strength of the undercoating layer 4 and will cause coating film defects, they are preferably used up to about 95 weight %, relative to the total amount of solids of the undercoating layer 4, and more preferably up to about 90 weight %.

In the undercoating layer 4, depending on the purpose such as to improve the electrical properties and improve light-scattering characteristics, it is preferable to add a powder of various kinds of organic compounds, or a powder of an inorganic compound. In particular the following are effective: white pigments, such as titanium oxide, zinc oxide, zinc white, zinc sulfide, white lead, and lithopone; fillers such as alumina, calcium carbonate, and barium sulfate; polytetrafluoroethylene resin particles, benzoguanamine resin particles, styrene resin particles, and the like.

The volume average particle size of added powders is preferably from about 0.01 μm to about 2 μm. The addition of the powder is carried out as required, however, the addition is preferably from about 10 weight % to about 90 weight % relative to the total amount of solids of the undercoating layer 4, and it is more preferable that it is from about 30 weight % to about 80 weight %.

The undercoating layer 4 is formed using a coating liquid for undercoating layer formation containing each of the components above. As an organic solvent used for the coating liquid for undercoating layer formation, it should be an organic solvent that dissolves the organometallic compound and binder resin, and furthermore, does not gel or cause an aggregation when the pigment with electron transporting ability is mixed and/or dispersed therein.

Examples that may be given of such an organic solvent are, for example, ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be used singly or in mixtures of two or more.

Conventional methods may be applied as the mixing and/or the dispersion method of each component, such as a ball mill, a roll mill, a sand mill, an attritor, a vibration ball mill, a colloid mill, a paint shaker, an ultrasonic homogenizer or the like. Mixing and/or dispersion may be performed in an organic solvent.

As a coating method when forming the undercoating layer 4, ordinary methods may be used, such as a blade coating method, a wire bar coating method, a spray coating method, a dip coating method, a bead coating method, an air knife coating method, or a curtain coating method.

Drying is usually carried out to evaporate the solvent, and at a temperature at which a film can be formed. In particular it is preferable to form the undercoating layer 4 to a conductive substrate 2 that has been subjected to acidic solution treatment or boehmite treatment, since in such cases the ability to hide substrate defects readily becomes insufficient.

The film thickness of the undercoating layer 4 is preferably from about 0.01 μm to about 30 μm, and more preferably from about 0.05 μm to about 25 μm.

The charge generating layer 5 is configured to include a charge generating material, or to include a charge generating material and binder resin.

As such a charge generating material, well known materials may be used without any particular limitations, such as: organic pigments, such as fused ring aromatic pigments, such as azo pigments, such as bisazo and tris azo, and dibromo anthoanthrone or the like, perylene pigments, pyrolopyrrole pigments, and phthalocyanine pigments; and inorganic pigments, such as trigonal selenium, zinc oxide, and the like. As a charge generating material, when using a light source of exposure wavelength of from 380 nm to 500 nm, an inorganic pigment is preferable, and when using a light source of exposure wavelength of from 700 nm to 800 nm, a metal phthalocyanine pigment or a non-metal phthalocyanine pigment are preferable. Among these, the following are particularly preferably used: hydroxygallium phthalocyanines described in JP-A H5-263007 and JP-A H5-279591; chlorogallium phthalocyanines described in JP-A H5-98181; dichlorotin phthalocyanines described in JP-A H5-140472 and JP-A H5-140473; and titanylphthalocyanines described in JP-A H4-189873 and JP-A H5-43813.

The charge generating layer 5 is preferably a layer (the second functional layer) containing a hydroxygallium phthalocyanine pigment which has a maximum absorption wavelength in the range of from 810 nm to 839 nm in the spectral absorption spectrum in the wavelength band of from 600 nm to 900 nm. This specific hydroxygallium phthalocyanine pigment differs from a conventional Type-V hydroxygallium phthalocyanine pigment. In order to obtain excellent dispersibility, it is preferable that the pigment has a maximum absorption wavelength in the range of from 810 nm to 835 nm. In such a manner, by shifting the maximum absorption wavelength of the spectral absorption spectrum to the short wavelength side compared to that of a conventional Type-V hydroxygallium phthalocyanine pigment, the crystal arrangement of pigment particles becomes that of appropriately controlled fine hydroxygallium phthalocyanine pigment, and when used as a material for an electrophotographic photoreceptor superior dispersibility may be obtained, and sensitivity, electrostatic properties, and dark decay characteristics may be satisfied, and charging potential attenuation of a photoreceptor may be suppressed.

Here, with a phthalocyanine pigment, when the interaction between phthalocyanine molecules changes due to molecular arrangement in the crystals, as a result the state of molecular arrangement is usually reflected in the spectrum thereof. When a Type-V hydroxygallium phthalocyanine pigment is produced by a conventional manufacturing method having a maximum absorption wavelength (namely, absorption maximum) at from 840 nm to 870 nm, the absorption is extended to the long wavelength side. This indicates that the interaction between molecules is strong, and this is a state where charge readily flows within a crystal, and is hypothesized as being why increases in dark current and fogging and the like are readily generated. Molecular arrangement is controlled by controlling the conditions at the time of crystal synthesis, and by a hydroxygallium phthalocyanine pigment having the maximum absorption wavelength (namely, absorption maximum) in the range of from 810 nm to 839 nm in the spectral absorption spectrum in the wavelength band of the from 600 nm to 900 nm, superior electrophotographic properties and image quality characteristics may be obtained. It is hypothesized that such a hydroxygallium phthalocyanine pigment has the spectral absorption spectrum shifted to the short wavelength side due to the appropriate control of the crystal arrangement of the pigment particles, and the appropriate fineness thereof for improving the dispersibility.

It is preferable that the above specific hydroxygallium phthalocyanine pigment has Bragg angle diffraction peaks (2θ±0.2°) to CuKα X-ray at 7.5°, 9.9°, 12.5°, 16.3°, 18.6°, 25.1°, and 28.3°. It is also preferably that especially the above specific hydroxygallium phthalocyanine pigment has a diffraction full width at half maximum at the 7.5 degrees diffraction peak of from 0.35° to 1.20°. It should be noted that the high sensitivity Type-V hydroxygallium phthalocyanine produced by a conventional manufacturing method, such as described in the Journal of Imaging Science and Technology, Vol. 40, No. 3, May/June, 249 (1996), JP-A H5-263007, JP-A H7-53892, or the like, although having Bragg angle diffraction peaks (2θ±0.2°) to CuKα X-ray at 7.5°, 9.9°, 12.5°, 16.3°, 18.6°, 25.1°, and 28.3°, has a diffraction full width at half maximum for the 7.5° diffraction peak of less than 0.35, and it is clear that the specific hydroxygallium phthalocyanine pigment differs from a conventional hydroxygallium phthalocyanine pigment.

The number average particle size of the above specific hydroxygallium phthalocyanine pigment is preferable about 0.10 μm or smaller, and it is more preferably about 0.08 μm or smaller. Furthermore, it is preferable for the specific surface area value by a BET adsorption method to be about 45 $m^2/g$ or greater, it is more preferable that it is about 50 $m^2/g$ or greater, and it is particularly preferably about 55 $m^2/g$ or greater.

An example that may be given of a method for carrying out crystal conversion, as a manufacturing method for the above specific hydroxygallium phthalocyanine pigment, is by carrying out wet grinding treatment of Type-I hydroxygallium phthalocyanine with a solvent. In this manufacturing method, in order that the spectral absorption spectrum of the hydroxygallium phthalocyanine pigment may have a maximum absorption wavelength (namely, absorption maximum) within the limits of from 810 nm to 839 nm in the wavelength band of from 600 nm to 900 nm, the duration of the wet-grinding treatment may be determined while monitoring the crystal conversion state by measuring the absorption wavelength measurement of the wet-grinding treatment liquid so that the specific hydroxygallium phthalocyanine pigment having a maximum absorption wavelength (namely, absorption maximum) within the limits of from 810 nm to 839 nm is obtained. It should be noted that that the specific hydroxygallium phthalocyanine pigment obtained with such a described method has a smaller pigment particle size compared with cases in which it is produced by other methods, and the variation of the particle size is suppressed.

The Type-I hydroxygallium phthalocyanine used as a raw material in the manufacturing method of the above specific hydroxygallium phthalocyanine pigment is conventionally obtained by a well known method. An example thereof is given below.

First, raw gallium phthalocyanine is manufactured by: a method of reacting o-phthalodinitrile or 1,3-diiminoisoindoline with gallium trichloride in a predetermined solvent (Type-I chlorogallium phthalocyanine method); a method of heating and reacting together o-phthalodinitrile, alkoxy gallium and ethylene glycol in a predetermined solvent and preparing a phthalocyanine dimer (phthalocyanine dimer method); or other similar method. It is preferable to use an inert solvent with a high boiling point as a solvent for the above reactions, such as α-chloronaphthalene, β-chloronaphthalene, α-methylnaphthalene, methoxy naphthalene, dimethylamino ethanol, diphenylethane, ethylene glycol, dialkyl ether, quinoline, sulfolane, dichlorobenzene, dimethylformamide, dimethyl sulfoxide, or dimethylsulfoamide.

Next, by performing acid pasting treatment to the raw gallium phthalocyanine obtained by one of the above processes, while making the raw gallium phthalocyanine into fine particles, the gallium phthalocyanine is changed into a Type-I hydroxygallium phthalocyanine pigment. Here, acid pasting treatment means specifically pouring the raw gallium phthalocyanine dissolved in an acid, such as sulfuric acid, or a salt thereof such as a sulfate, into an alkaline aqueous solution, water, or ice water, and making it recrystallize. Sulfuric acid is preferable as an acid used for acid pasting treatment, and sulfuric acid of concentration from about 70 weight % to about 100 weight % is more preferable (from about 95 weight % to about 100 weight % is particularly preferable).

Although the specific hydroxygallium phthalocyanine pigment may be obtained, for example, by carrying out wet grinding treatment with a solvent of the above Type-I hydroxygallium phthalocyanine pigment obtained using the above acid pasting treatment, and by carrying out crystal conversion thereto, it is preferable to use a grinding device to carry out wet grinding treatment using a spherical shape media of outside diameter from about 0.1 mm to about 3.0 mm, and a spherical shape media of outside diameter from about 0.2 mm to about 2.5 mm is particularly preferable. When the outside diameter of media is larger than 3.0 mm, since grinding efficiency falls, there is a tendency for aggregations to be generated without the particle size being decreased.

Although the substance of such a media is not particularly limited, glass, zirconia, alumina, agate, and the like may be preferably used, since when mixing with the pigment they does not readily generate image quality defects.

Although the amount of the media used depends on the device to be used, it is preferable that it is from about 1 part by weight to about 1000 parts by weight relative to 1 part by weight of Type-I hydroxygallium phthalocyanine pigment, and it is more preferable that it is from about 10 parts by weight to about 100 parts by weight. Furthermore, if the outside diameter of media becomes small then, for the same amount by weight of the media, the density of the media in the device will increase, increasing the viscosity the mixing solution and changing the grinding efficiency. Therefore it is preferable that as the media outside diameter is decreased, to also control the amount of the media used and the amount of the solvent used, so as to perform the wet processing with the optimal mixing ratio.

Although there are no particularly limitations to the substance of the container in which wet grinding treatment is carried out, glass, zirconia, alumina, agate, polypropylene, polytetrafluoroethylene, polyphenylene sulfide, and the like may be appropriately used, since when the pigment is mixed therein, image quality defects are not readily generated. Also, glass, polypropylene, polytetrafluoroethylene, polyphenylene sulfide, or the like may be used to line the inner surface of metal containers, such as iron and stainless steel.

The temperature of wet grinding treatment is preferably from about 0° C. to about 100° C., about 5° C. to about 80° C. is more preferable, and about 10° C. to about 50° C. is particularly preferable.

Examples that may be given of solvents for use in the wet grinding treatment include: amides, such as N,N-dimethylformamide, N,N-dimethylacetamide and N-methylpyrrolidone; esters, such ethyl acetate, n-butyl acetate, and isoamyl acetate; ketones, such as acetone, methyl ethyl ketone, and methyl iso-butyl ketone; and also dimethyl sulfoxide and the like. The amount of these solvents used is preferable from about 1 part by weight to about 200 parts by weight relative to 1 part by weight of hydroxygallium phthalocyanine pigment, and from about 1 part by weight to about 100 parts by weight is more preferable.

Devices which use media as a dispersion medium, such as, for example, a vibration mill, an automatic mortar, a sand mill, a Dynomill, a co-ball mill, an attritor, a planetary ball mill, a ball mill or the like, may be used as the device for wet grinding treatment.

Although the progress speed of crystal conversion is greatly influenced by the scale of a wet-grinding treatment process, the stirring speed, the substance of the media, and the like, in order that the spectral absorption spectrum of hydroxygallium phthalocyanine pigment may have a maximum absorption wavelength (namely, absorption maximum) within the limits of from 810 nm to 839 nm in the wavelength band of from 600 nm to 900 nm, wet-grinding treatment should be continued, while monitoring the crystal conversion state by measuring the absorption wavelength, until the pigment is changed into a hydroxygallium phthalocyanine pigment which has a maximum absorption wavelength (namely, absorption maximum) within the limits of from 810 nm to 839 nm. Generally, the processing time of the wet grinding treatment is preferably in the range of from about 5 hours to about 500 hours, and is more preferably from about 7 hours to about 300 hours. When the processing time is less than 5 hours, crystal conversion is incomplete, reducing the electrophotographic properties, and there is a tendency in particular for the problem of the sensitivity being insufficient to readily occur. When processing time is greater than 500 hours, there is the tendency that the sensitivity is lowered due to the influence of grinding stress, or problems in production to readily occur, such as mixing in of abraded powder from the media or the like. By determining the duration of the wet-grinding treatment in this way, wet grinding treatment is completed after hydroxygallium phthalocyanine pigment particles have been formed into particles without variation therebetween, and lot-to-lot quality variation may be suppressed when carrying out repeated wet grinding treatments of two or more lots.

Although it is preferable to include the above specific hydroxygallium phthalocyanine pigment in the charge generating layer 5, however it may be included in other layers.

Other charge generating materials, other than the specific hydroxygallium phthalocyanine pigment may be used in combination therewith, from the viewpoint of adjusting the sensitivity, dispersibility control, and the like, such as azo pigments, perylene pigments, and fused ring aromatic pigments and the like. It is preferable to use metal or non-metal phthalocyanines as such other charge generating materials, and among these it is particularly preferable to use, other than the above specific hydroxygallium phthalocyanine pigment, a hydroxygallium phthalocyanine pigment, a chlorogallium phthalocyanine pigment, a dichlorotin phthalocyanine pigment, or an oxytitanyl phthalocyanine pigment. The blending quantity of such other charge generating materials is preferable about 50 weight % or less relative to the weight of all substances included in the charge generating layer 5.

A binder resin used for the charge generating layer 5 may be chosen from a wide range of insulating resins. Furthermore, it may be chosen from organic photoconductive polymers, such as poly-N-vinylcarbazole, polyvinyl anthracenes, polyvinyl pyrenes, and polysilanes. Examples that may be given of preferable binder resins include, but are not limited to, polyvinyl butyral resin, polyarylate resins (polycondensates of bisphenol A and phthalic acid and the like), polycarbonate resin, polyester resin, phenoxy resins, vinyl chloride-vinyl acetate copolymers, polyamide resins, acrylic resins, polyacrylamide resins, polyvinyl pyridine resins, cellulose resins, urethane resins, epoxy resins, caseins, polyvinyl alcohol resins, and polyvinyl pyrrolidone resins. However, it should be noted that the binder resin is not limited thereto. Here, by "insulating" it is meant that the volume resistivity is $10^{13}$ Ωcm or greater.

The charge generating layer 5 is formed by vapor deposition of a charge generating material, or by using a coating liquid for charge generating layer formation containing a charge generating material and a binder resin. When forming the charge generating layer 5 using such a coating liquid for charge generating layer formation, the compounding ratio (weight ratio) of charge generating material to binder resin has the preferable range of about 10:1 to about 1:10. When using the above specific hydroxygallium phthalocyanine pigment as such a charge generating material the compounding ratio (weight ratio) of the hydroxygallium phthalocyanine pigment to the binder resin is preferably about 40:1 to about 1:4 preferable, and about 20:1 to about 1:2 is more preferable, from a viewpoint of the dispersibility of the pigment in dispersion liquid, and the sensitivity of an electrophotographic photoreceptor.

Normal methods may be used as a method for dispersing such materials, such as, for example, a ball mill dispersion method, an attritor dispersion method, and a sand mill dispersion method. It should be noted that conditions that do not change the appropriate crystal form are required for the dispersion. Furthermore, with each of the above dispersion methods it should be confirmed that there is no change to the crystal from before dispersion to after dispersion. Also, when carrying out the dispersion, it is effective to make particles of about 0.5 μm or less, more preferably about 0.3 μm or less, still more preferable about 0.15 μm or less.

Examples that may be given of the solvent used for the dispersion are ordinary organic solvents, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be used singly or in mixtures of two or more.

When forming the charge generating layer 5 using the coating liquid for charge generating layer formation, ordinary methods may be used as the coating method, such as, for example, a blade coating method, a Mayer bar coating method, a spray coating method, a dip coating method, a bead coating method, an air knife coating method, or a curtain coating method.

The film thickness of the charge generating layer 5 is preferably from about 0.1 μm to about 5 μm, and from about 0.2 μm to about 2.0 μm is more preferable.

The charge transport layer 6 is configured to include a charge transporting material and a binder resin, or include a polymer charge-transporting material.

Examples that may be given of such charge transporting materials include compounds with electron transporting ability, such as: quinone based compounds, such as p-benzoquinone, chloranil, bromanil, anthraquinone; etracyanoquinodimethane compounds; fluorenone compounds, such as 2,4,7-trinitrofluorenone; xanthone compounds; benzophenone compounds; cyanovinyl compounds; and ethylene compounds. Examples of such charge transporting materials also include compounds with hole transporting ability, such as: triarylamine compounds; benzidine compounds; arylalkane compound; aryl substituted ethylene compounds; stilbene compounds; anthracene compounds; and hydrazone compounds. However, the charge transporting materials are not limited to these. These charge transporting materials may be used singly or in mixtures of two or more.

As a charge transporting material, the compound represented by the following formula is preferable from a viewpoint of charge mobility.

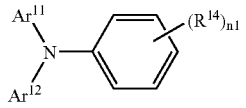

In the formula: $R^{14}$ represents a hydrogen atom or a methyl group; n1 is 1 or 2; $Ar^{11}$ and $Ar^{12}$ each independently represents a substituted or unsubstituted aryl group, —$C_6H_4$—C($R^{18}$)=C($R^{19}$)($R^{20}$), or —$C_6H_4$—CH=CH—CH=C$(Ar)_2$, such a substituent is a halogen atom, an alkyl group of 1 to 5 carbon atoms, an alkoxy group of 1 to 5 carbon atoms, or an alkyl group of 1 to 3 carbon atoms. $R^{18}$, $R^{19}$, and $R^{20}$ each independently represents a hydrogen atom, a substituted or unsubstituted alkyl group, or a substituted or unsubstituted aryl group. Ar represents a substituted or unsubstituted aryl group.

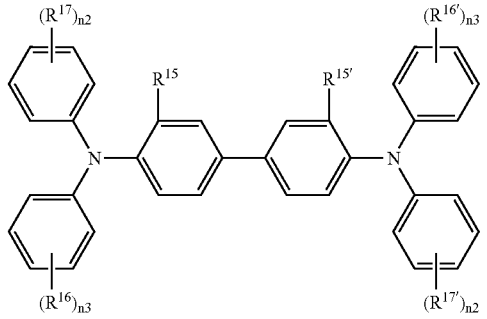

In the formula: $R^{15}$ and $R^{15'}$ each independently represents a hydrogen atom, a halogen atom, an alkyl group of from 1 to 5 carbon atoms, or an alkoxy group of from 1 to 5 carbon atoms. $R^{16}$, $R^{16'}$, $R^{17}$, and $R^{17'}$ each independently represents a hydrogen atom, a halogen atom, an alkyl group of from 1 to 5 carbon atoms, an alkoxy group of from 1 to 5 carbon atoms, an amino group substituted by an alkyl group of from 1 to 2 carbon atoms, a substituted or unsubstituted aryl group, $C(R^{18})=C(R^{19})(R^{20})$, or $—CH=CH—CH=C(Ar)_2$. $R^{18}$, $R^{19}$, and $R^{20}$ each independently represents a hydrogen atom, a substituted or unsubstituted alkyl group, or a substituted or unsubstituted aryl group. Ar represents a substituted or unsubstituted aryl group. n2 and n3 each independently represents an integer of from 0 to 2.

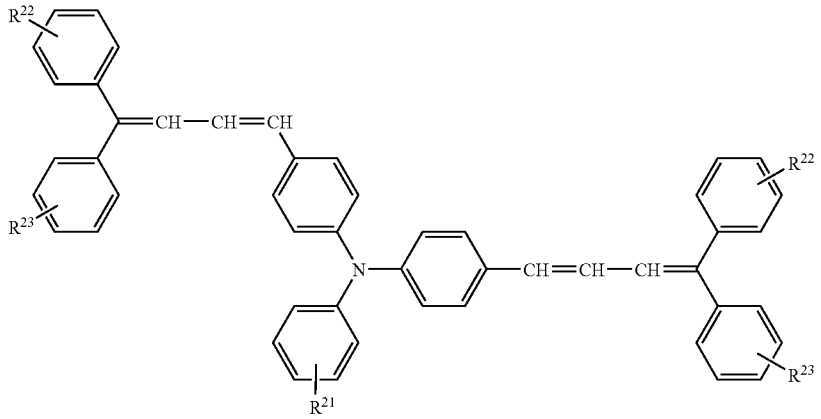

In the formula: $R^{21}$ represents a hydrogen atom, an alkyl group of from 1 to 5 carbon atoms, an alkoxy group of from 1 to 5 carbon atoms, a substituted or unsubstituted aryl group, or $—CH=CH—CH=C(Ar)_2$. Ar represents a substituted or unsubstituted aryl group. $R^{22}$ and $R^{23}$ each independently represents a hydrogen atom, a halogen atom, an alkyl group of from 1 to 5 carbon atoms, an alkoxy group of from 1 to 5 carbon atoms, an amino group substituted by an alkyl group of from 1 to 2 carbon atoms, or a substituted or unsubstituted aryl group.

Examples that may be given for the binder resin used for the charge transport layer 6 include: polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, and the like. Such binder resins may be used singly or in mixtures of two or more. The compounding ratio (weight ratio) of the charge transporting material and the binder resin is preferably about 10:1 to about 1:5.

Well known polymers with charge transporting properties may be used as a polymer charge-transporting material, such as poly-N-vinylcarbazole and polysilanes. Polyester based polymer charge-transporting materials described in JP-A H8-176293 and JP-A H8-208820 have particularly high charge transporting properties compared to other compounds, and are therefore particularly preferable.

Polymer charge-transporting materials may be used alone as the component of the charge transport layer 6, however, they may also be mixed with the above binder resins to form a film.

The charge transport layer 6 may be formed using a coating liquid for charge transport layer formation containing the above component(s).

Examples that may be given of a solvent for the coating liquid for charge transport layer formation are ordinary organic solvents including: aromatic hydrocarbons, such as benzene, toluene, xylene, and chlorobenzene; ketones such as acetone, 2-butanone; halogenated aliphatic hydrocarbon, such as methylene chloride, chloroform, and ethylene chloride; cyclic or linear ethers, such as tetrahydrofuran and ethyl ether. These may be used singly or in mixtures of two or more.

Ordinary methods may be used as a coating method for the coating liquid for charge transport layer formation, such as a blade coating method, a wire bar coating method, a spray coating method, a dip coating method, a bead coating method, an air knife coating method, of a curtain coating method.

The film thickness of the charge transport layer 6 is preferably from about 5 μm to about 50 μm, and from about 10 μm to about 30 μm is more preferable.

The protective layer 7 is the outermost surface layer in the electrophotographic photoreceptor 1, and is a layer provided in order to give resistance to abrasion and scratching of the surface layer, and to raise the transfer efficiency of the toner. The protective layer 7 is a layer containing the compound represented by the following Formula (I). In particular, the protective layer 7 may be configured to include a cured material of a composition including the compound represented by the following Formula (I).

Specifically, the protective layer 7 may be, for example: 1) configured with a cured material formed by curing, on its own, a compound represented by the following Formula (I); 2) configured to include a compound represented by the following Formula (I) in a cured material made from cross-linking a cross-linking compound; or 3) configured as a cross-linked resin from cross-linking a compound represented by the following Formula (I) with a cross-linking compound.

(I)

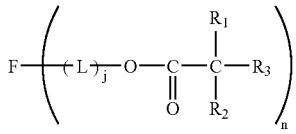

In Formula (I), F represents an n-valent organic group with hole transportation ability; $R_1$, $R_2$, and $R_3$ each independently represents a hydrogen atom, a halogen atom, or a monovalent organic group; L represents a divalent organic group; n represents an integer of 1 to 4; and j represents 0 or 1.

A preferably example of the compound represented by above Formula (I) is a compound that is also represented by the following Formula (II).

(II)

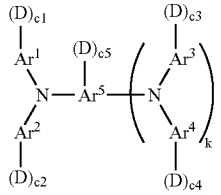

In Formula (II), $Ar^1$, $Ar^4$, $Ar^3$, and $Ar^4$ each independently represents a substituted or unsubstituted aryl group or a substituted or unsubstituted allylene group; and $Ar^5$ represents a substituted or unsubstituted aryl group or a substituted or unsubstituted allylene group; c1, c2, c3, c4, and c5 each independently represents 0 or 1; k represents 0 or 1; D represents a monovalent organic group represented by the following Formula (III); and the total of c1, c2, c3, c4, and c5 is from 1 to 4.

(III)

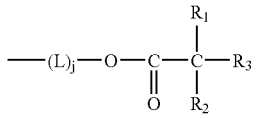

In Formula (III), $R_1$, $R_2$, and $R_3$ each independently represents a hydrogen atom, a halogen atom, or a monovalent organic group; L represents a divalent organic group; and j represents 0 or 1.

In the above Formulae (I) and (III) $R_1$, $R_2$, and $R_3$ each independently represents a hydrogen atom, a halogen atom, or a monovalent organic group, and preferably represent a monovalent organic group. Such a monovalent hydrocarbon group is: preferably a monovalent organic group with from 1 to 18 carbon atoms; more preferably a monovalent organic group with from 1 to 18 carbon atoms that may be substituted with a halogen atom, or a group represented by $—(CH_2)_r—O—R^4$; and even more preferably an alkyl group of from 1 to 4 carbon atoms, or a group represented by $—(CH_2)_r—O—R^4$; and especially preferably a methyl group. Furthermore, from the point of view of solubility and film forming ability, a preferably combination of $R_1$, $R_2$, and $R_3$ in one in which $R_1$ and $R_2$ are hydrogen atoms, and $R_3$ is a hydrogen atom, an alkyl group of from 1 to 4 carbon atoms, or a group represented by $—(CH_2)_r—O—R^4$. Although $R^4$ may represent a hydrocarbon group of from 1 to 6 carbon atoms, and it may form a ring, however, it is preferable that $R^4$ is an aliphatic hydrocarbon groups, such as a methyl group, an ethyl group, a propyl group, or a butyl group. r represents an integer of 1 to 12, and it is preferable that it is an integer of from 1 to 4. Also, L represents a divalent organic group in the above Formulae (I) and (III). As such an organic group divalent, it is preferable that it is an alkylene group of from 1 to 18 carbon atoms which may be branched, and, from a point of view of improving the electrical properties, it is more preferable that it is a methylene group. In the above Formulae (I) and (II), when there are two or more of $R_1$, $R_2$ and $R_3$, or L, each may be the same as or different from each other.

The substituted or unsubstituted aryl groups or substituted or unsubstituted allylene groups that are represented by $Ar^1$, $Ar^2$, $Ar^3$, and $Ar^4$ in the above Formula (II) are preferably a group represented by the following formulae (1) to (7). However, the aryl group or allylene group connected with each $Ar^1$ to $Ar^4$ [equivalent to $(D)_{C1}$, $(D)_{C2}$, $(D)_{C3}$, and $(D)_{C4}$] is represented in the following formulae (1) to (7) by $(D)_c$.

(1)

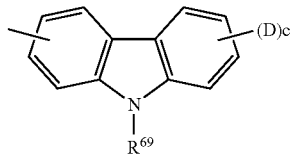

(2)

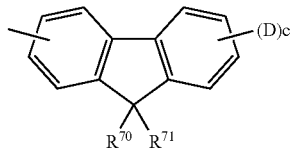

(3)

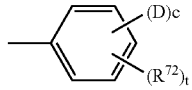

(4)

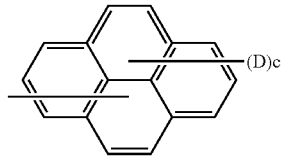

(5)

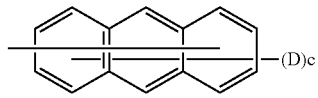

(6)

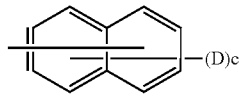

(7)

In the above formulae (1) to (7), $R^{69}$ represents a hydrogen atom, an alkyl group of from 1 to 4 carbon atoms, a phenyl group substituted by an alkyl group of from 1 to 4 carbon atoms or by an alkoxy group of from 1 to 4 carbon atoms, an unsubstituted phenyl group, or an aralkyl group of from 7 to 10 carbon atoms; $R^{70}$ to $R^{72}$ each independently represents a hydrogen atom, an alkyl group of from 1 to 4 carbon atoms, an alkoxy group of from 1 to 4 carbon atoms, a phenyl group substituted by an alkoxy group of from 1 to 4 carbon atoms, an unsubstituted phenyl group, an aralkyl group of from 7 to 10 carbon atoms, or a halogen atom. Ar represents a substituted or unsubstituted allylene group; Ar' represents a substituted or unsubstituted aryl group or a substituted or unsubstituted allylene group; D represents a monovalent organic group in the above Formula (III); c corresponds to c1, c2, c3, or c4 in the above Formula (II) and is either 0 or 1; s represents 0 or 1; and t represents an integer of 1 to 3.

An allylene group represented by the following formulae (8) or (9) is preferable as the Ar and Ar' groups in the above formula (7).

(8)

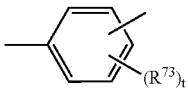

(9)

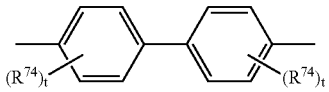

In the above formulae (8) and (9), $R^{73}$ and $R^{74}$ each independently represents a hydrogen atom, an alkyl group of from 1 to 4 carbon atoms, an alkoxy group of from 1 to 4 carbon atoms, a phenyl group substituted by an alkoxy group of from 1 to 4 carbon atoms, an unsubstituted phenyl group, an aralkyl group of from 7 to 10 carbon atoms, or a halogen atom; and t represents an integer of 1 to 3.

A divalent group represented by the following formulae (10) to (17) is preferable as Z' in the aryl group represented by the above formula (7).

(10)

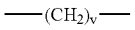

(11)

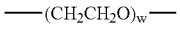

(12)

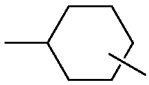

(13)

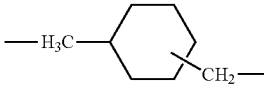

(14)

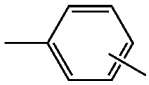

(15)

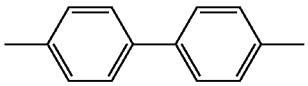

(16)

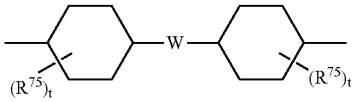

-continued (17)

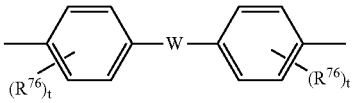

In the above formulae (10) to (17), $R^{71}$ and $R^{76}$ each independently represents a hydrogen atom, an alkyl group of from 1 to 4 carbon atoms, an alkoxy group of from 1 to 4 carbon atoms, a phenyl group substituted by an alkoxy group of from 1 to 4 carbon atoms, an unsubstituted phenyl group, an aralkyl group of from 7 to 10 carbon atoms, or a halogen atom; W represents a divalent group; v and w each independently represents an integer of from 1 to 10; and t represents an integer of 1 to 3.

In the above formulae (16) to (17) a divalent group represented by the following formulae (18) to (26) is preferably for W. In formula (25), u represents an integer of 0 to 3.

(18) —$CH_2$—

(19) —$C(CH_3)_2$—

(20) —O—

(21) —S—

(22) —$C(CF_3)_2$—

(23) —$Si(CH_3)_2$—

(24)

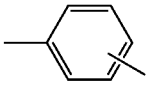

(25)

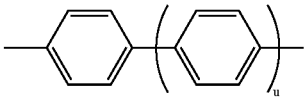

(26)

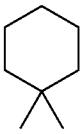

In the above Formula (II), as specific structures of $Ar^5$, when k is 0, $Ar^5$ is an aryl group represented by the specific structures of the above $Ar^1$ to $Ar^4$ (formulae (1) to (7)) or an allylene group, and when k is 1, $Ar^5$ is an allylene group represented by the specific structures of the above $Ar^1$ to $Ar^4$ (formulae (1) to (7)). In such a case, "$(D)_c$" in the specific structures of $Ar^5$ represented by the above $Ar^1$ to $Ar^4$ specific structures (formulae (1) to (10)), is equivalent to $D_{c5}$ in the above Formula (II).

Furthermore, the compounds represented below are examples that may be given of compounds represented by the above Formula (I) (by the above Formula (II)). In the following table, Me or a bond (—) are shown, but where a substituent is not indicated then these represent a methyl group, Et represents an ethyl group, and Pr represents an n-propyl group.

I-1
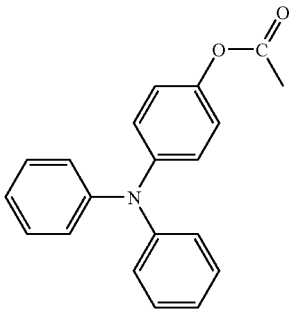
I-2
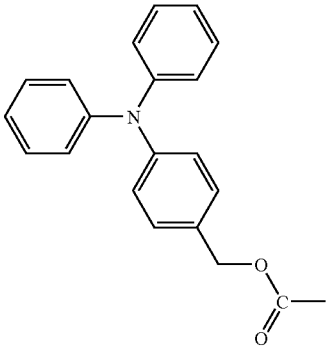
I-3
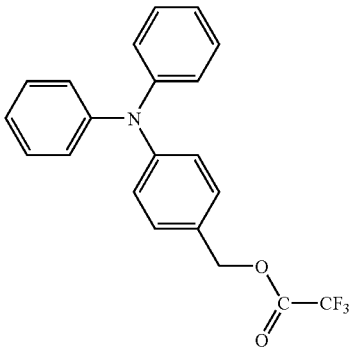
I-4
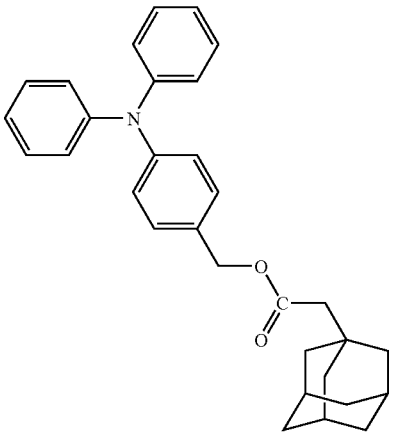
I-5
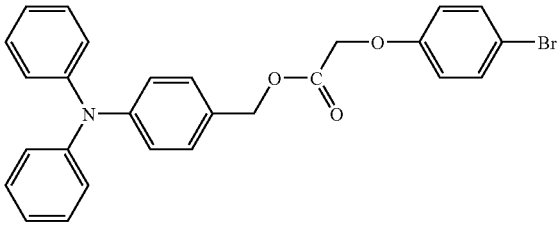
I-6
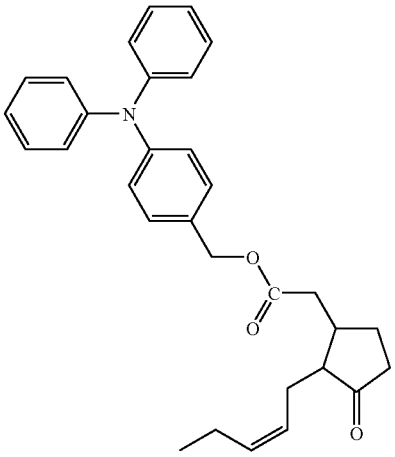
I-7
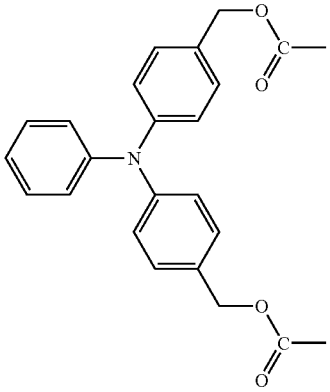
I-8
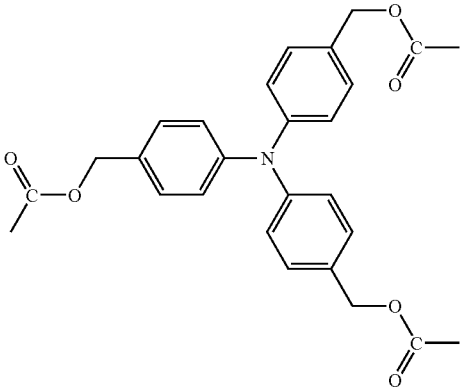

-continued
I-9
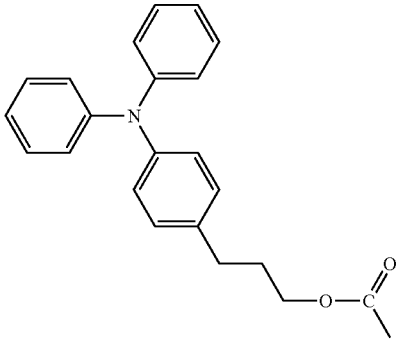
I-10
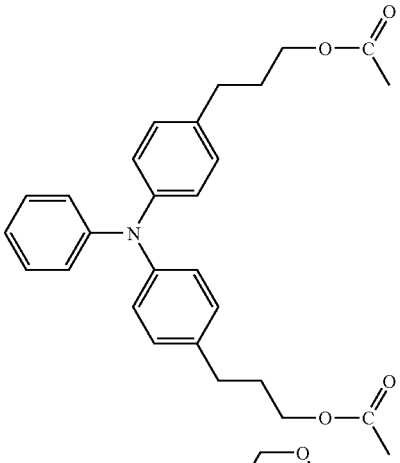
I-11
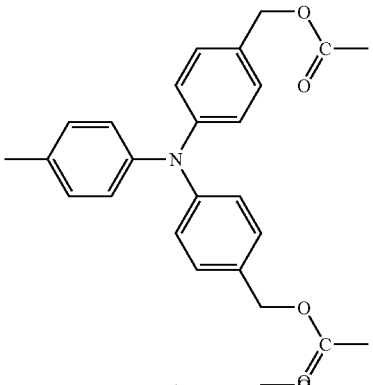
I-12
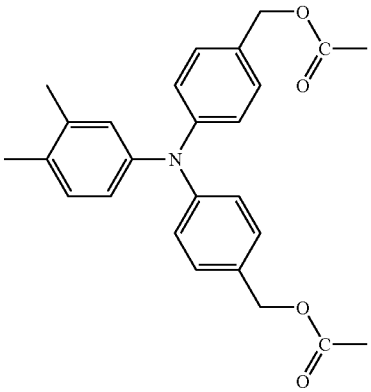
I-13
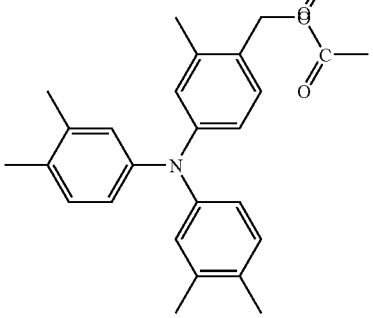
I-14
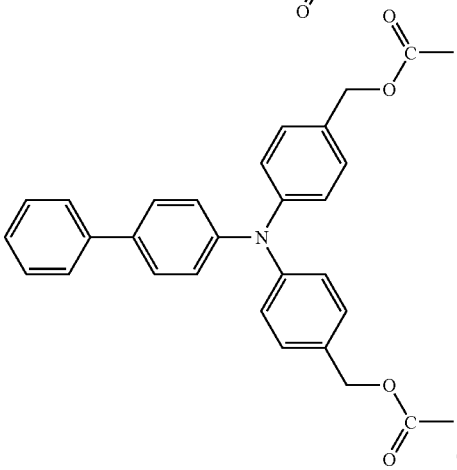
I-15
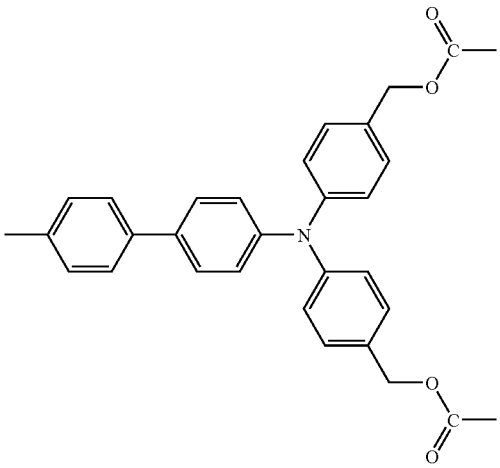
I-16
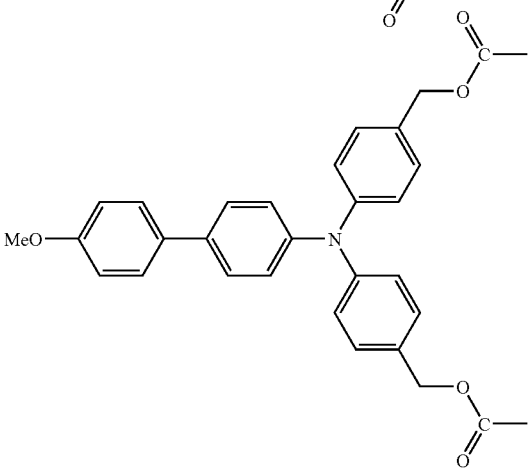

-continued
I-17
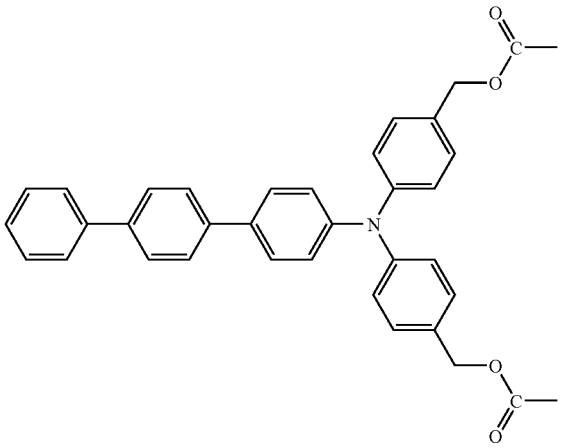
I-18
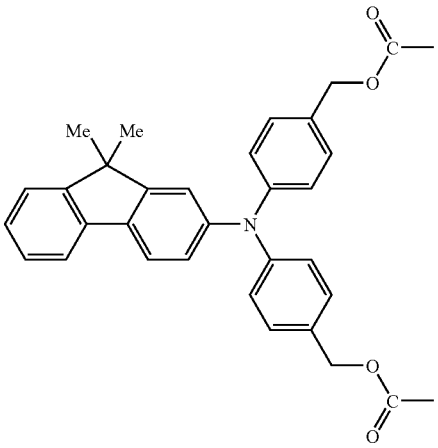
I-19
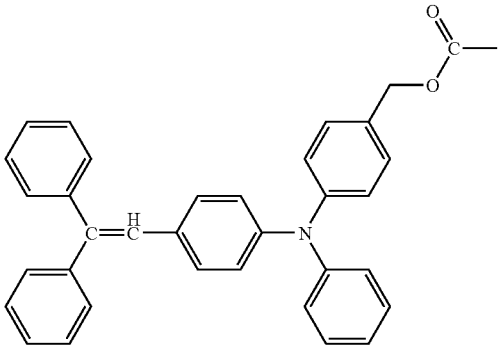
I-20
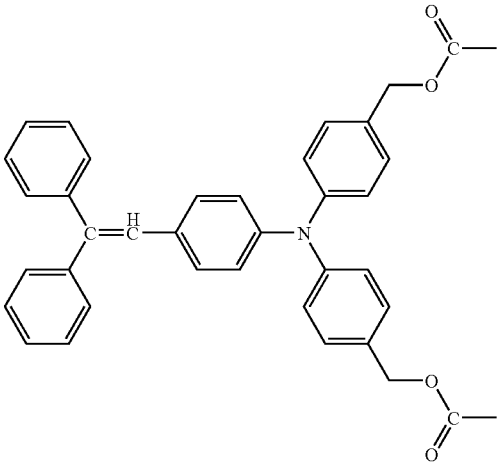
I-21
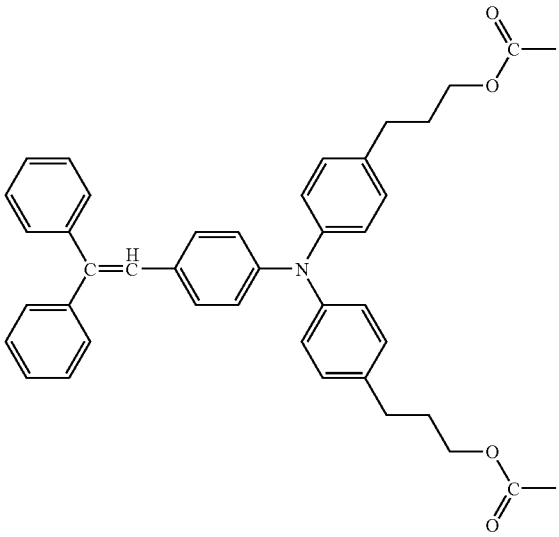
I-22
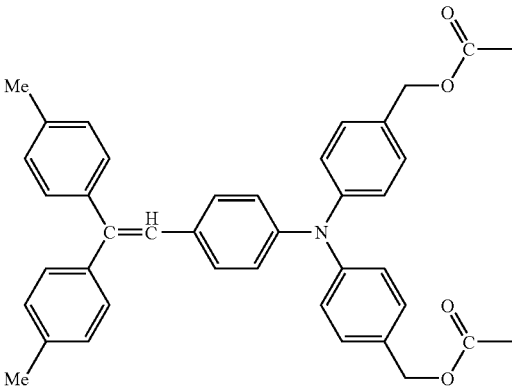

-continued
I-23
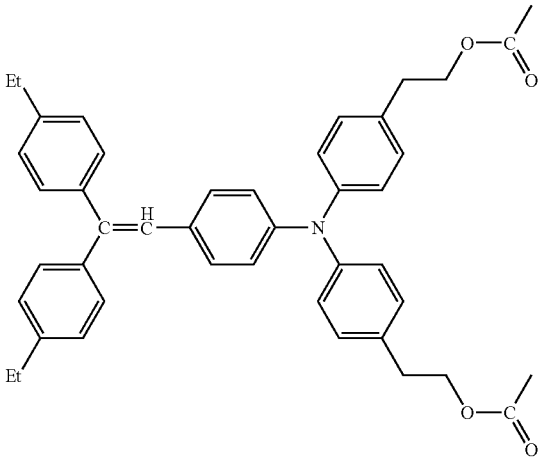
I-24
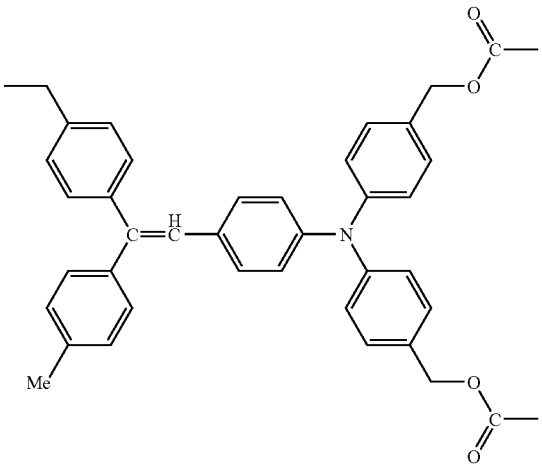
I-25
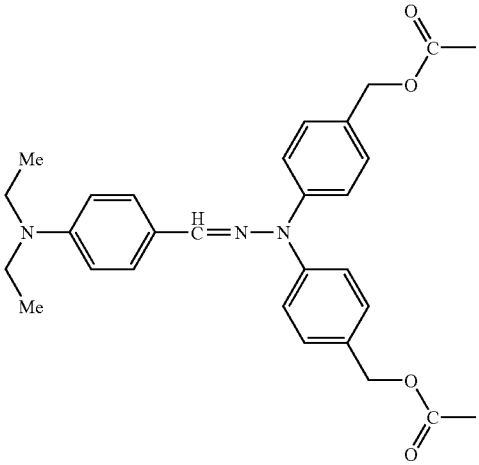
I-26
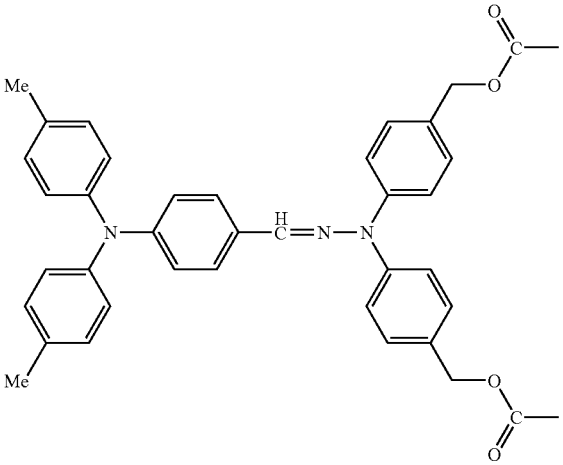
I-27
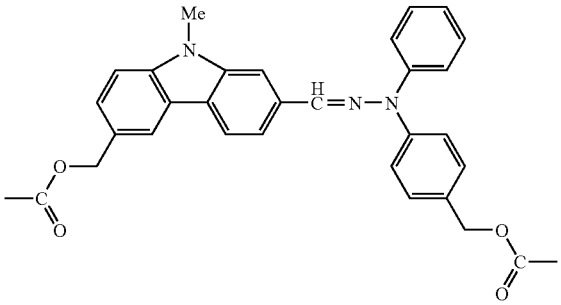
I-28
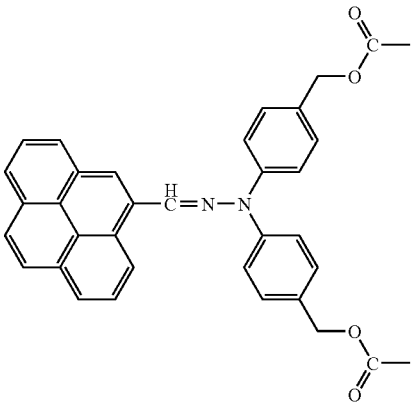

-continued
I-29
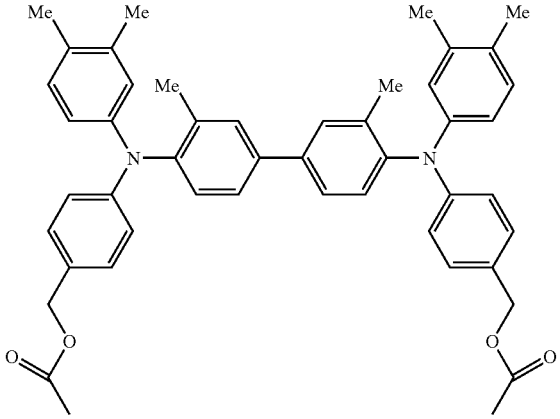
I-30
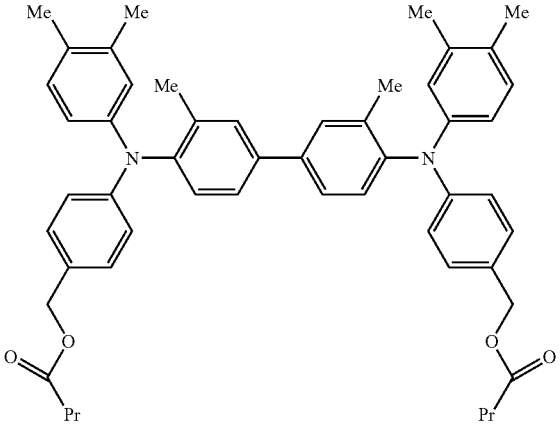
I-31
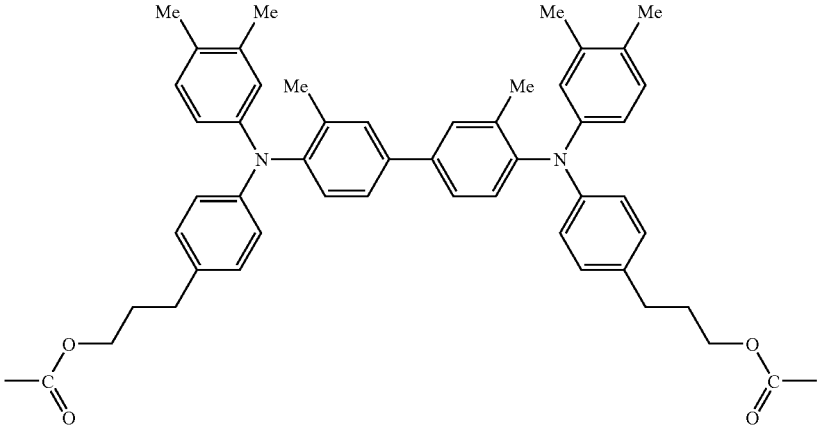
I-32
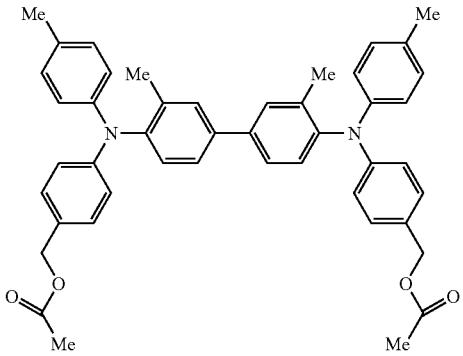
I-33
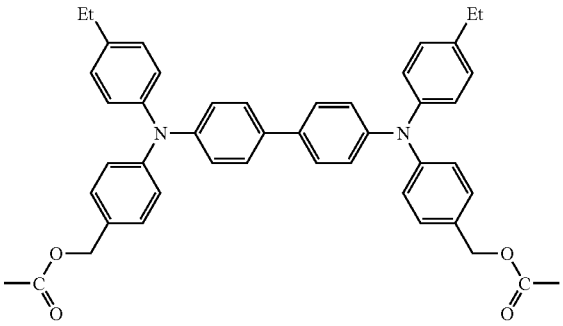
I-34
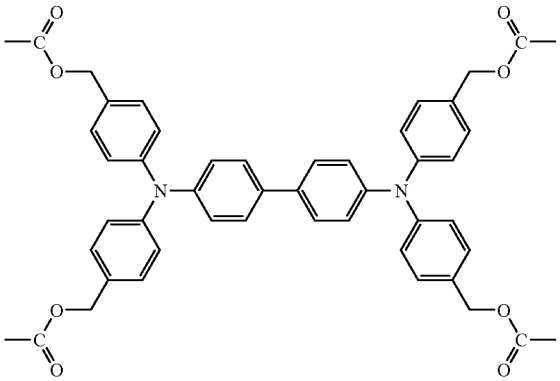
I-35
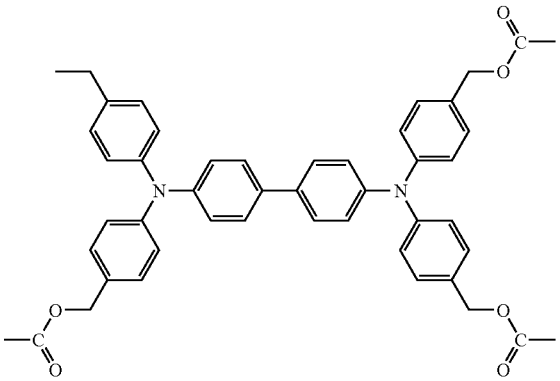

-continued

I-36

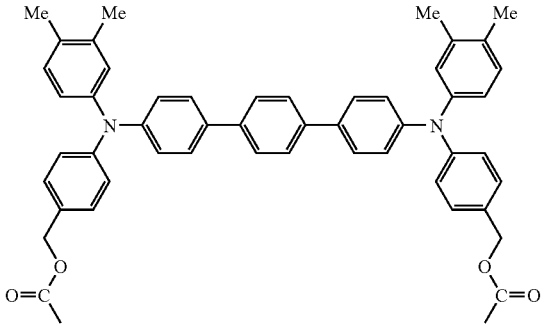

I-37

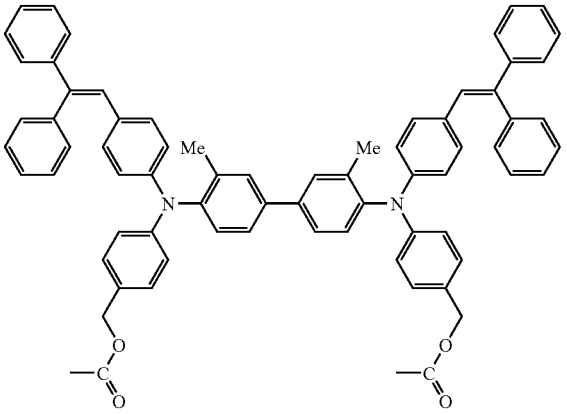

I-38

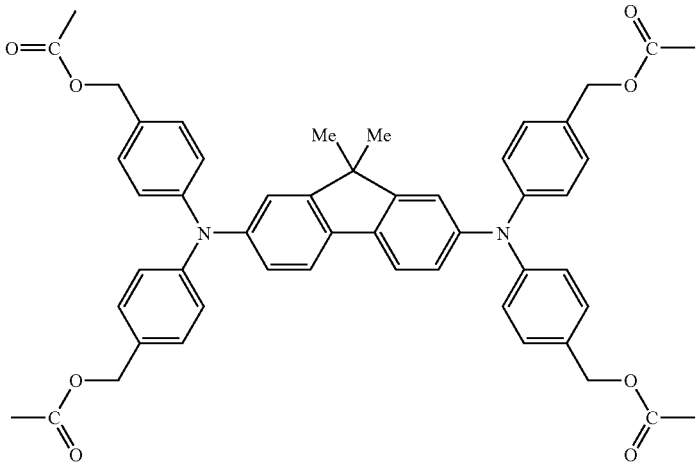

The compound represented by above Formula (I) is readily synthesized, for example, by an esterification method by reacting a compound having a hydroxyalkyl group with an acid anhydride, acid halide, or the like. When doing so, examples of reagents that may be used include: acid anhydrides, such as acetic anhydride, propionic anhydride, and anhydrous butyric acid; acyl chloride compounds, such as thionyl chloride, and propionic acid chloride. For these reagents 1 equivalent weight or more thereof relative to the hydroxyalkyl groups may be used, with 2 equivalent weights or more being preferable. Furthermore, it is preferable in such cases to use a basic substances, such as trimethylamine, triethylamine, or pyridine, as a catalyst, and 1 equivalent or more thereof relative to the hydroxyalkyl groups may be used, or preferably 2 equivalents or more. Also, the reaction may be performed, for example, at a temperature within the range from 0° C. to the boiling point of the solvent used.

Although the above reaction may be performed without a solvent, it may also be carried out using a suitable solvent. Examples that may be given for such a solvent used in the reaction are common solvents, such as benzene, toluene, and tetrahydrofuran and the like, and solvents which act as basic liquid catalysts at the reaction temperature such as triethylamine and pyridine, and these solvents may be used singly or as a mixed solvent medium of two or three thereof.

The protective layer 7 may further include: binder resin(s), such as a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol resin, and/or a styrene-alkyd resin; and polymer charge-transporting material(s), such as poly-N-vinylcarbazole, a polysilane, and polyester polymer charge-transporting materials described in JP-A H8-176293, or JP-A H8-208820.

Here, the above cross-linking resin may be used as a binder resin. Preferable examples as a cross-linking resin are, thermosetting resins, such as a phenol resin, thermosetting acrylics, thermosetting silicone resins, epoxy resins, melamine resins, and urethane resins, and in particular phenol resins, melamine resins, siloxane resins, and urethane resins. Among such curable resins, phenol resins are preferable with respect to the mechanical strength of the curable resin composition cured material, the electrical properties thereof, and the ability to remove matter adhered thereto.

Examples of such phenol resins include compounds obtained by reacting compounds having a phenol group and aldehydes in the presence of a catalyst. The compounds having a phenol group include substituted phenols containing one hydroxyl group, such as phenol, cresol, xylenol, para-alkylphenol, para-phenylphenol; substituted phenols containing two hydroxyl groups, such as catechol, resorcinol, and hydroquinone; bisphenols, such as bisphenol A and Bisphenol Z. The compounds having a phenol group also include monomers of monomethylol phenols, dimethylol phenols, and trimethylol phenols; mixtures of such monomers; oligomers made from these monomers; and monomer and oligomer mixtures. Here, oligomer refers to relatively large molecules with between 2 and 20 repeating units in their molecule structure, and smaller molecules are referred to as monomers. The aldehydes include formaldehyde, paraformaldehyde, and the like.

As melamine resins and benzoguanamine resins, although various resins, such as methylol types with a methylol group as it is, full ether types in which all methylol groups are alkyl-etherized, or full imino types, and mixed types of methylol and imino group(s) may be used, however, from the viewpoint of the stability of a coating liquid, ether type resins are preferable.

As urethane resins, polyfunctional isocyanates, isocyanurates, and blocked isocyanates thereof blocked with an alcohol or ketone, may be used, however, from the viewpoint of the stability of a coating liquid, blocked isocyanates, or isocyanurates are preferable and, for example, after mixing with a compound represented by above Formula (I), and coating, a protective layer is formed by thermo cross-linking.

As a silicone resin a resin derived from a compound represented by Formula (IV) or Formula (V), later described, for example, may be used.

The above binder resins may be used singly or in mixtures of two or more. The compounding ratio (weight ratio) of the compound represented by above Formula (I) to the above binder resins is preferably about 10:1 to about 1:5.

As a catalyst used when synthesizing the phenol resin as a cross-linking resin the following may be used: sulfuric acid, paratoluene sulfonic acid, phenolsulfonic acid, phosphoric acid, and hydroxides alkali metals or alkaline earth metals (for example, NaOH, KOH, $Ca(OH)_2$, $Mg(OH)_2$, $Ba(OH)_2$, and the like), oxides of alkali metals or alkaline earth metals (for example, CaO, MgO, and the like), amine based catalysts (for example, ammonia, hexamethylenetetramine, trimethylamine, triethylamine, triethanolamine, and the like) and acetates (zinc acetate, sodium acetate, and the like).

When a basic compound is used as a catalyst, since a resol type resin may be obtained, this is preferable in order to maintain strength, but with a basic compound (a basic substance) there is a tendency for the electrical properties to worsen since it generally readily becomes a trap when charge-transporting, and within an apparatus which has severe restrictions and requirements, such as for high definition and miniaturization, it may readily produce a ghost and like image quality defects. Among basic substances, an amine based catalyst is preferable since it volatilizes easily when the resin is produced and when carrying out film forming, and therefore does not readily produce the above bad effects.

However, even with amine based catalysts the above image quality defects cannot be completely prevented, and there may be significant effects that appear particularly in apparatuses that do not have an electric discharge light irradiation process. However, by using the compound represented by above Formula (I) together with the above cross-linking compounds (a phenol resin synthesized using an amine based catalyst), a high strength film may be produced while still maintaining the electrical properties. That is, stable images may be obtained over a long period of time, without the generation of image quality defects, such as ghosting and streaks. The reason why the above effect may be obtained is not necessarily clear, but it is considered to be because the compound represented by Formula (I) generates an organic acid when carrying out film forming and the remaining basic catalyst is thereby effectively neutralized.

When an insulating resin, such as a polyvinyl butyral resin, a polyarylate resin (polycondensate of bisphenol A and phthalic acid, and the like), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, a casein, a polyvinyl alcohol resin, or a polyvinyl pyrrolidone resin, is mixed in a desired proportion into the protective layer 7, then coating film defects, due to the adhesiveness thereof to the charge transport layer 6, thermal contraction, and bad wetting and the like, may be suppressed.

Furthermore, other charge transporting materials may be included in the protective layer 7 in order to improve charge introduction characteristics to the adjacent layer, and give matching compatibility to surrounding members, such as a cleaning member. Such charge transporting materials may also serve as a cross-linking resin.

Compounds represented by the following Formulae (CTI) to (CTVI) may be given as examples of compounds suitable as a charge transporting material.

$$F—[(X^1)_{n1}R^1\text{-}Z^1H]_{m1} \quad \text{(CTI)}$$

In Formula (CTI), F represents an organic group derivable from a compound having hole transportation ability; $R^1$ represents an alkylene group; $Z^1$ represents an oxygen atom, a sulfur atom, NH, or COO; $X^1$ represents an oxygen atom or a sulfur atom; $m^1$ represents an integer of 1 to 4; and n1 represents 0 or 1.

$$F—[(X^2)_{n2}—(R^2)_{n3}\text{-}(Z^2)_{n4}G]_{n5} \quad \text{(CTII)}$$

In Formula (CTII), F represents an organic group derived from a compound having hole transportation ability; $X^2$ represents an oxygen atom or a sulfur atom; $R^2$ represents an alkylene group; $Z^2$ represents an oxygen atom, a sulfur atom, NH, or COO; G represents an epoxy group; n2, n3, and n4 each independently represents 0 or 1, and n5 represents an integer of 1 to 4.

$$F\text{-}[D\text{-}Si(R^3)_{(3-a)}Q_a]_b \quad \text{(CTIII)}$$

In Formula (CTIII), F represents an organic group derived from a compound having hole transportation ability; D represents a divalent group which has flexibility; $R^3$ represents a hydrogen atom, a substituted or unsubstituted alkyl group, or a substituted or unsubstituted aryl group; Q represents a hydrolyzable group; a represents an integer of 1 to 3; and b represents an integer of 1 to 4.

Here, a compound represented by the following Formula (CTVIII-2) is preferred as the compound represented by Formula (CTIII).

(CTVIII-2)

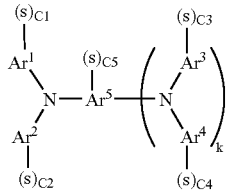

In Formula (CTVIII-2): $Ar^1$, $Ar^2$, $Ar^3$ and $Ar^4$ each independently represents a substituted or unsubstituted aryl group or a substituted or unsubstituted allylene group; $Ar^5$ represents a substituted or unsubstituted aryl group or a substituted or unsubstituted allylene group; c1, c2, c3, c4, and c5 each independently represents 0 or 1; k represents 0 or 1; S represents an organic group represented by $\text{-D-Si}(R^3)_{(3-a)}Q_a$, wherein D represents a divalent group which has flexibility, $R^3$ represents a hydrogen atom, a substituted or unsubstituted alkyl group, or a substituted or unsubstituted aryl group, Q represents a hydrolyzable group, a represents the integer of from 1 to 3; and the total of c1, c2, c3, c4, and c5 is from 1 to 4.

(CTIV)

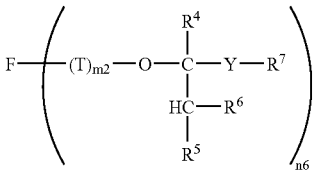

In Formula (CTIV), F represents an organic group derived from a compound having hole transportation ability; T represents a divalent group; Y represents an oxygen atom or a sulfur atom; $R^4$, $R^5$, and $R^6$ each independently represents a hydrogen atom or a monovalent organic group; $R^7$ represents a monovalent organic group; m2 represents 0 or 1; and n6 represents an integer of 1 to 4. However, $R^6$ and $R^7$ may link together with each other to form a heterocycle which uses Y as a hetero atom.

(CTV)

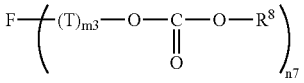

In Formula (CTV), F represents an organic group derived from a compound having hole transportation ability; T represents a divalent group; $R^8$ represents a monovalent organic group; m3 represents 0 or 1; and n7 represents an integer of 1 to 4.

$$F\text{-}(L\text{-}O\text{—}R^9)_{n8} \quad \text{(CTVI)}$$

In Formula (CTVI), F represents an organic group derived from a compound having hole transportation ability; L represents an alkylene group; $R^9$ represents a monovalent organic group; and n8 represents an integer of 1 to 4.

As the above divalent group D having flexibility, specifically it is a divalent group which takes on the role of combining two functions, that of the part F for imparting photoelectrical characteristics, and that of the substituted silicon group that contributes to the construction of a three-dimensional inorganic glass framework structure. Also, the group D represents an organic group structure that imparts appropriate flexibility to the portion of the hard inorganic glass framework structure that is also brittle, and also undertakes the role of improving the mechanical toughness as a film.

Specific examples that may be given of the group D are divalent hydrocarbon groups represented by $\text{—}C_{\alpha}H_{2\alpha}\text{—}$, $\text{—}C_{\beta}H_{2\beta-2}\text{—}$, and $\text{—}C_{\gamma}H_{2\gamma-4}\text{—}$ (wherein α represents an integer of from 1 to 15, and β represents an integer of from 2 to 15, and γ represents the integer of from 3 to 15), —COO—, —S—, —O—, $\text{—}CH_2\text{—}C_6H_4\text{—}$, —N═CH—, $\text{—}(C_6H_4)\text{—}(C_6H_4)\text{—}$, and particular structures which combined these particular groups, and these particular groups substituted therein with other substituents, and the like.

An alkoxy group is preferable as the above hydrolyzable group Q, with an alkoxy group of from 1 to 15 carbon atoms being more preferable.

Following compounds (CTI-1) to (CTI-37) may be given as specific examples of compounds represented by the above Formula (CTI). In the following table, Me or a bond (—) are shown, but where a substituent is not indicated then these represent a methyl group, Et represents an ethyl group, and Pr represents an n-propyl group.

CTI-1

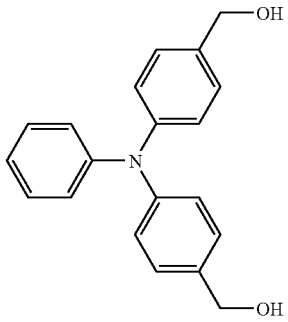

CTI-2

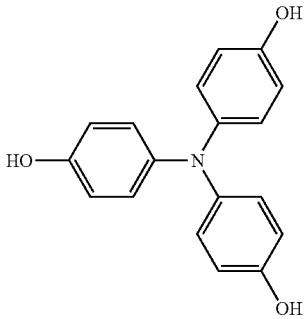

CTI-3

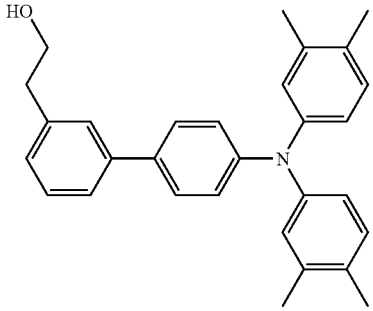

CTI-4

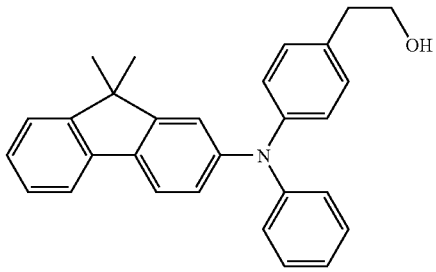

-continued
CTI-5
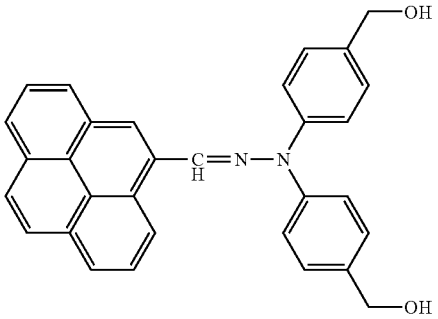
CTI-6
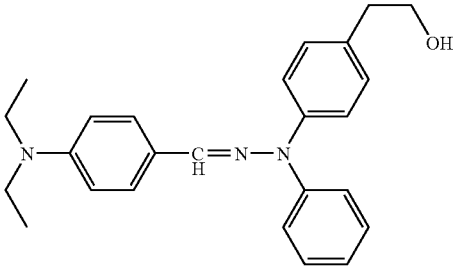
CTI-7
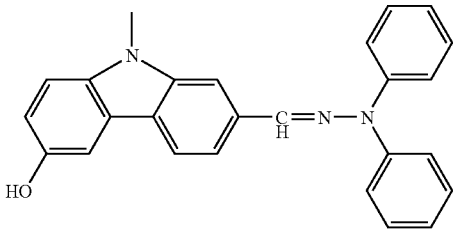
CTI-8
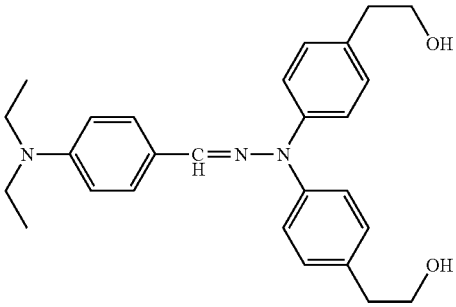
CTI-9
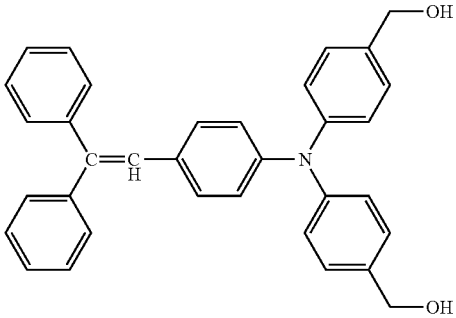
-continued
CTI-10
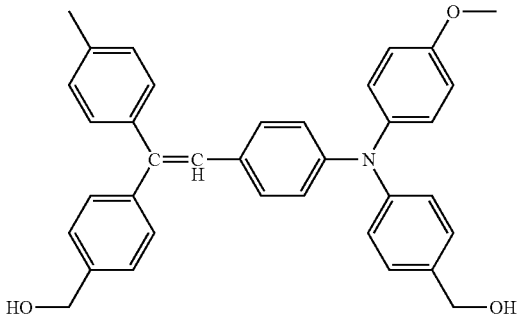
CTI-11
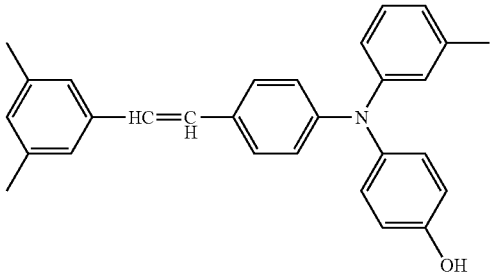
CTI-12
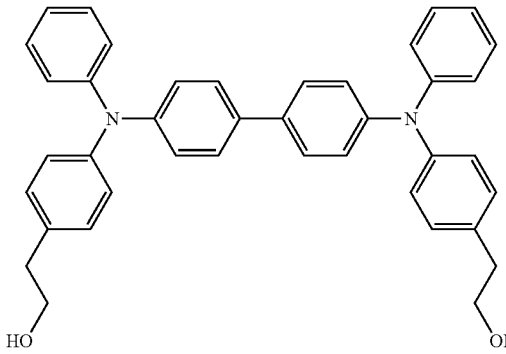
CTI-13
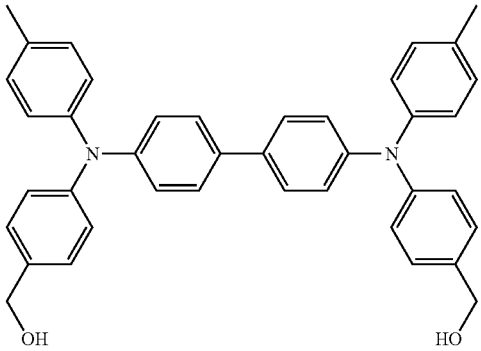

-continued
CTI-14
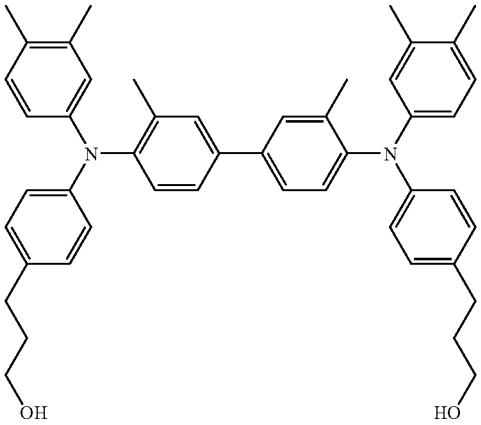
CTI-15
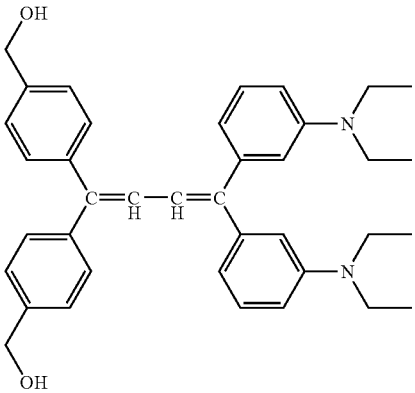
CTI-16
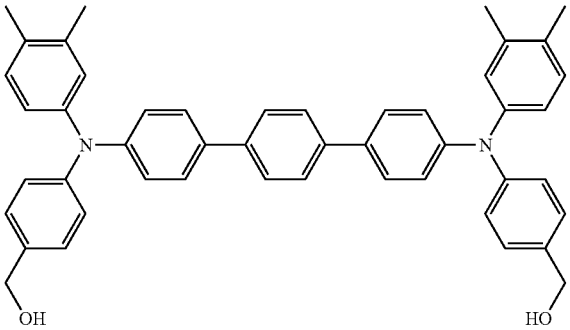
CTI-17
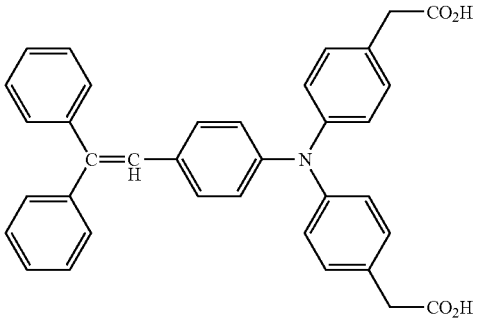
-continued
CTI-18
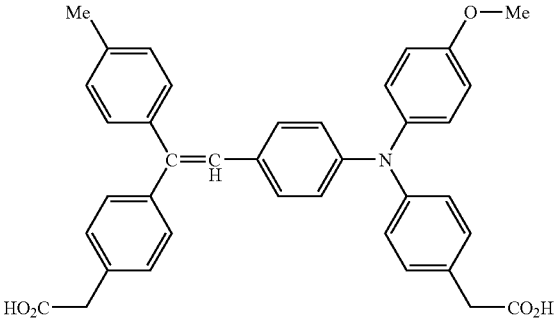
CTI-19
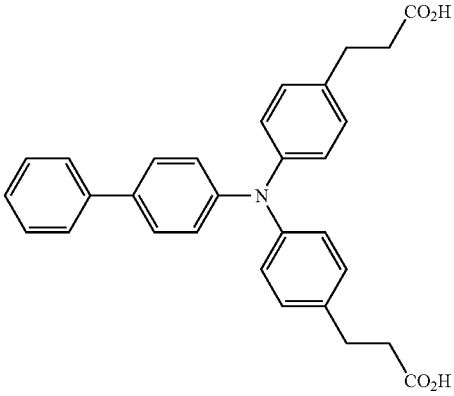
CTI-20
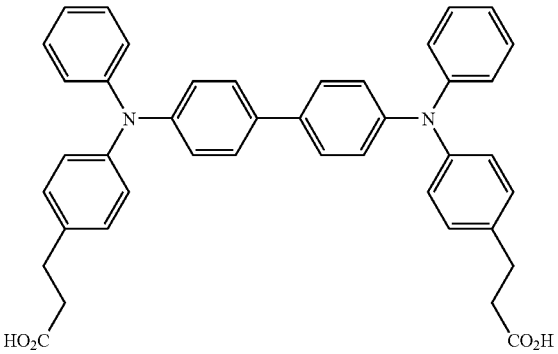
CTI-21
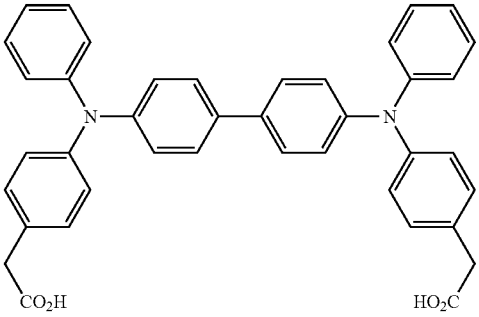

-continued
CTI-22
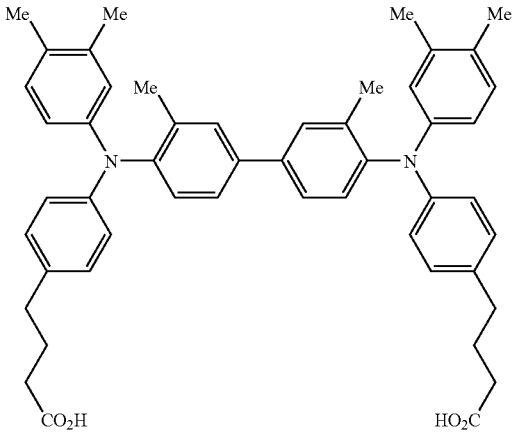
CTI-23
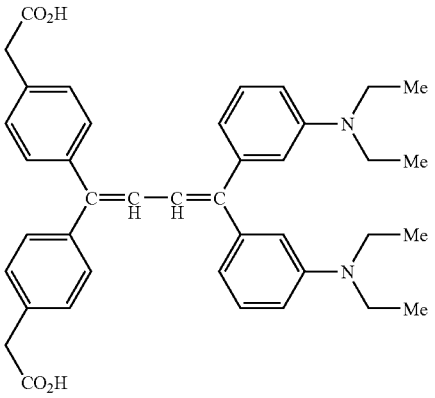
CTI-24
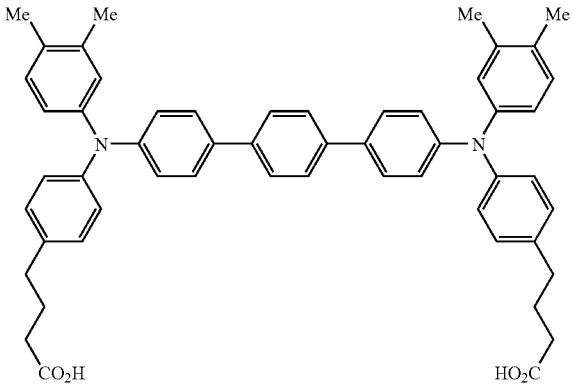
-continued
CTI-25
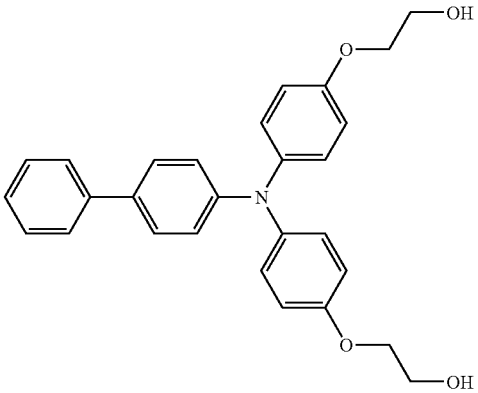
CTI-26
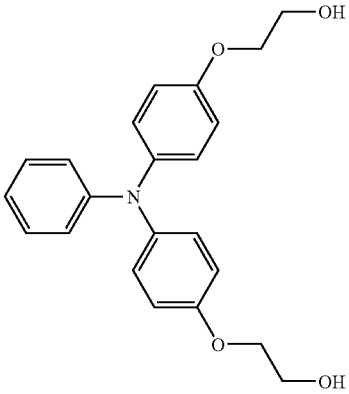
CTI-27
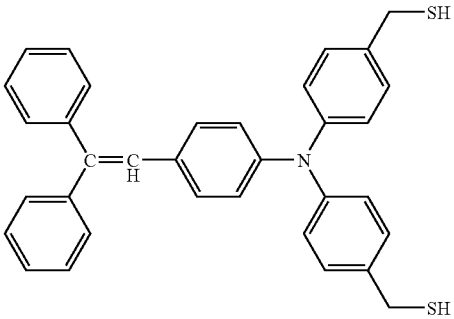
CTI-28
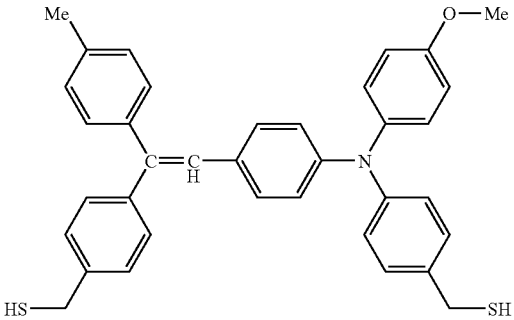

-continued
CTI-29
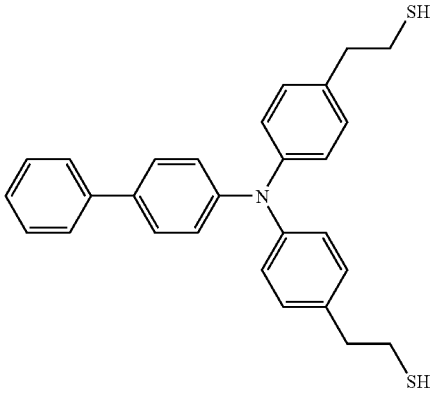
CTI-30
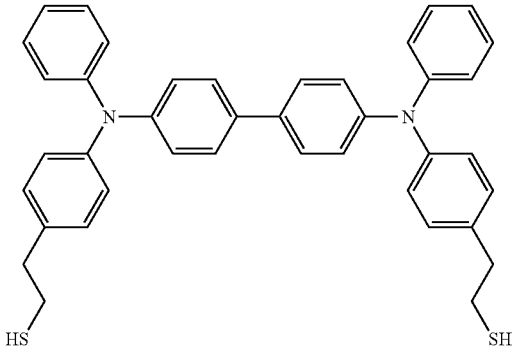
CTI-31
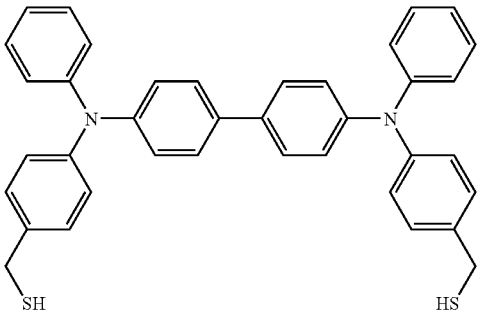
CTI-32
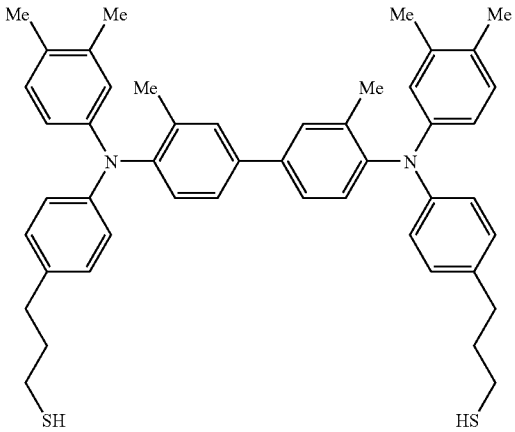
-continued
CTI-33
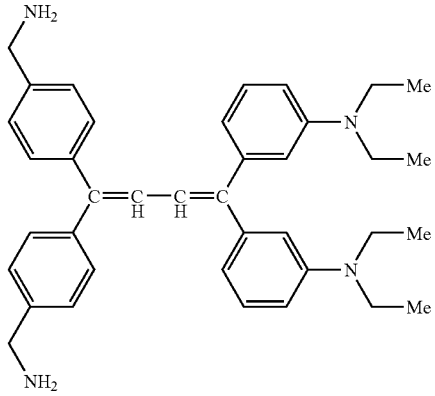
CTI-34
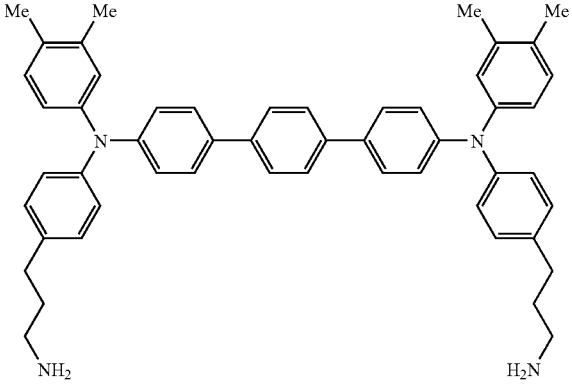
CTI-35
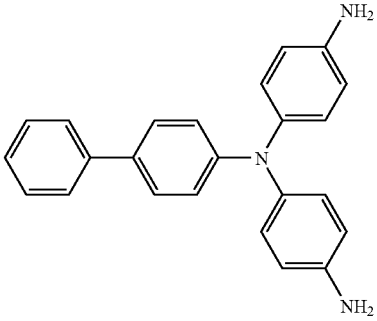
CTI-36
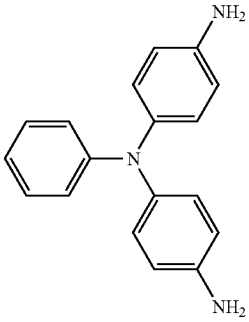

-continued
CTI-37
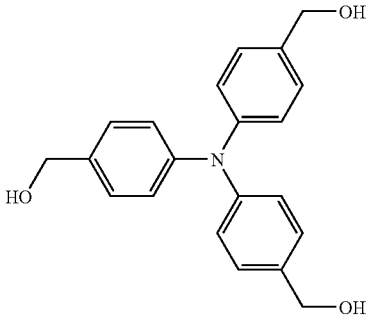
Following compounds (CTII-1) to (CTII-47) may be given as specific examples of compounds represented by the above Formula (CTII). In the following table, Me or a bond (—) are shown, but where a substituent is not indicated then these represent a methyl group, Et represents an ethyl group, and Pr represents an n-propyl group.
CTII-1
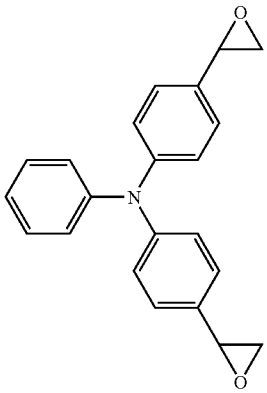
CTII-2
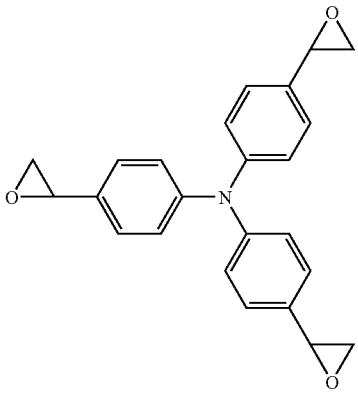
-continued
CTII-3
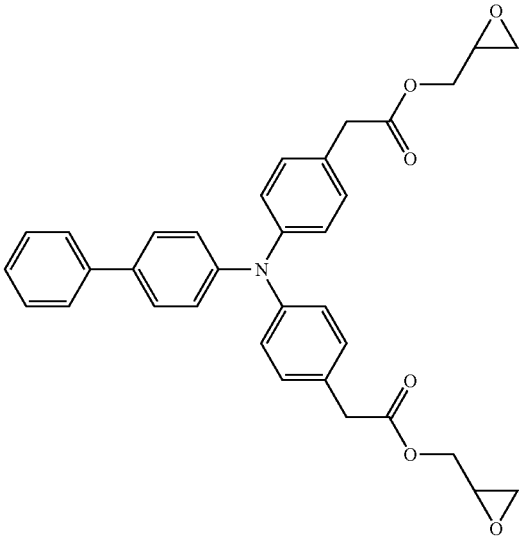
CTII-4
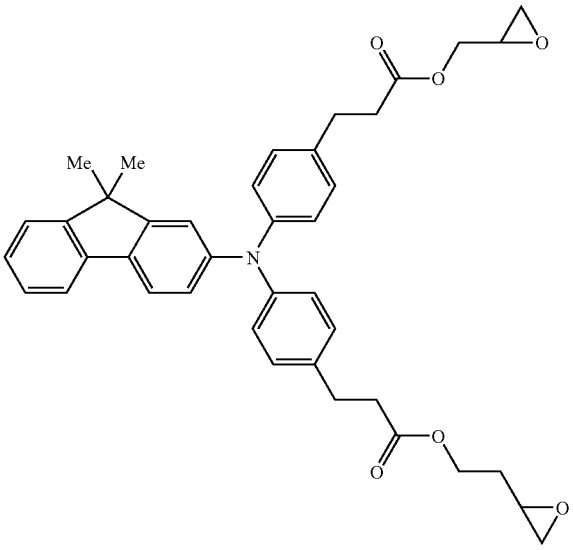
CTII-5
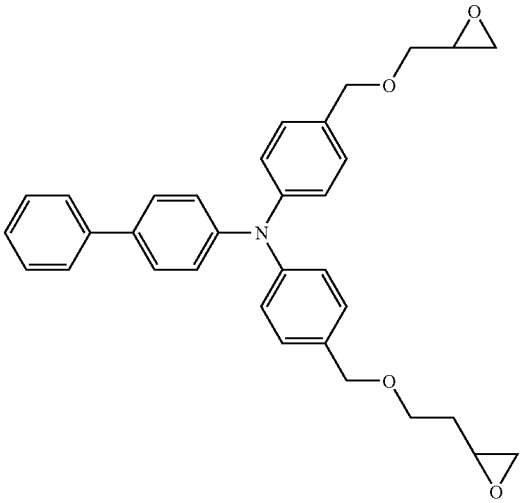

-continued
CTII-6
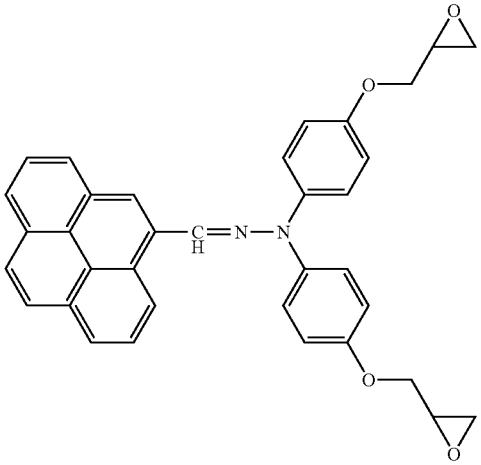
CTII-7
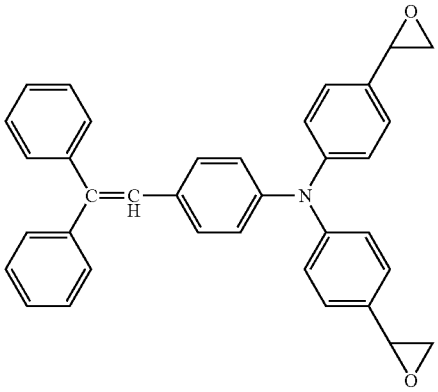
CTII-8
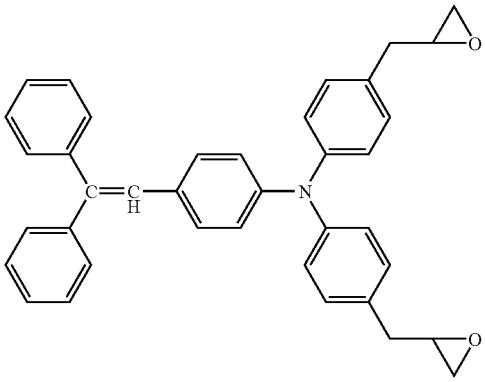
CTII-9
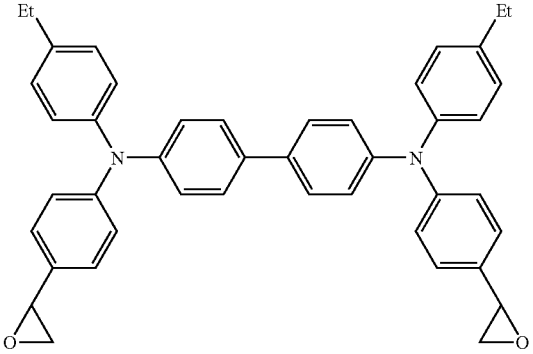
-continued
CTII-10
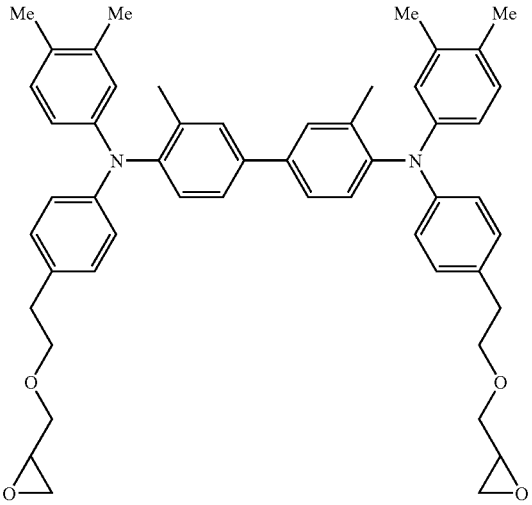
CTII-11
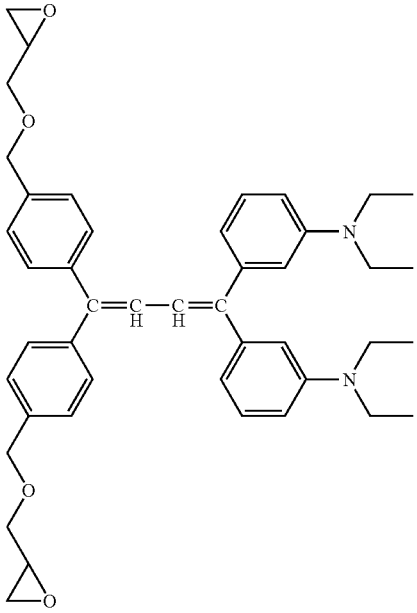
CTII-12
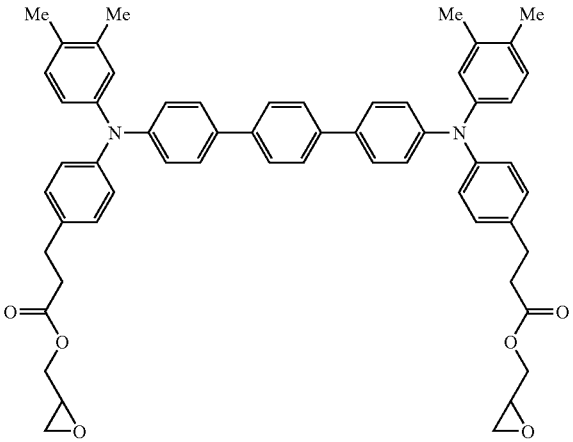

-continued
CTII-13
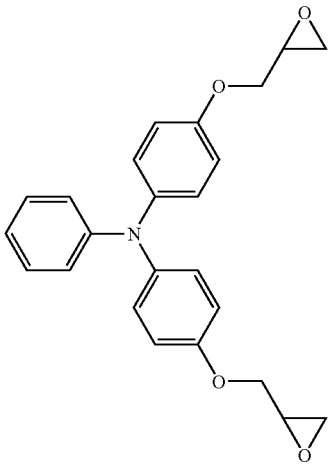
CTII-14
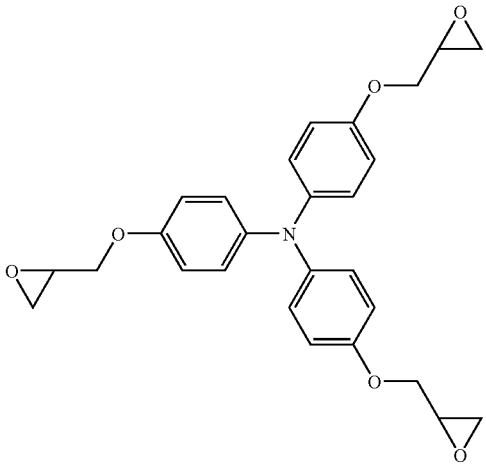
CTII-15
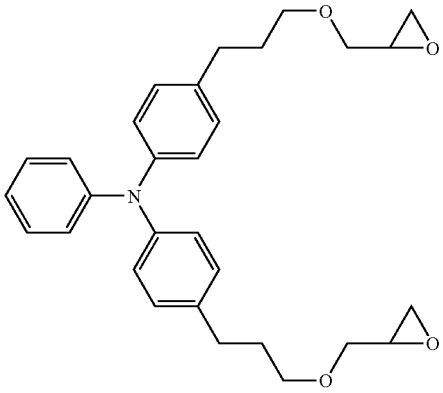
-continued
CTII-16
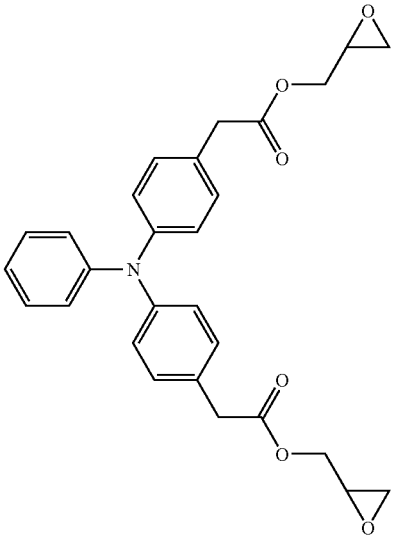
CTII-17
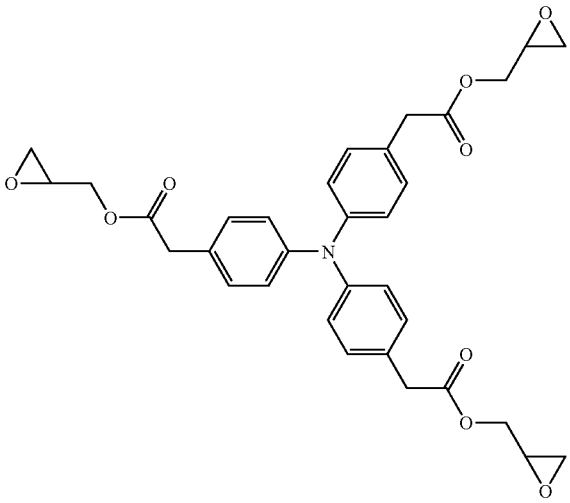
CTII-18
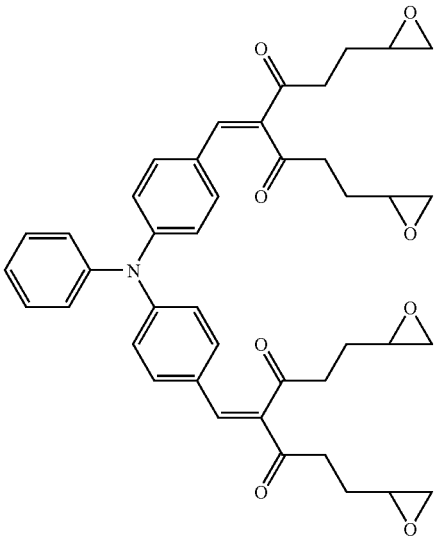

CTII-19
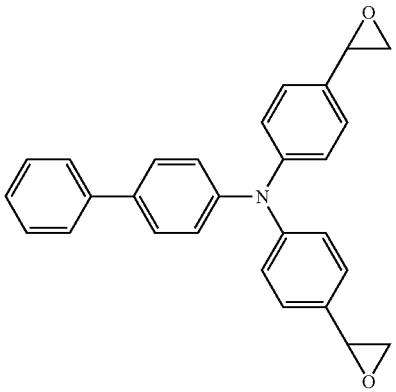
CTII-20
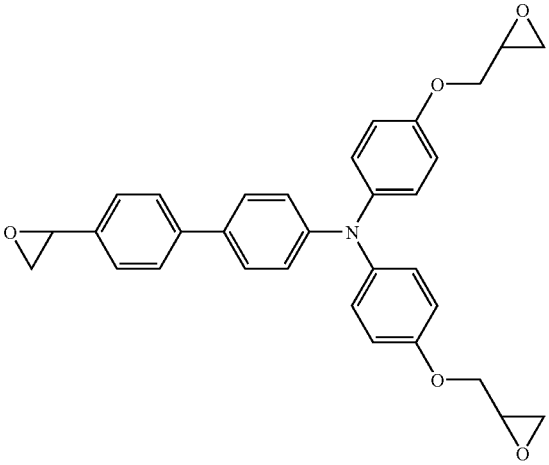
CTII-21
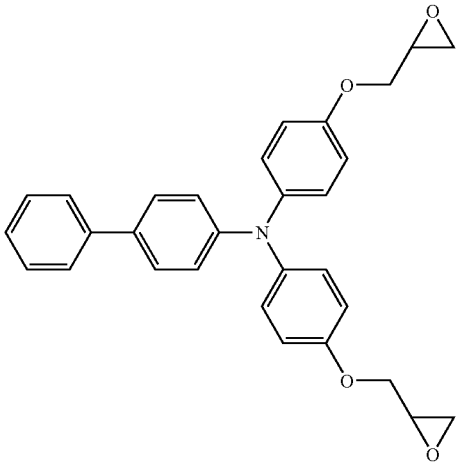
CTII-22
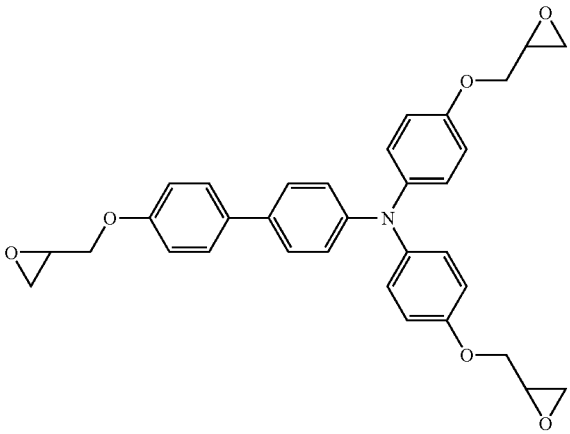
CTII-23
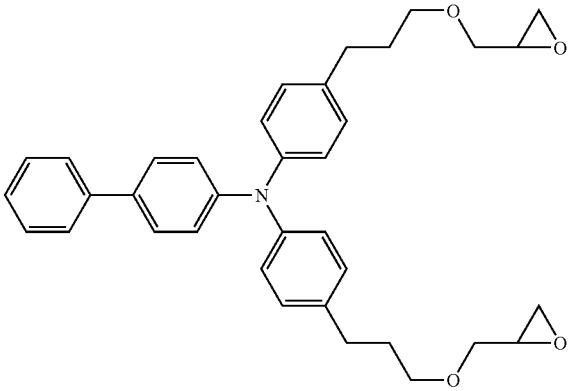
CTII-24
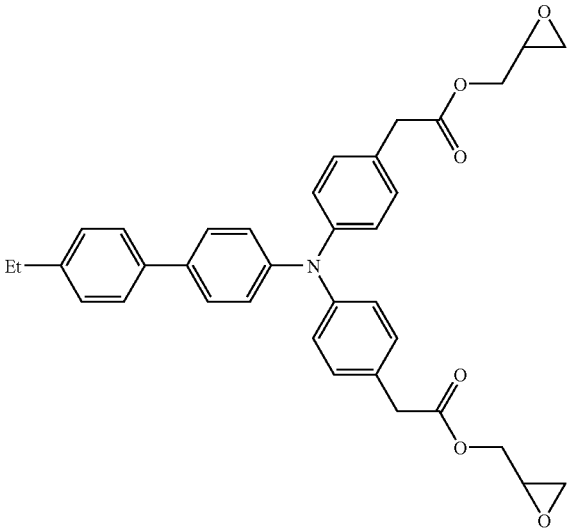

-continued
CTII-25
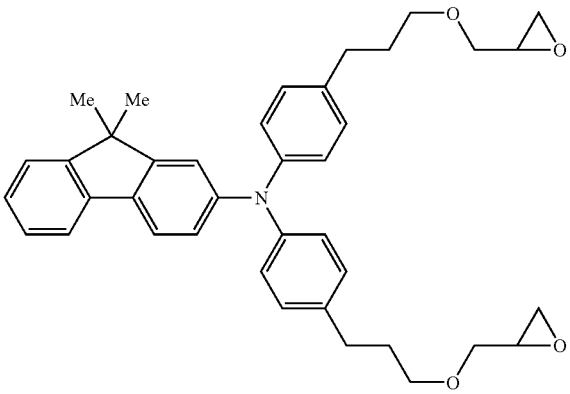
CTII-26
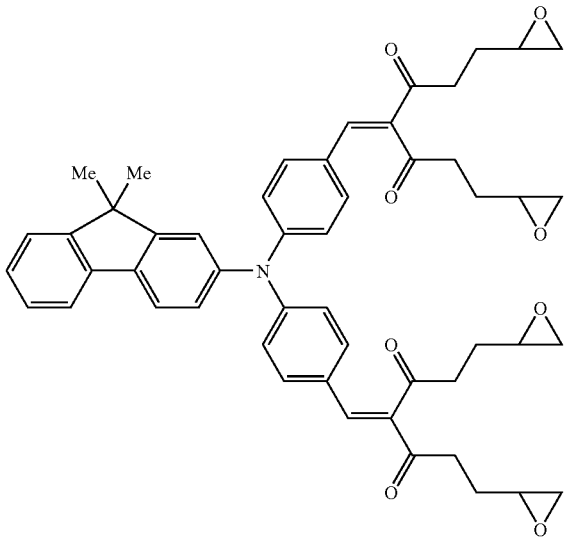
CTII-27
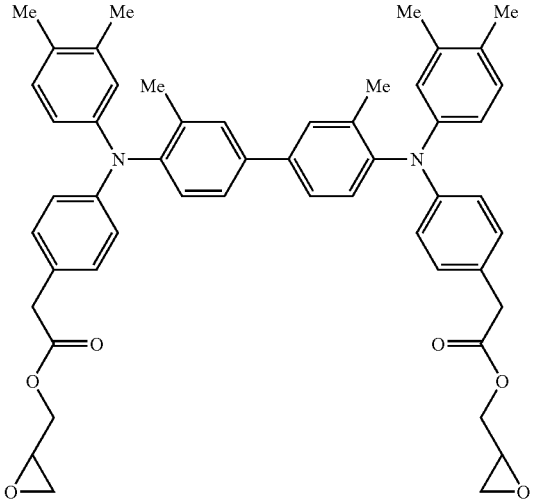
-continued
CTII-28
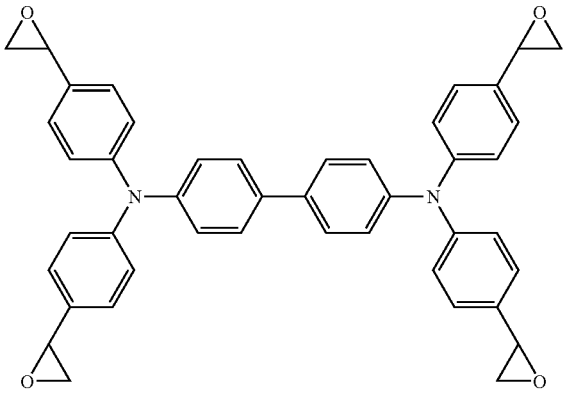
CTII-29
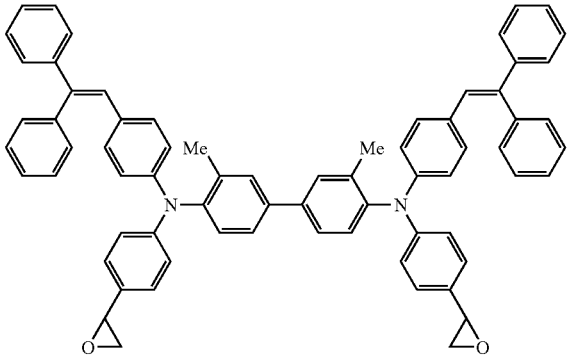
CTII-30
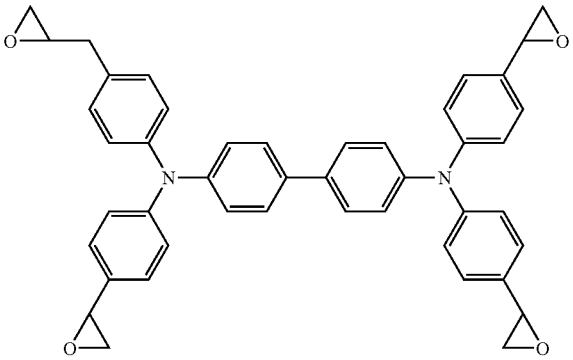
CTII-31
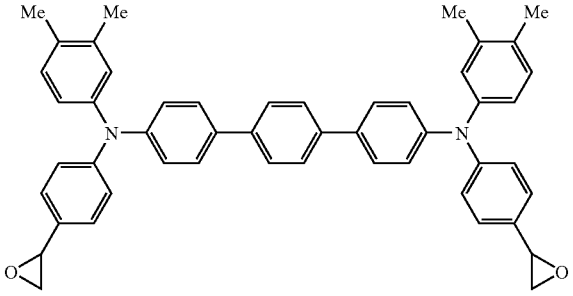

CTII-32
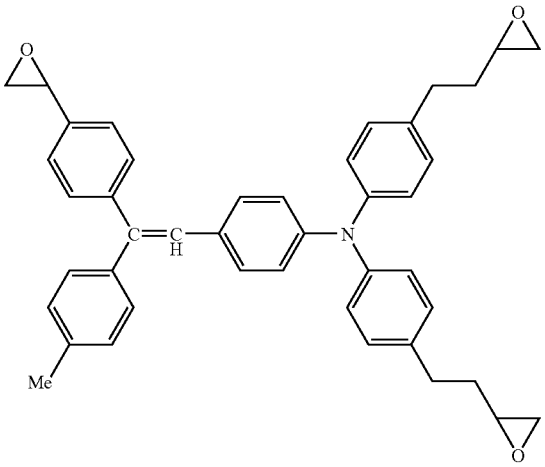
CTII-33
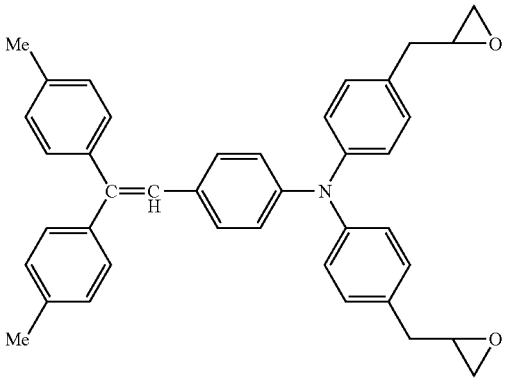
CTII-34
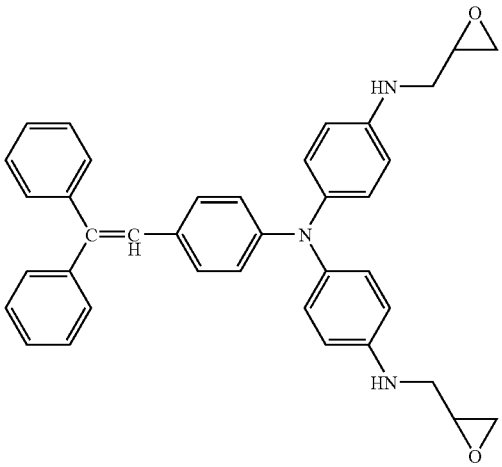
CTII-35
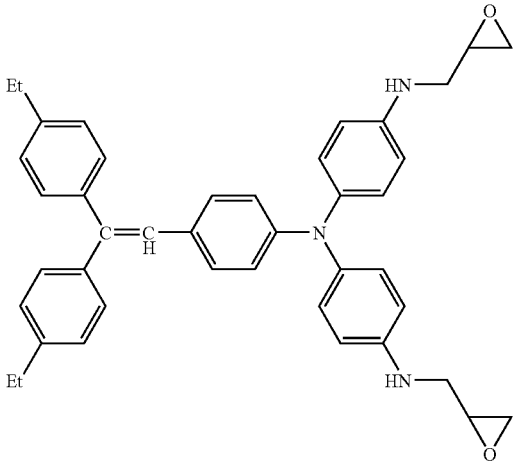
CTII-36
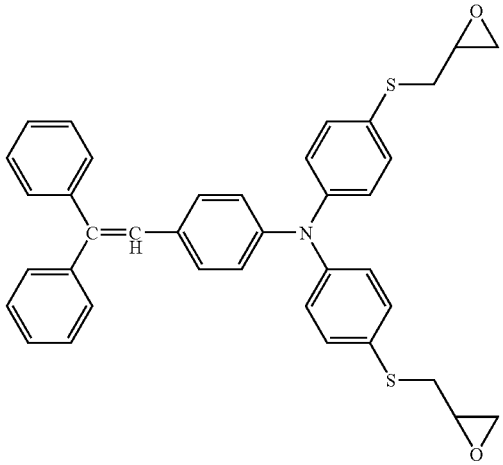
CTII-37
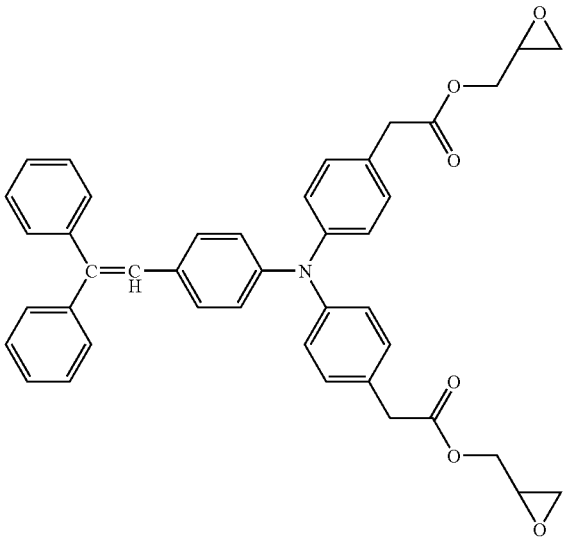

-continued
CTII-38
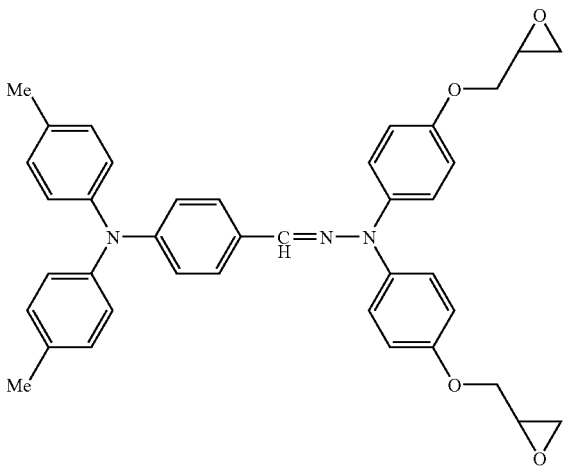
CTII-39
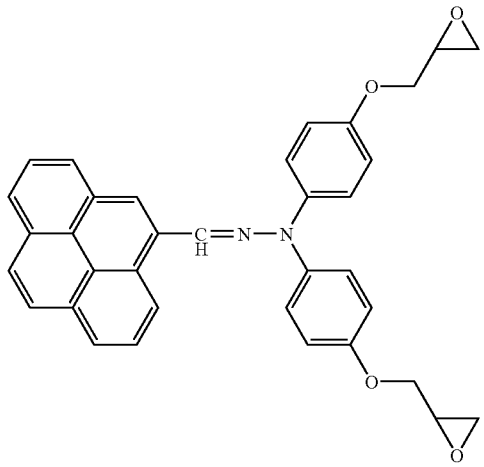
CTII-40
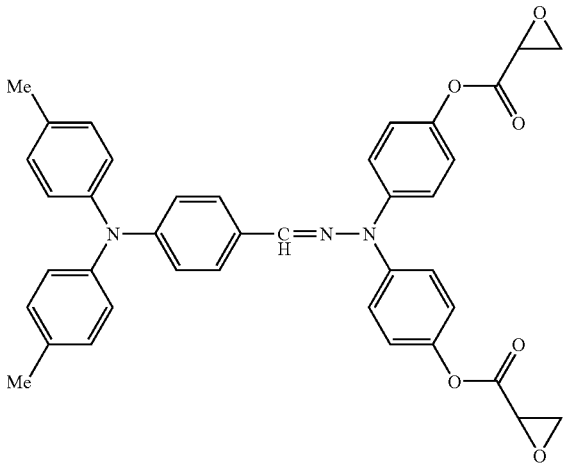
-continued
CTII-41
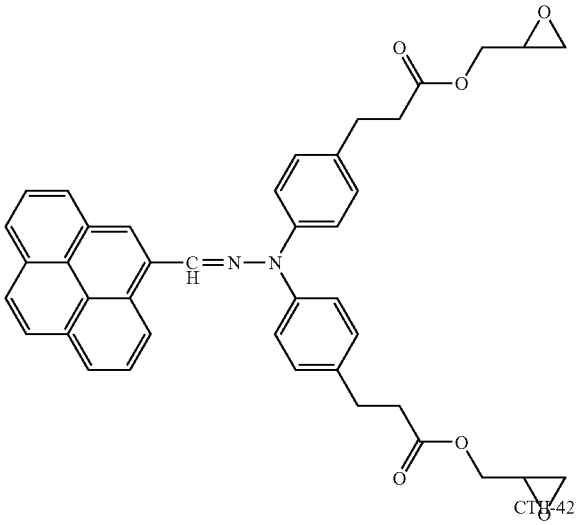
CTII-42
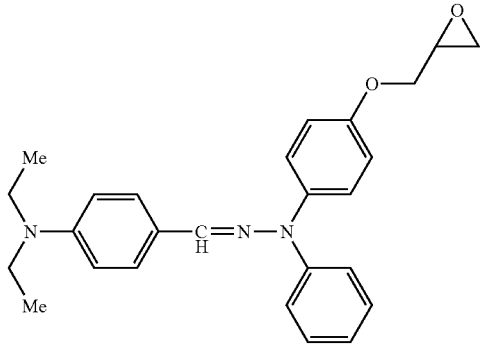
CTII-43
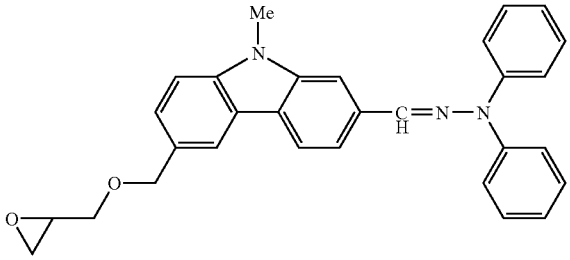
CTII-44
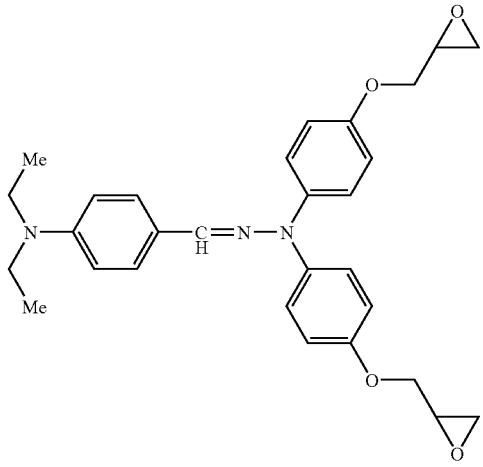

-continued

CTII-45

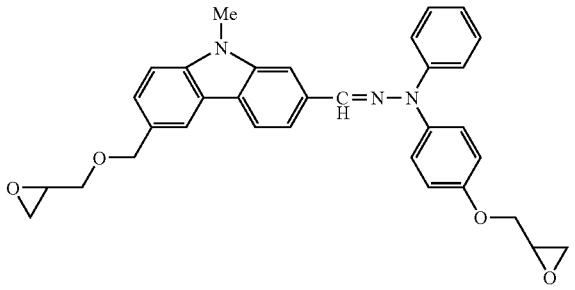

CTII-46

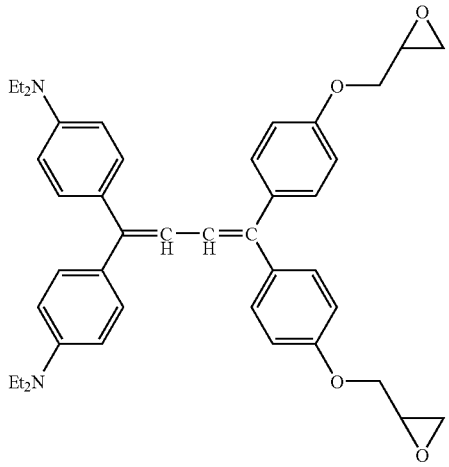

-continued

CTII-47

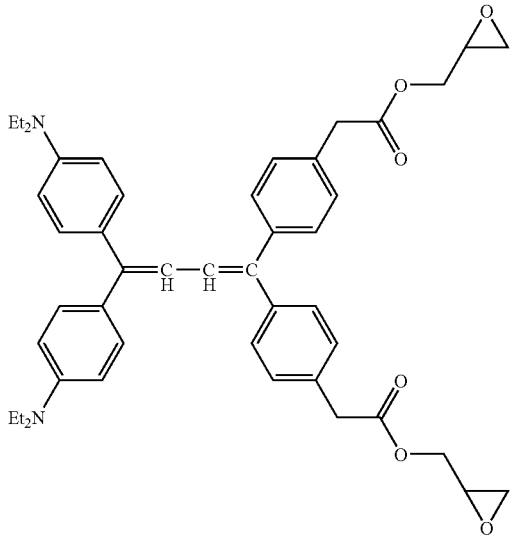

Furthermore, the following compounds (CTIII-1) to (CTIII-61) may be given as more specific examples of compounds represented by the above Formula (CTIII). The following compounds (CTIII-1) to (CTIII-61) are combinations, shown in a table, of $Ar^1$ to $Ar^5$ and k in the Formula (CTIII-2), which is a preferred compound represented by Formula (CTIII), and alkoxy silyl groups (Y (note, however, that in Formula (CTIII-2) it is shown as S)). In the following table Me represents a methyl group, Et an ethyl group, and iPr represents an isopropyl group.

| No. | $Ar^1$ | $Ar^2$ | $Ar^3$ |
|---|---|---|---|
| CTIII-1 | 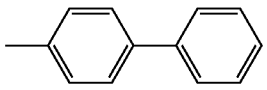 | 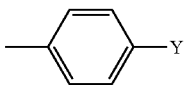 | — |
| CTIII-2 | 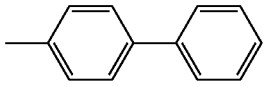 | 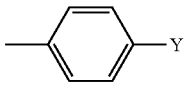 | — |
| CTIII-3 | 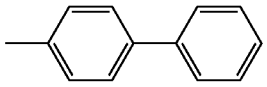 | 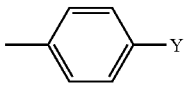 | — |
| CTIII-4 | 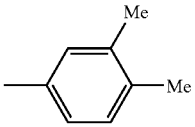 | 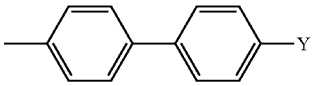 | — |
| CTIII-5 | 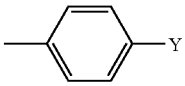 | 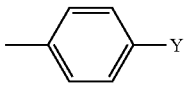 | — |
| CTIII-6 | 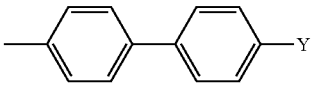 | 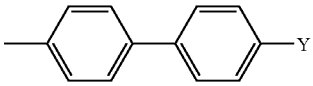 | — |

-continued
| | | | |
|---|---|---|---|
| CTIII-7 | 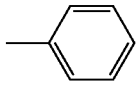 | 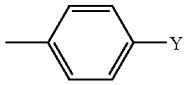 | 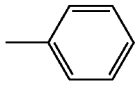 |
| CTIII-8 | 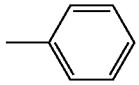 | 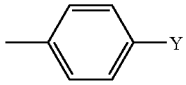 | 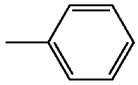 |
| CTIII-9 | 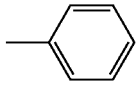 | 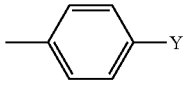 | 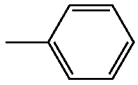 |
| CTIII-10 | 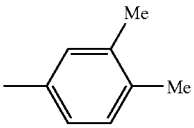 | 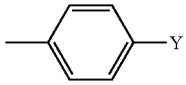 | 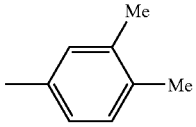 |
| CTIII-11 | 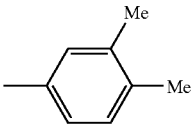 | 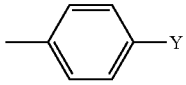 | 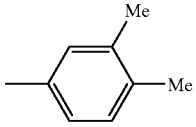 |
| CTIII-12 | 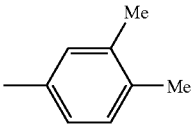 | 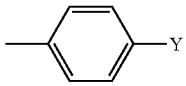 | 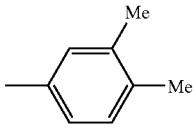 |
| CTIII-13 | 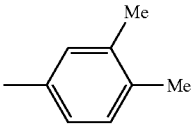 | 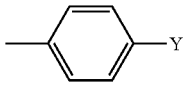 | 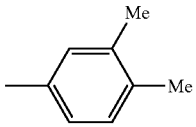 |
| CTIII-14 | 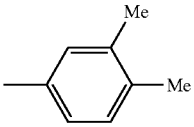 | 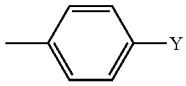 | 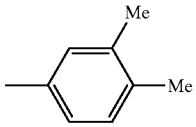 |
| CTIII-15 | 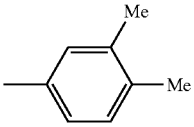 | 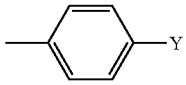 | 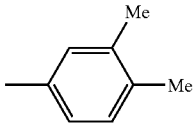 |
| CTIII-16 | 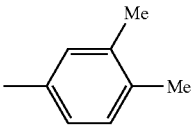 | 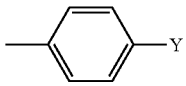 | 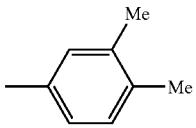 |
| CTIII-17 | 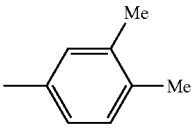 | 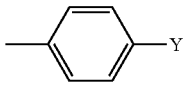 | 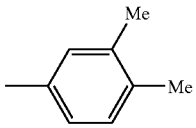 |
| CTIII-18 | 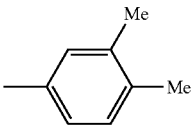 | 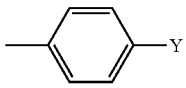 | 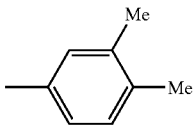 |

-continued
| | | | |
|---|---|---|---|
| CTIII-19 | 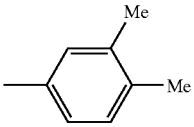 | 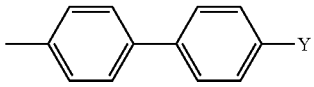 | 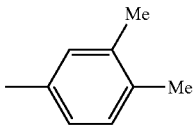 |
| CTIII-20 | 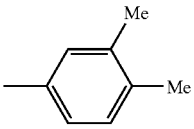 | 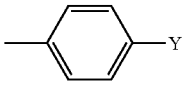 | 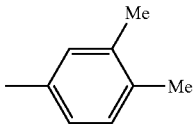 |
| CTIII-21 | 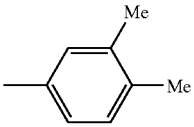 | 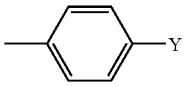 | 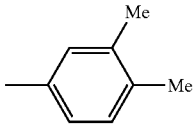 |
| CTIII-22 | 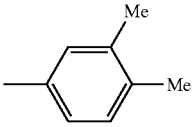 | 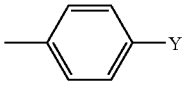 | 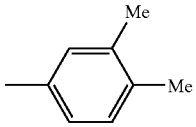 |
| CTIII-23 | 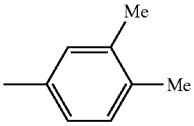 | 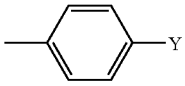 | 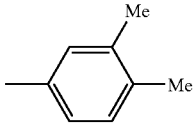 |
| CTIII-24 | 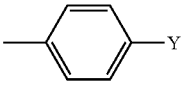 | 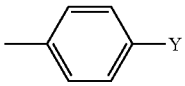 | 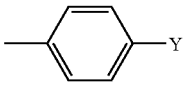 |
| CTIII-25 | 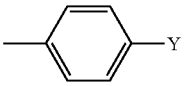 | 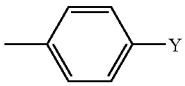 | 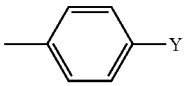 |
| CTIII-26 | 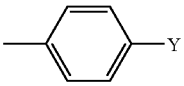 | 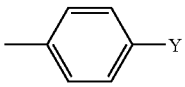 | 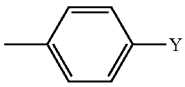 |
| CTIII-27 | 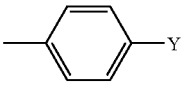 | 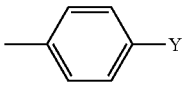 | 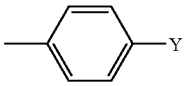 |
| CTIII-28 | 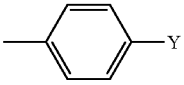 | 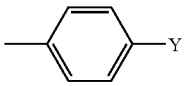 | 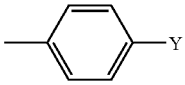 |
| CTIII-29 | 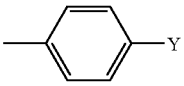 | 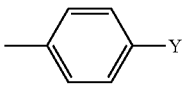 | 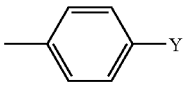 |
| CTIII-30 | 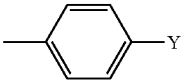 | 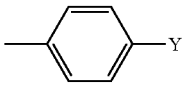 | 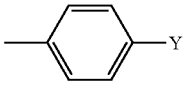 |
| CTIII-31 | 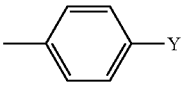 | 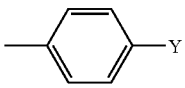 | 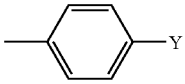 |
| CTIII-32 | 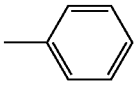 | 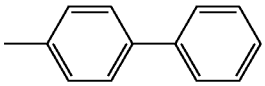 | — |

-continued
| | | | |
|---|---|---|---|
| CTIII-33 | 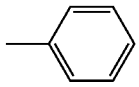 | 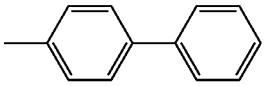 | — |
| CTIII-34 | 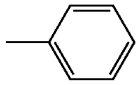 | 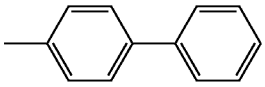 | — |
| CTIII-35 | 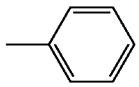 | 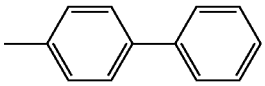 | — |
| CTIII-36 | 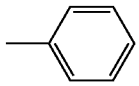 | 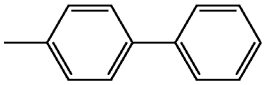 | — |
| CTIII-37 | 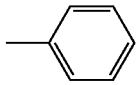 | 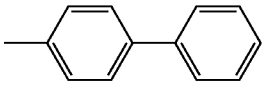 | — |
| CTIII-38 | 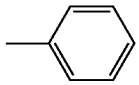 | 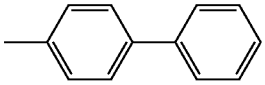 | — |
| CTIII-39 | 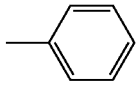 | 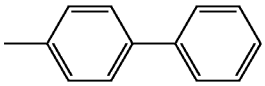 | — |
| CTIII-40 | 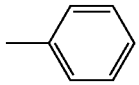 | 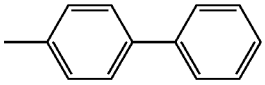 | — |
| CTIII-41 | 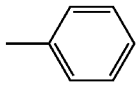 | 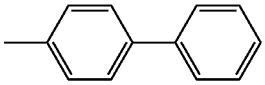 | — |
| CTIII-42 | 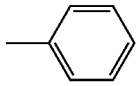 | 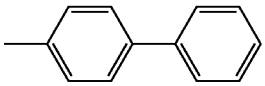 | — |
| CTIII-43 | 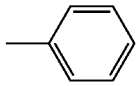 | 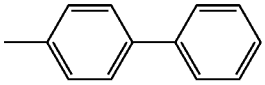 | — |
| CTIII-44 | 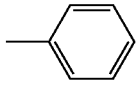 | 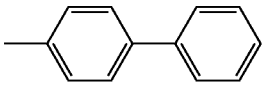 | — |
| CTIII-45 | 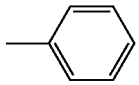 | 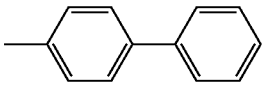 | — |
| CTIII-46 | 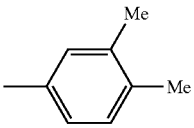 | 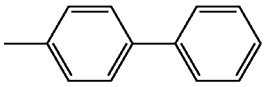 | — |
| CTIII-47 | 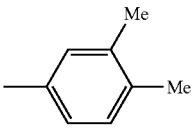 | 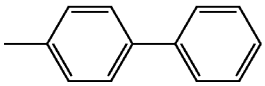 | — |

-continued
| | | | |
|---|---|---|---|
| CTIII-48 | 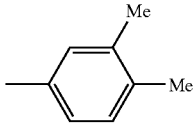 | 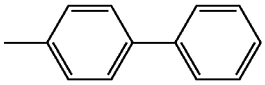 | — |
| CTIII-49 | 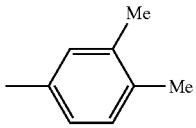 | 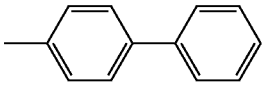 | — |
| CTIII-50 | 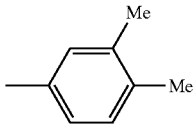 | 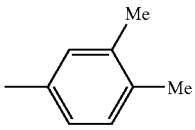 | — |
| CTIII-51 | 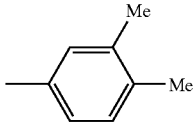 | 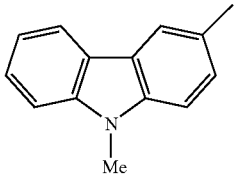 | — |
| CTIII-52 | 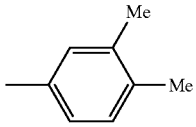 | 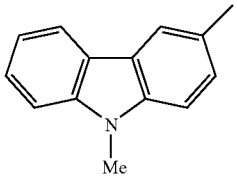 | — |
| CTIII-53 | 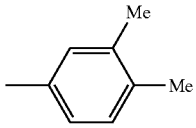 | 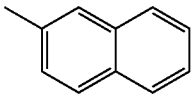 | — |
| CTIII-54 | 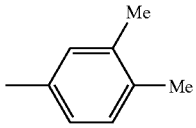 | 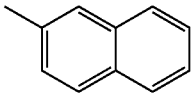 | — |
| CTIII-55 | 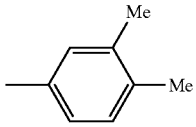 | 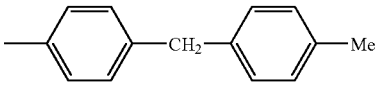 | — |
| CTIII-56 | 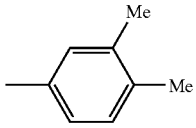 | 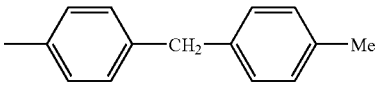 | — |
| CTIII-57 | 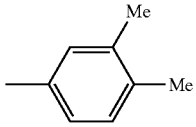 | 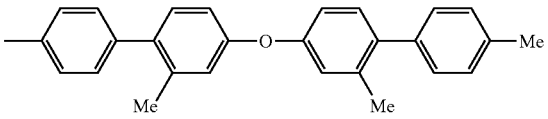 | — |

-continued
| | | | |
|---|---|---|---|
| CTIII-58 | 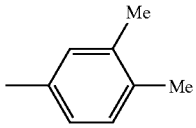 | 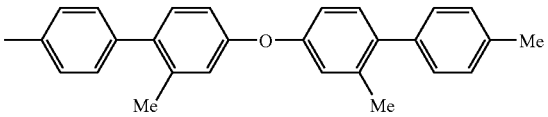 | — |
| CTIII-59 | 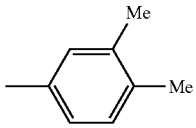 | 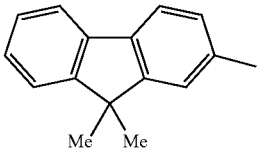 | — |
| CTIII-60 | 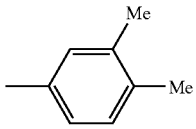 | 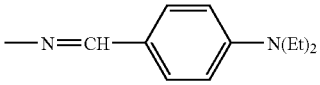 | — |
| CTIII-61 | 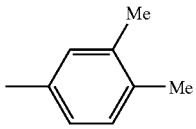 | 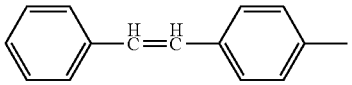 | — |
| No. | $Ar^4$ | $Ar^5$ | k | Y |
|---|---|---|---|---|
| CTIII-1 | — | 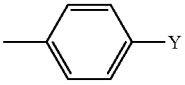 | 0 | —$(CH_2)_2$—COO—$(CH_2)_3$—Si(OiPr)$_3$ |
| CTIII-2 | — | 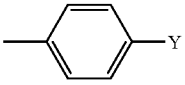 | 0 | —$(CH_2)_2$—COO—$(CH_2)_3$—Si(OiPr)$_2$Me |
| CTIII-3 | — | 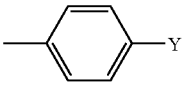 | 0 | —$(CH_2)_2$—COO—$(CH_2)_3$—Si(OiPr)Me$_2$ |
| CTIII-4 | — | 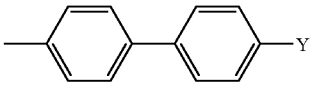 | 0 | —COO—$(CH_2)_3$—Si(OiPr)$_3$ |
| CTIII-5 | — | 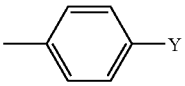 | 0 | —$(CH_2)_2$—COO—$(CH_2)_3$—Si(OiPr)$_3$ |
| CTIII-6 | — | 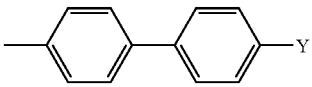 | 0 | —COO—$(CH_2)_3$—Si(OiPr)$_3$ |
| CTIII-7 | 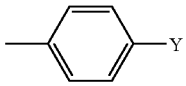 | 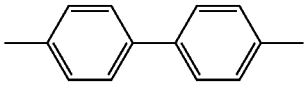 | 1 | —$(CH_2)_4$—Si(OEt)$_3$ |
| CTIII-8 | 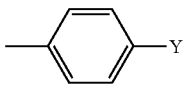 | 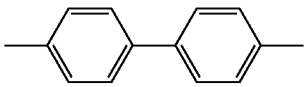 | 1 | —$(CH_2)_4$—Si(OiPr)$_3$ |
| CTIII-9 | 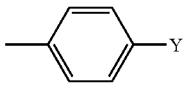 | 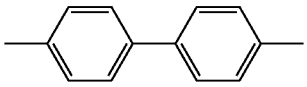 | 1 | —CH═CH—$(CH_2)_2$—Si(OiPr)$_3$ |

-continued
| | | | | |
|---|---|---|---|---|
| CTIII-10 | 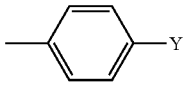 | 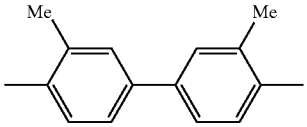 | 1 | —$(CH_2)_4$—$Si(OMe)_3$ |
| CTIII-11 | 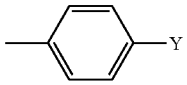 | 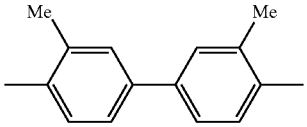 | 1 | —$(CH_2)_4$—$Si(OiPr)_3$ |
| CTIII-12 | 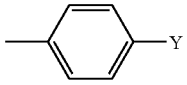 | 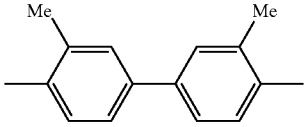 | 1 | —CH═CH—$(CH_2)_2$—$Si(OiPr)_3$ |
| CTIII-13 | 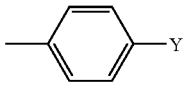 | 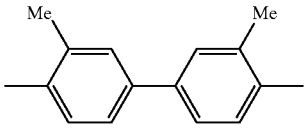 | 1 | —CH═N—$(CH_2)_3$—$Si(OiPr)_3$ |
| CTIII-14 | 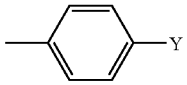 | 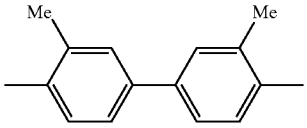 | 1 | —O—$(CH_2)_3$—$Si(OiPr)_3$ |
| CTIII-15 | 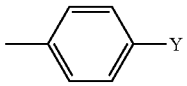 | 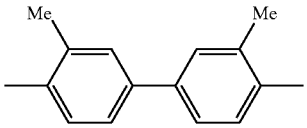 | 1 | —COO—$(CH_2)_3$—$Si(OiPr)_3$ |
| CTIII-16 | 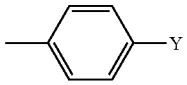 | 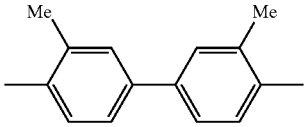 | 1 | —$(CH_2)_2$—COO—$(CH_2)_3$—$Si(OiPr)_3$ |
| CTIII-17 | 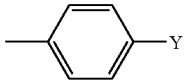 | 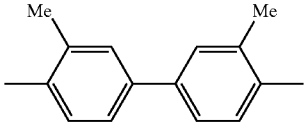 | 1 | —$(CH_2)_2$—COO—$(CH_2)_3$—$Si(OiPr)_2Me$ |
| CTIII-18 | 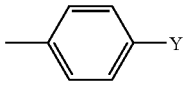 | 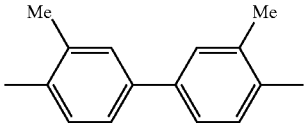 | 1 | —$(CH_2)_2$—COO—$(CH_2)_3$—$Si(OiPr)Me_2$ |
| CTIII-19 | 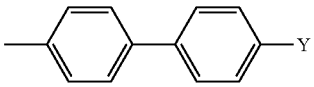 | 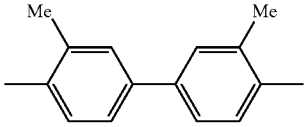 | 1 | —COO—$(CH_2)_3$—$Si(OiPr)_3$ |
| CTIII-20 | 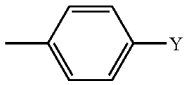 | 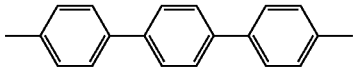 | 1 | —$(CH_2)_4$—$Si(OiPr)_3$ |
| CTIII-21 | 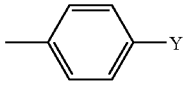 | 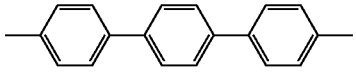 | 1 | —CH═CH—$(CH_2)_2$—$Si(OiPr)_3$ |

-continued

| | | | | |
|---|---|---|---|---|
| CTIII-22 | 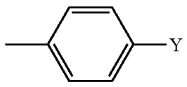 | 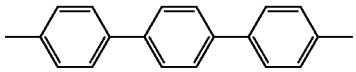 | 1 | —$(CH_2)_2$—COO—$(CH_2)_3$—Si(OiPr)$_3$ |
| CTIII-23 | 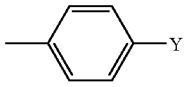 | 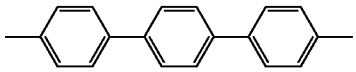 | 1 | —$(CH_2)_2$—COO—$(CH_2)_3$—Si(OiPr)$_2$Me |
| CTIII-24 | 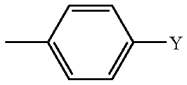 | 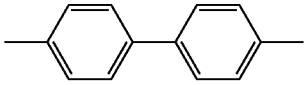 | 1 | —COO—$(CH_2)_3$—Si(OiPr)$_3$ |
| CTIII-25 | 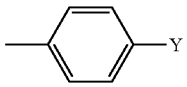 | 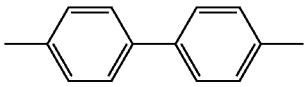 | 1 | —$(CH_2)_2$—COO—$(CH_2)_3$—Si(OiPr)$_3$ |
| CTIII-26 | 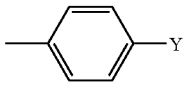 | 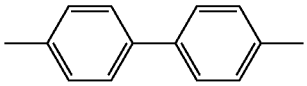 | 1 | —$(CH_2)_2$—COO—$(CH_2)_3$—Si(OiPr)$_2$Me |
| CTIII-27 | 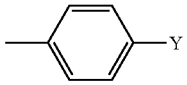 | 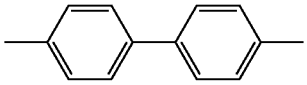 | 1 | —$(CH_2)_2$—COO—$(CH_2)_3$—Si(OiPr)Me$_2$ |
| CTIII-28 | 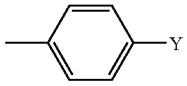 | 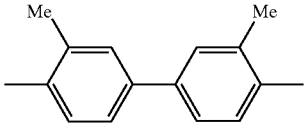 | 1 | —COO—$(CH_2)_3$—Si(OiPr)$_3$ |
| CTIII-29 | 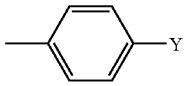 | 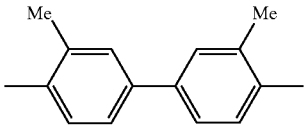 | 1 | —$(CH_2)_2$—COO—$(CH_2)_3$—Si(OiPr)$_3$ |
| CTIII-30 | 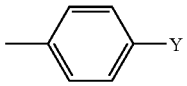 | 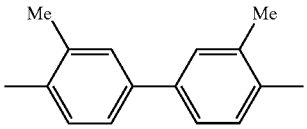 | 1 | —$(CH_2)_2$—COO—$(CH_2)_3$—Si(OiPr)$_2$Me |
| CTIII-31 | 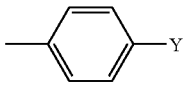 | 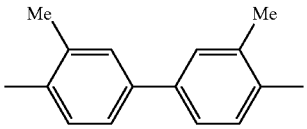 | 1 | —$(CH_2)_2$—COO—$(CH_2)_3$—Si(OiPr)Me$_2$ |
| CTIII-32 | — | 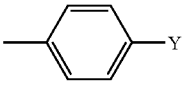 | 0 | —$(CH_2)_4$—Si(OiPr)$_3$ |
| CTIII-33 | — | 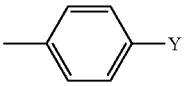 | 0 | —$(CH_2)_4$—Si(OEt)$_3$ |
| CTIII-34 | — | 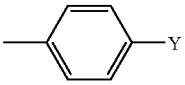 | 0 | —$(CH_2)_4$—Si(OMe)$_3$ |
| CTIII-35 | — | 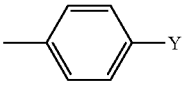 | 0 | —$(CH_2)_4$—SiMe(OMe)$_2$ |

-continued

| | | | | |
|---|---|---|---|---|
| CTIII-36 | — | 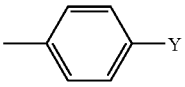 | 0 | —$(CH_2)_4$—SiMe$(OiPr)_2$ |
| CTIII-37 | — | 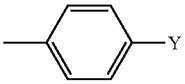 | 0 | —CH═CH—$(CH_2)_2$—Si$(OiPr)_3$ |
| CTIII-38 | — | 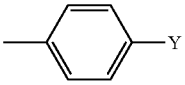 | 0 | —CH═CH—$(CH_2)_2$—Si$(OMe)_3$ |
| CTIII-39 | — | 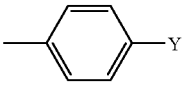 | 0 | —CH═N—$(CH_2)_3$—Si$(OiMe)_3$ |
| CTIII-40 | — | 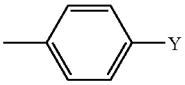 | 0 | —CH═N—$(CH_2)_3$—Si$(OiPr)_3$ |
| CTIII-41 | — | 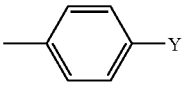 | 0 | —O—$(CH_2)_3$—Si$(OiPr)_3$ |
| CTIII-42 | — | 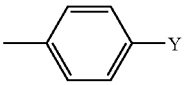 | 0 | —COO—$(CH_2)_3$—Si$(OiPr)_3$ |
| CTIII-43 | — | 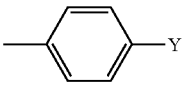 | 0 | —$(CH_2)_2$—COO—$(CH_2)_3$—Si$(OiPr)_3$ |
| CTIII-44 | — | 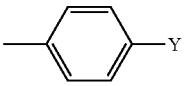 | 0 | —$(CH_2)_2$—COO—$(CH_2)_3$—Si$(OiPr)_2$Me |
| CTIII-45 | — | 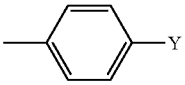 | 0 | —$(CH_2)_2$—COO—$(CH_2)_3$—Si(OiPr)$Me_2$ |
| CTIII-46 | — | 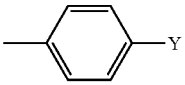 | 0 | —$(CH_2)_4$—Si$(OMe)_3$ |
| CTIII-47 | — | 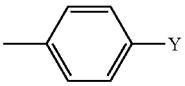 | 0 | —$(CH_2)_2$—COO—$(CH_2)_3$—Si$(OiPr)_3$ |
| CTIII-48 | — | 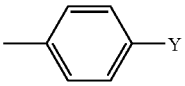 | 0 | —$(CH_2)_2$—COO—$(CH_2)_3$—SiMe$(OiPr)_2$ |
| CTIII-49 | — | 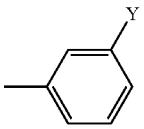 | 0 | —O—$(CH_2)_3$—Si$(OiPr)_3$ |
| CTIII-50 | — | 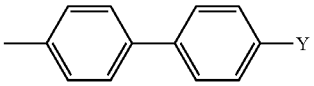 | 0 | —COO—$(CH_2)_3$—Si$(OiPr)_3$ |
| CTIII-51 | — | 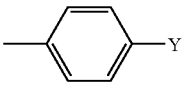 | 0 | —$(CH_2)_4$—Si$(OiPr)_3$ |

-continued

| | | | | |
|---|---|---|---|---|
| CTIII-52 | — | 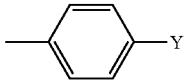 | 0 | —$(CH_2)_2$—COO—$(CH_2)_3$—Si(OiPr)$_3$ |
| CTIII-53 | — | 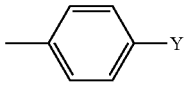 | 0 | —$(CH_2)_4$—Si(OiPr)$_3$ |
| CTIII-54 | — | 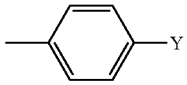 | 0 | —$(CH_2)_2$—COO—$(CH_2)_3$—Si(OiPr)$_3$ |
| CTIII-55 | — | 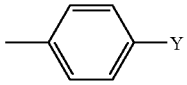 | 0 | —$(CH_2)_4$—Si(OiPr)$_3$ |
| CTIII-56 | — | 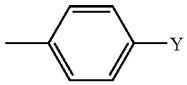 | 0 | —$(CH_2)_2$—COO—$(CH_2)_3$—Si(OiPr)$_3$ |
| CTIII-57 | — | 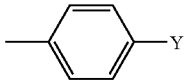 | 0 | —$(CH_2)_4$—Si(OiPr)$_3$ |
| CTIII-58 | — | 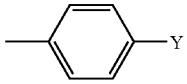 | 0 | —$(CH_2)_2$—COO—$(CH_2)_3$—Si(OiPr)$_3$ |
| CTIII-59 | — | 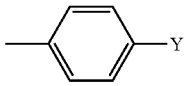 | 0 | —$(CH_2)_2$—COO—$(CH_2)_3$—Si(OiPr)$_3$ |
| CTIII-60 | — | 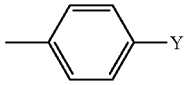 | 0 | —$(CH_2)_2$—COO—$(CH_2)_3$—Si(OiPr)$_3$ |
| CTIII-61 | — | 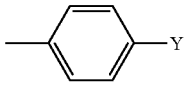 | 0 | —$(CH_2)_2$—COO—$(CH_2)_3$—Si(OiPr)$_3$ |

Following compound (CTIV-1) to (CTIV-40) may be given as specific examples of the compound represented by the above Formula (CTIV). In the following table, Me or a bond (—) are shown, but where a substituent is not indicated then these represent a methyl group and Et represents an ethyl group.

CTIV-1

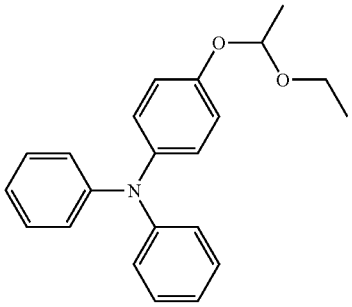

CTIV-2

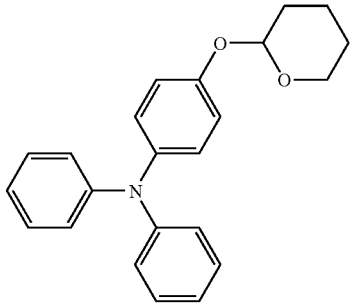

-continued
CTIV-3
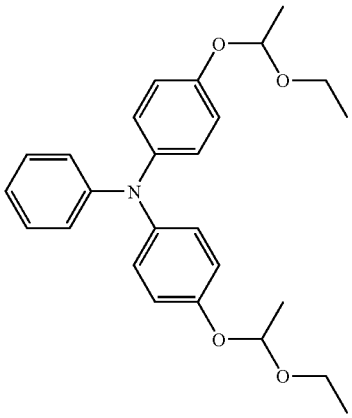
CTIV-4
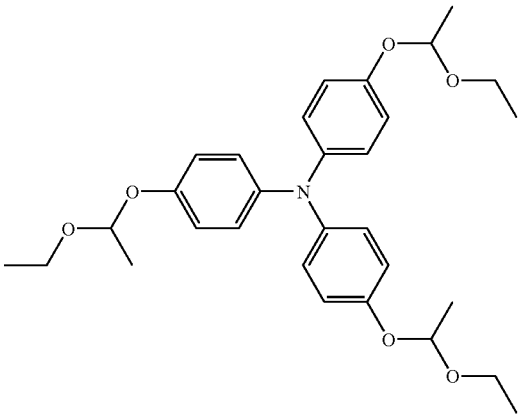
CTIV-5
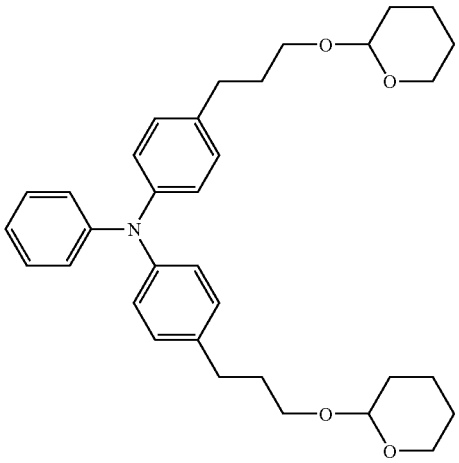
CTIV-6
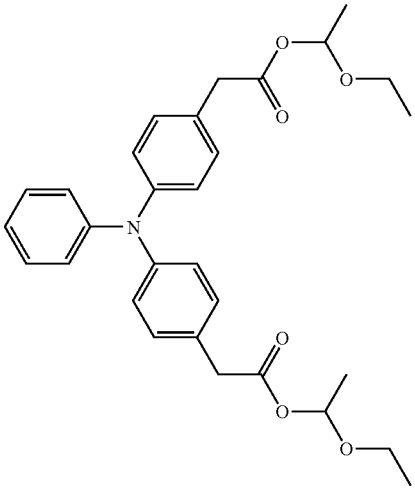
CTIV-7
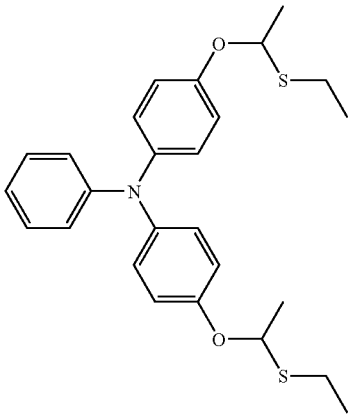
CTIV-8
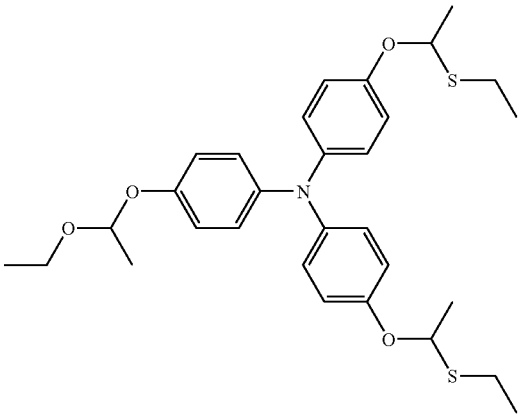

-continued
CTIV-9
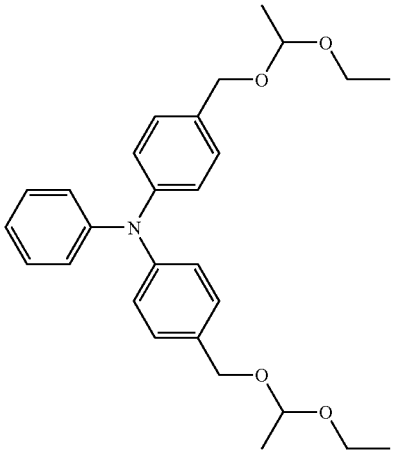
CTIV-10
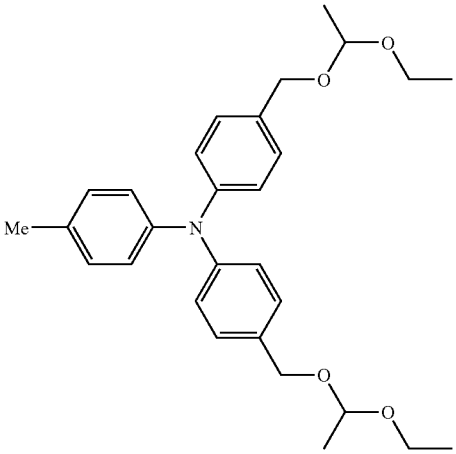
CTIV-11
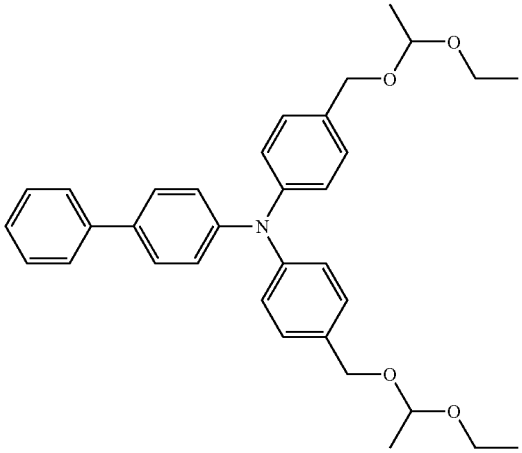
CTIV-12
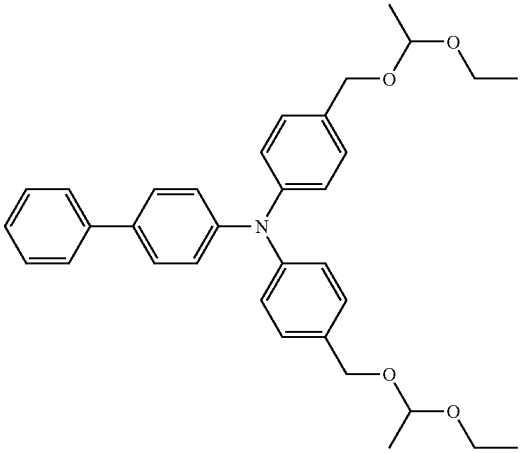
CTIV-13
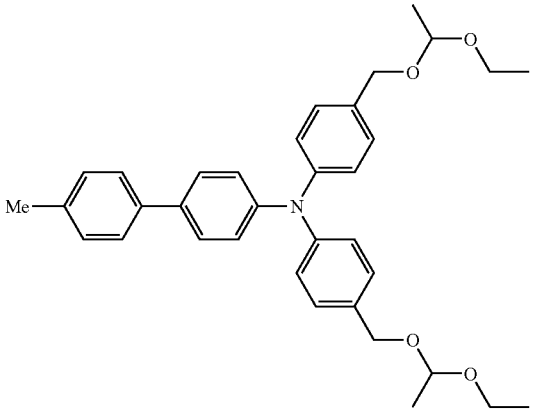
CTIV-14
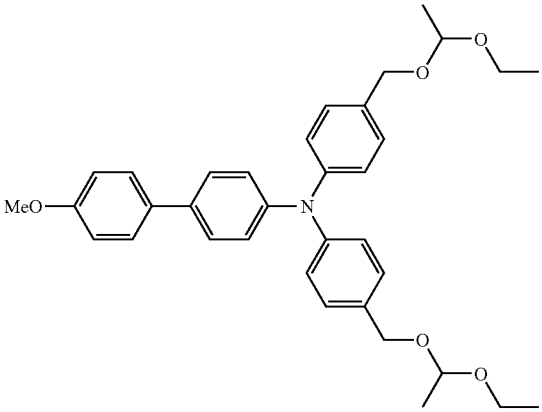

-continued
CTIV-15
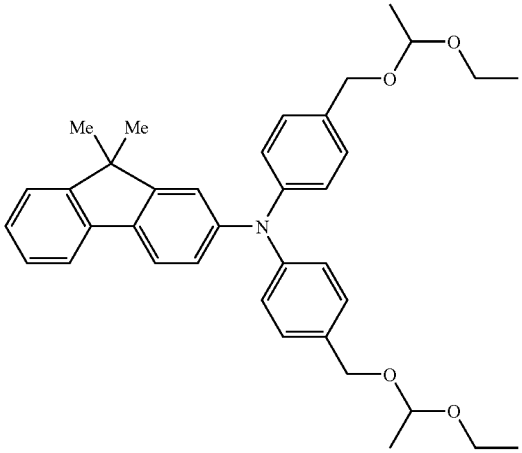
CTIV-16
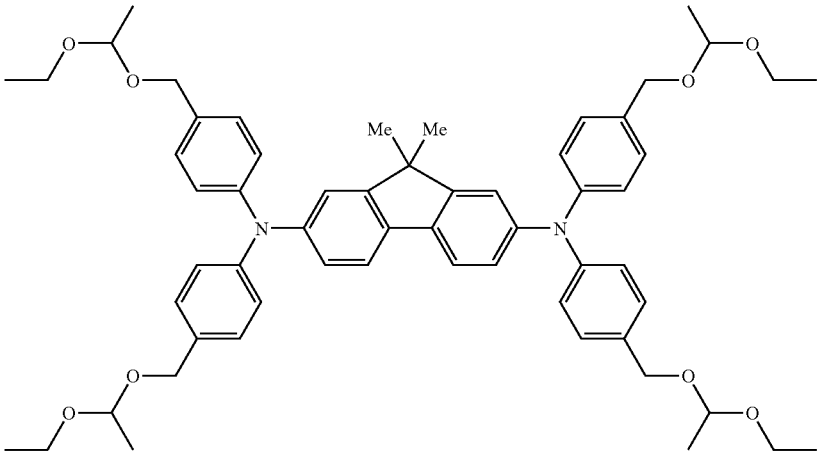
CTIV-17
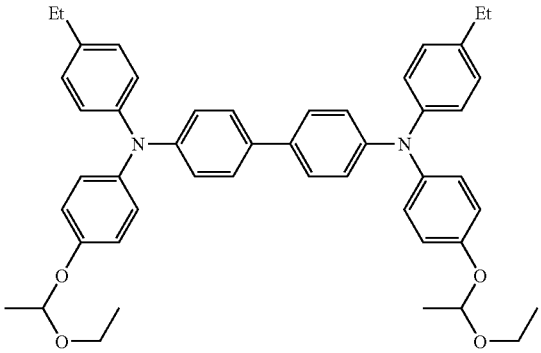
CTIV-18
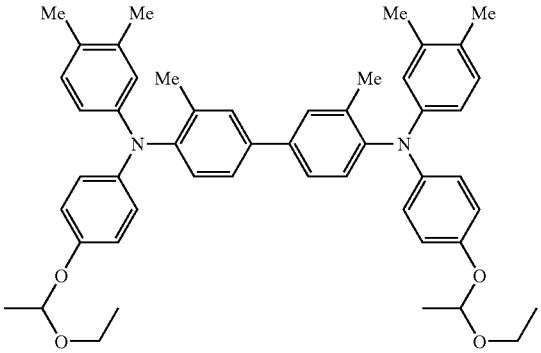

-continued
CTIV-19
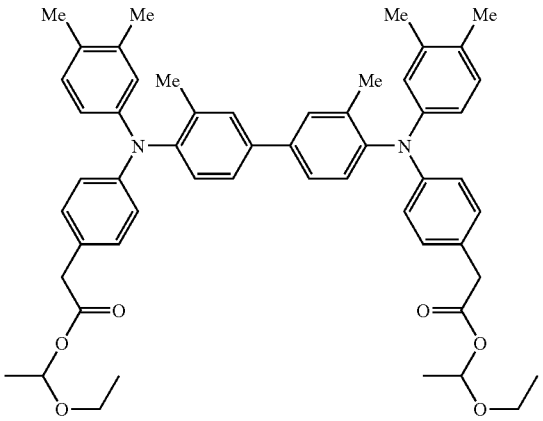
CTIV-20
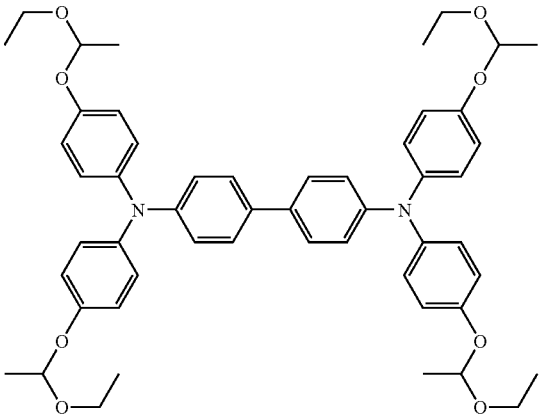
CTIV-21
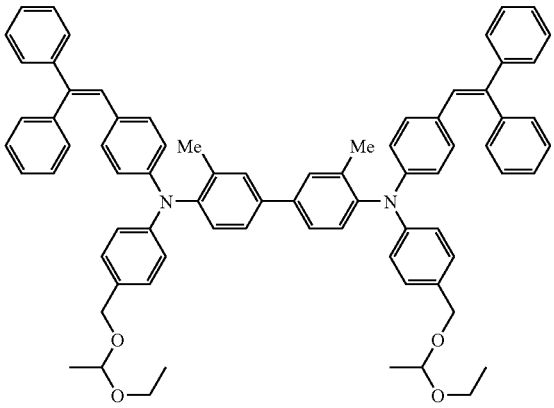
CTIV-22
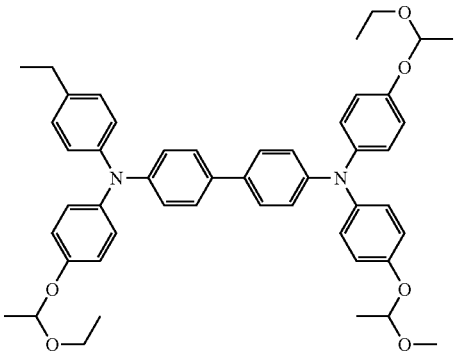
CTIV-23
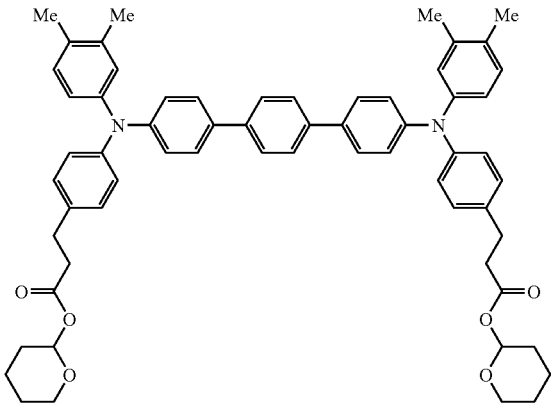
CTIV-24
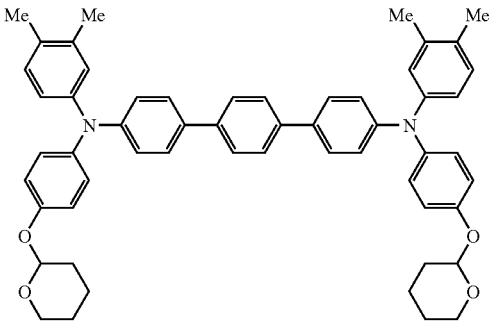

-continued
CTIV-25
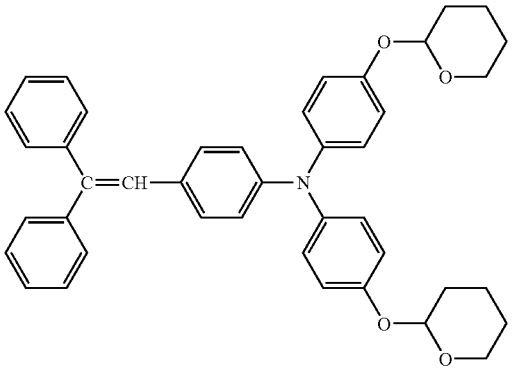
CTIV-26
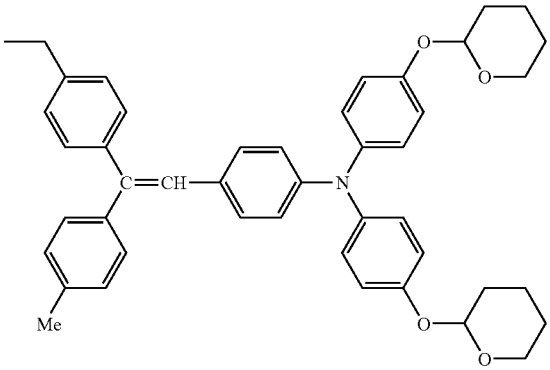
CTIV-27
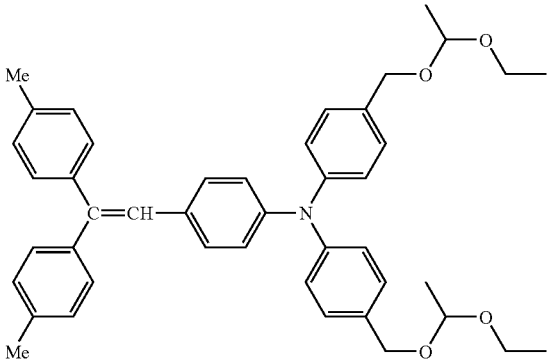
CTIV-28
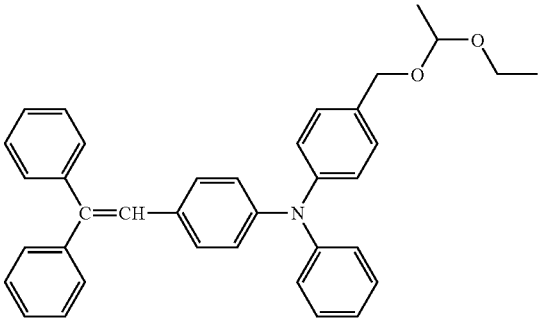
CTIV-29
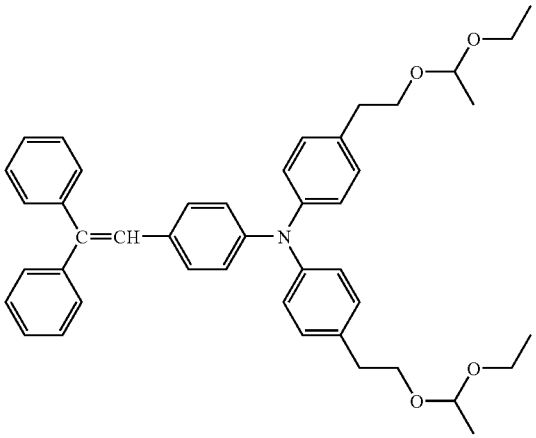
CTIV-30
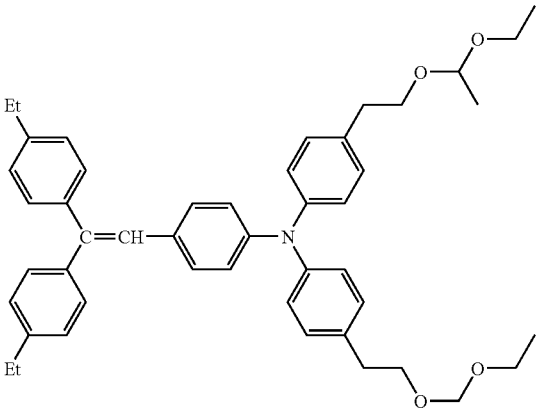

-continued
CTIV-31
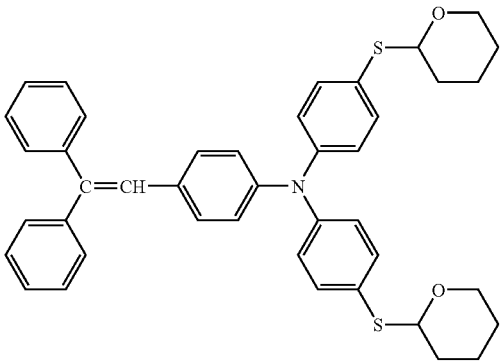
CTIV-32
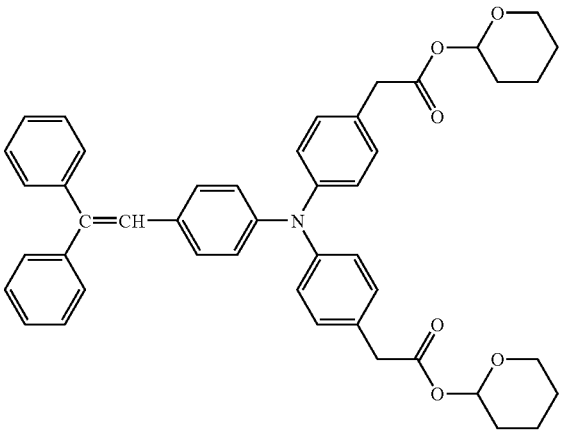
CTIV-33
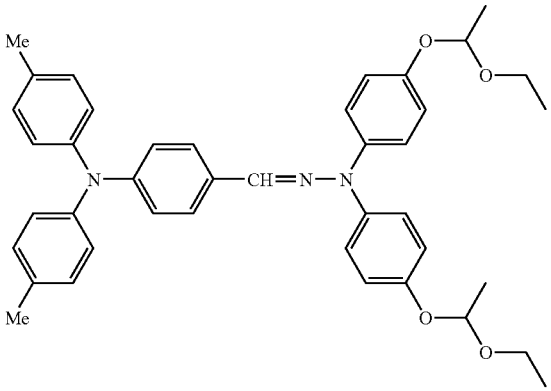
CTIV-34
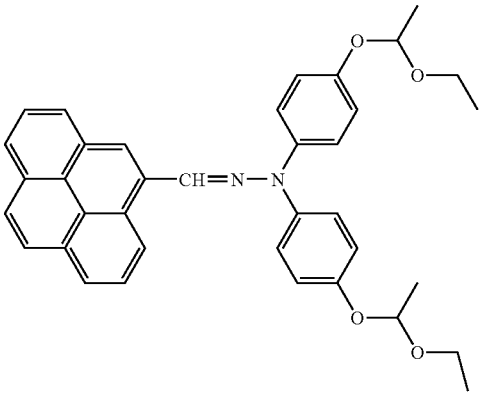
CTIV-35
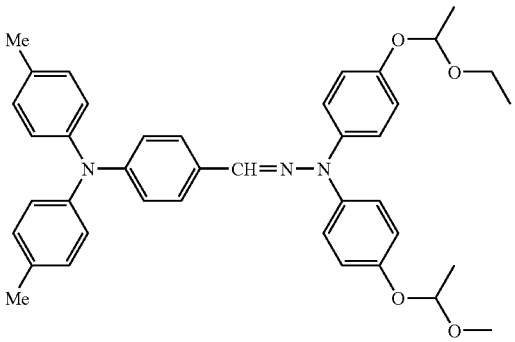
CTIV-36
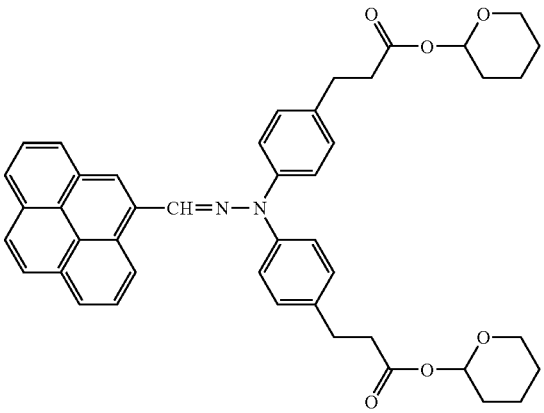

-continued
CTIV-37
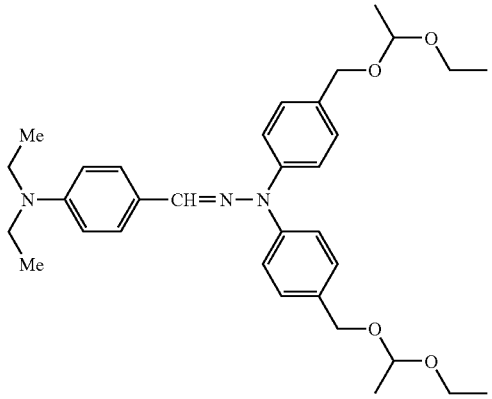
CTIV-38
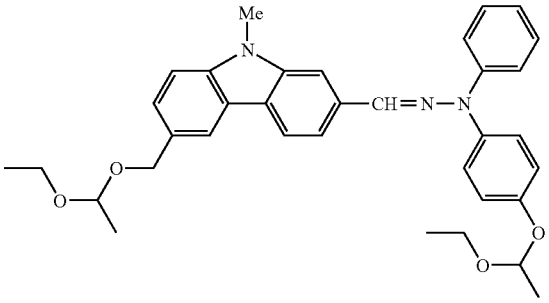
CTIV-39
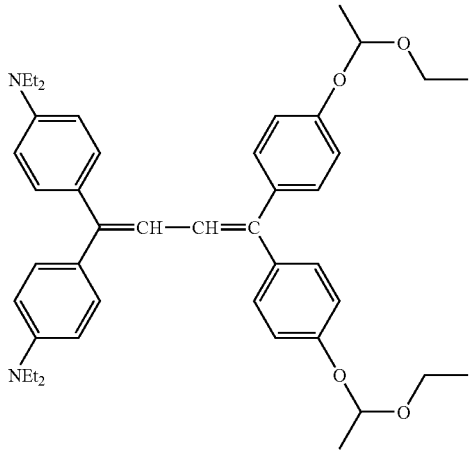
CTIV-40
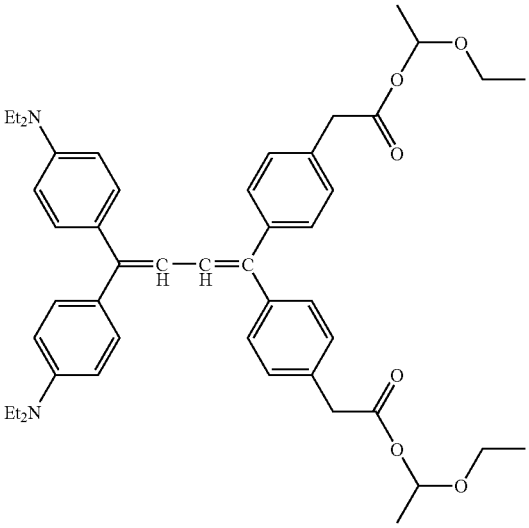
The following compounds (CTV-1) to (CTV-55) may be given as specific examples of compounds represented by the above Formula (CTV). In the following table, Me or a bond (—) are shown, but where a substituent is not indicated then these represent a methyl group, and Et represents an ethyl group.
(CTV-1)
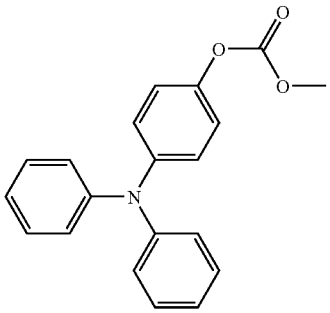
(CTV-2)
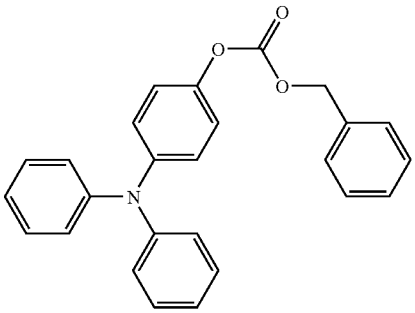

-continued
(CTV-3)
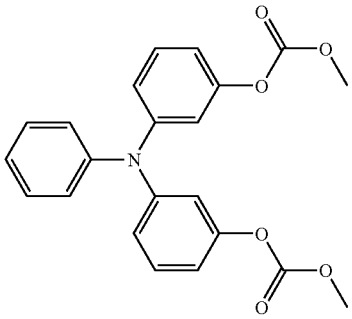
(CTV-4)
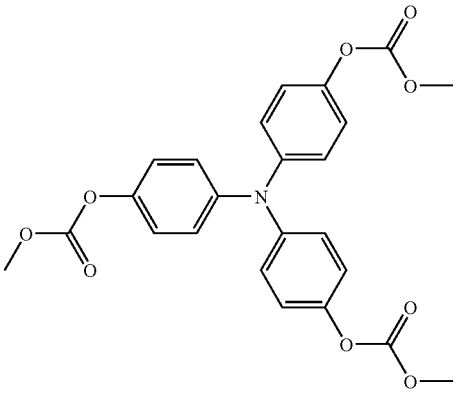
(CTV-5)
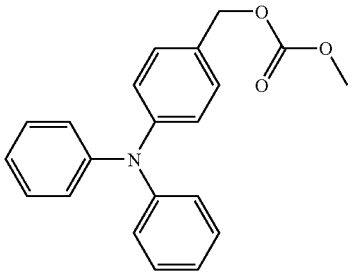
(CTV-6)
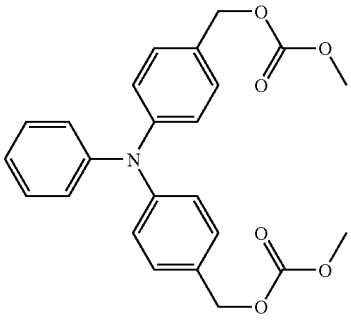
(CTV-7)
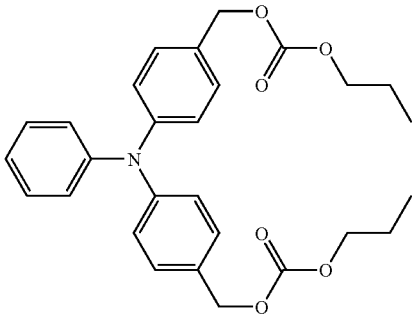
(CTV-8)
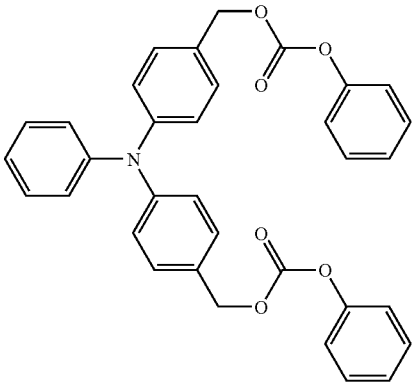
(CTV-9)
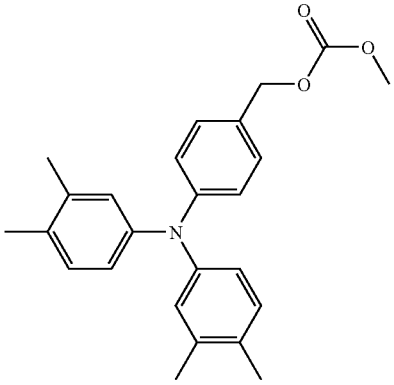
(CTV-10)
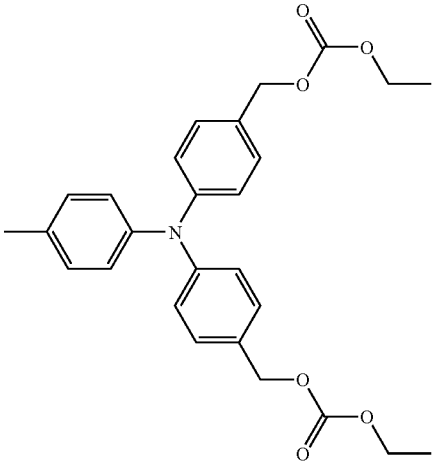

-continued
(CTV-11)
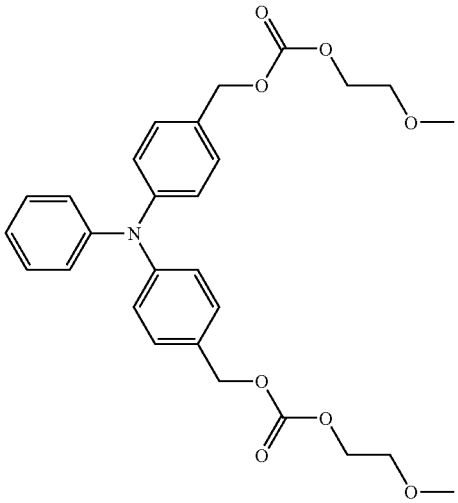
(CTV-12)
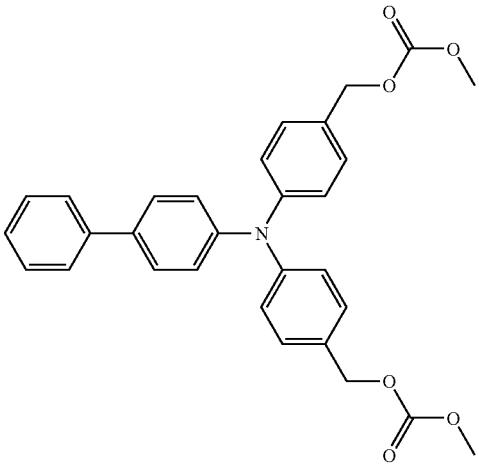
(CTV-13)
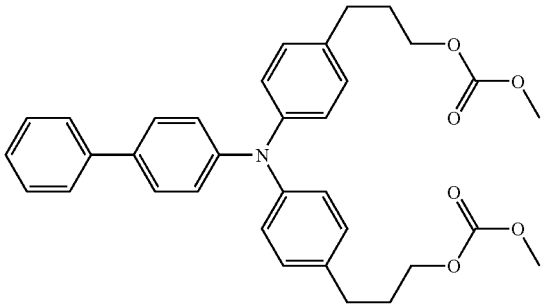
(CTV-14)
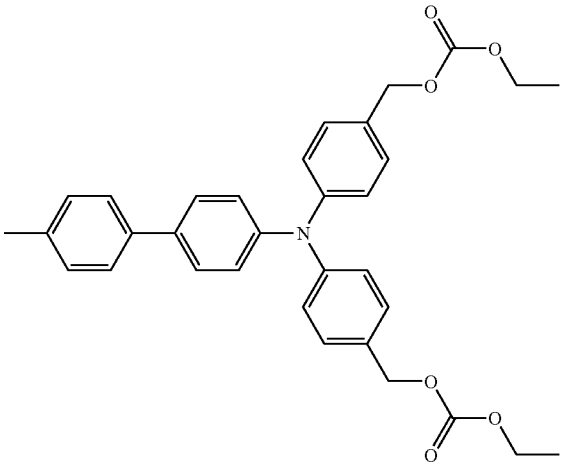
(CTV-15)
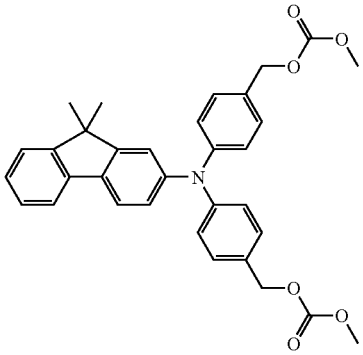
(CTV-16)
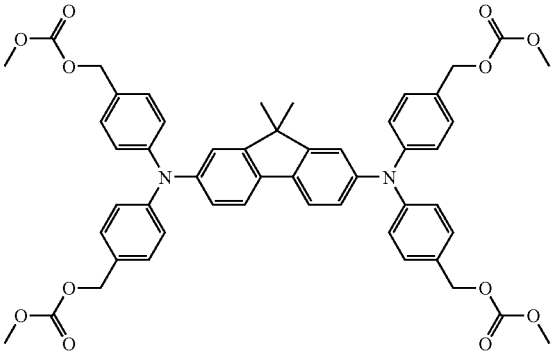

-continued
(CTV-17)
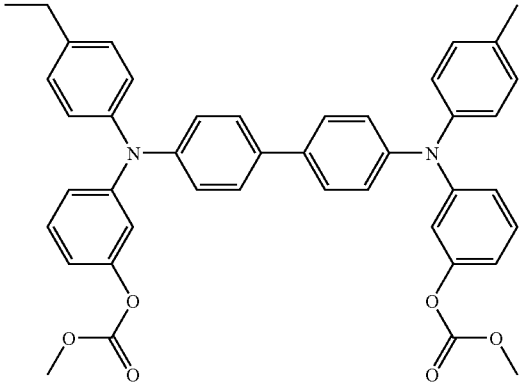
(CTV-18)
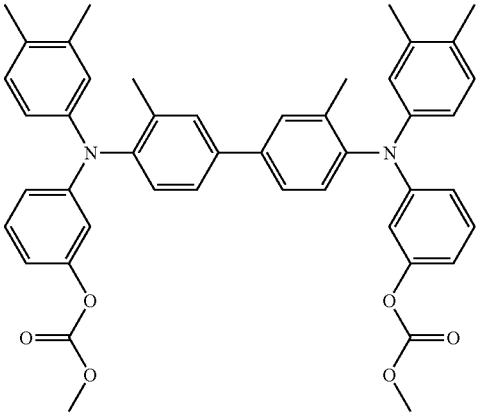
(CTV-19)
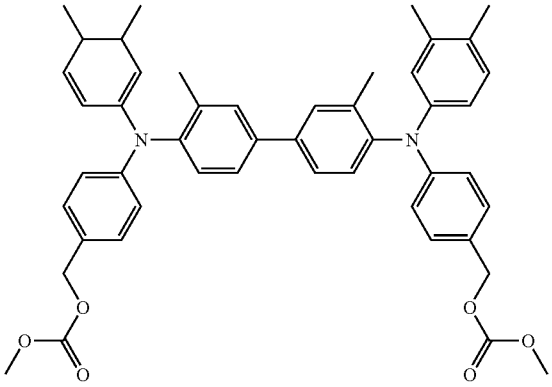
(CTV-20)
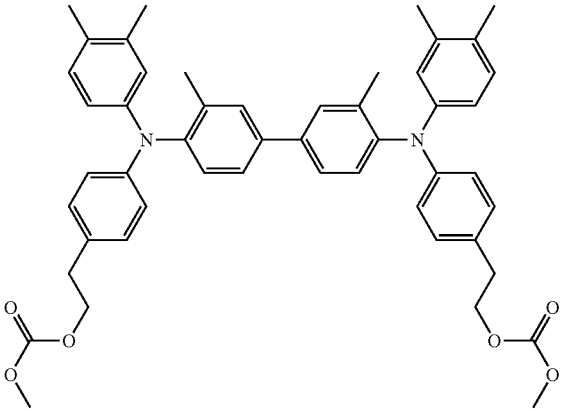
(CTV-21)
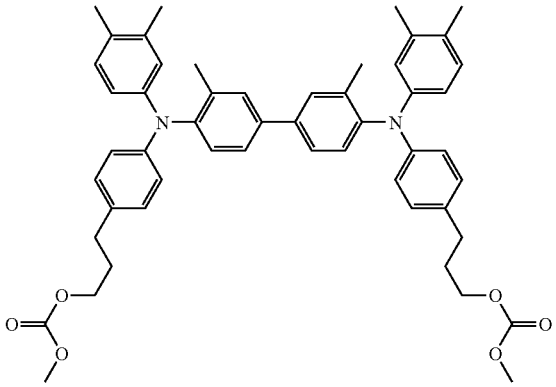
(CTV-22)
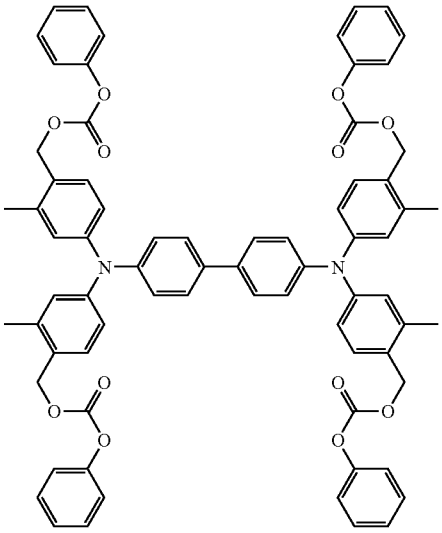

-continued
(CTV-23)
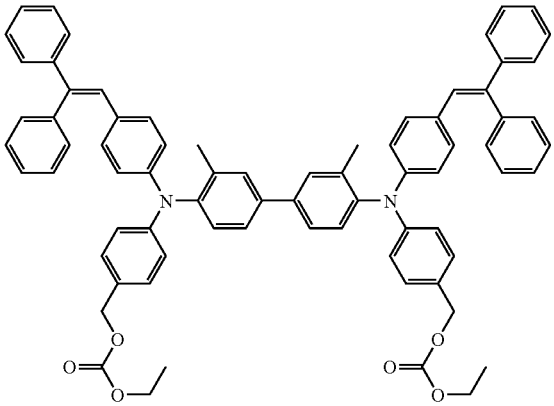
(CTV-24)
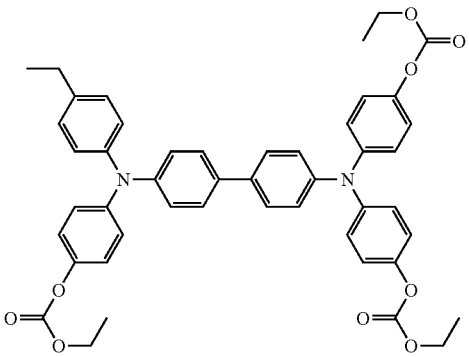
(CTV-25)
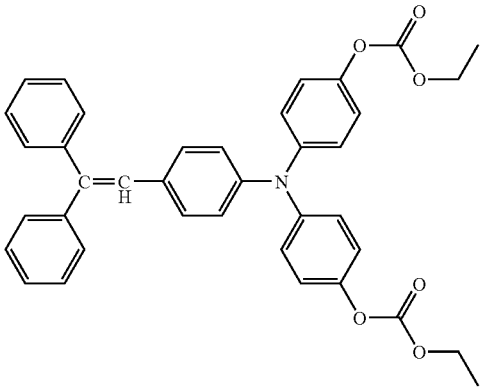
(CTV-26)
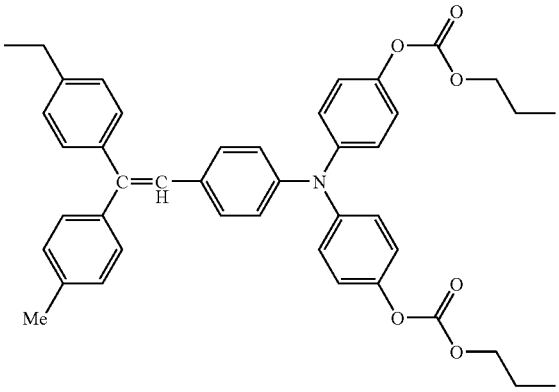
(CTV-27)
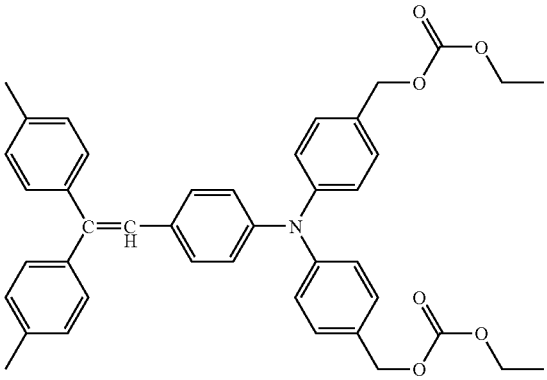
(CTV-28)
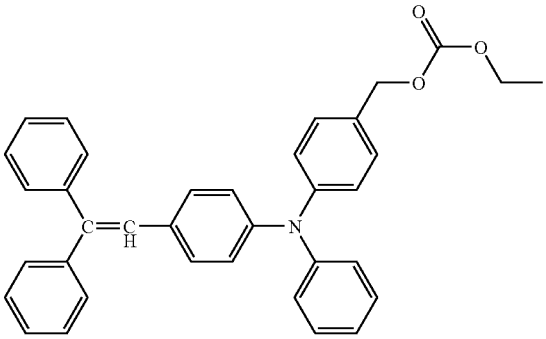

-continued
(CTV-29)
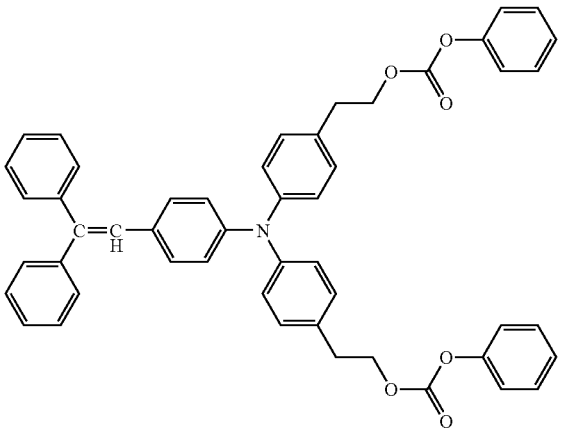
(CTV-30)
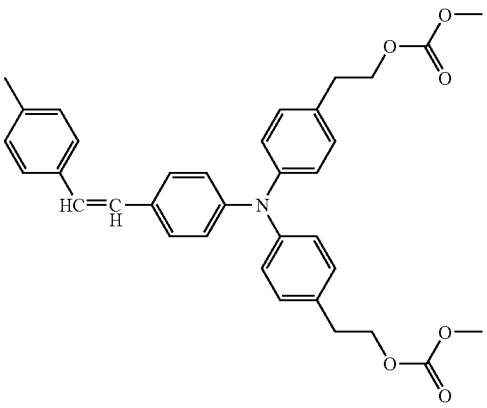
(CTV-31)
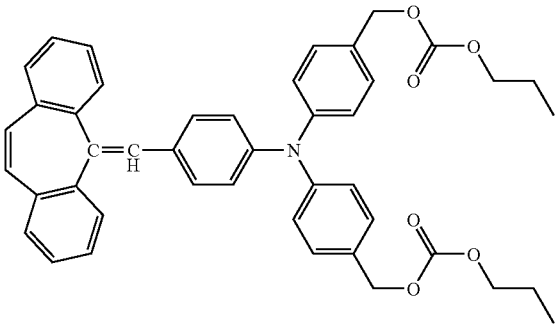
(CTV-32)
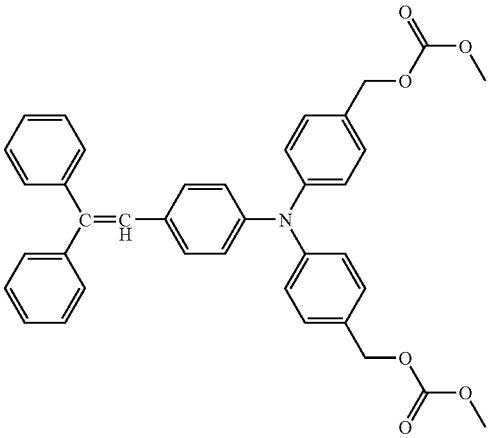
(CTV-33)
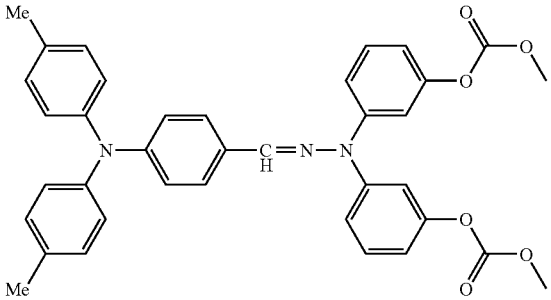
(CTV-34)
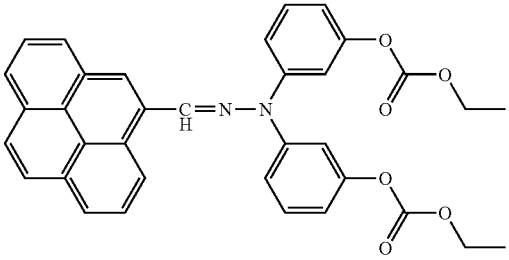

-continued
(CTV-35)
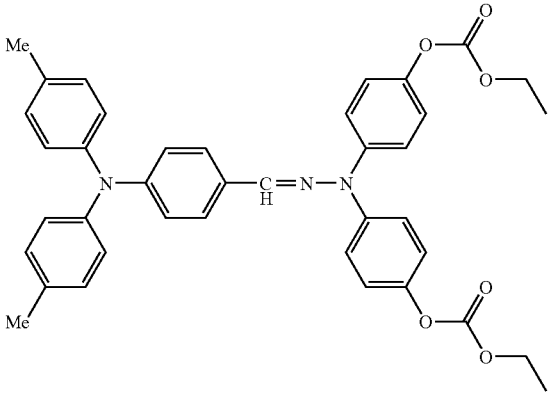
(CTV-36)
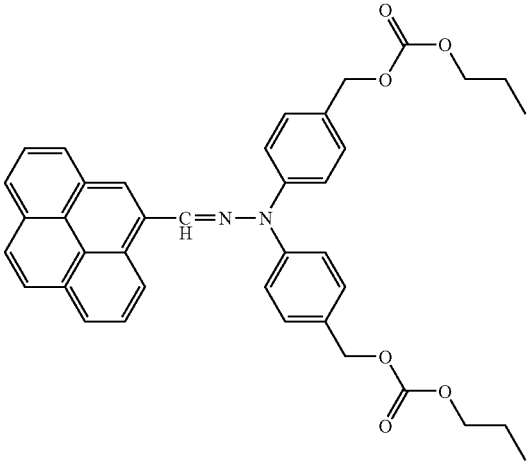
(CTV-37)
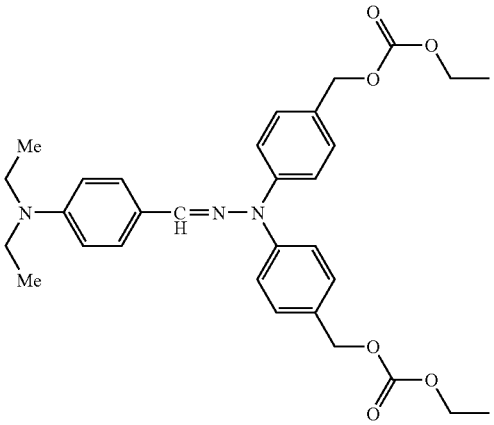
(CTV-38)
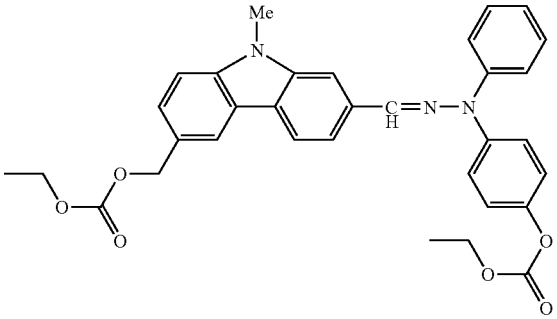
(CTV-39)
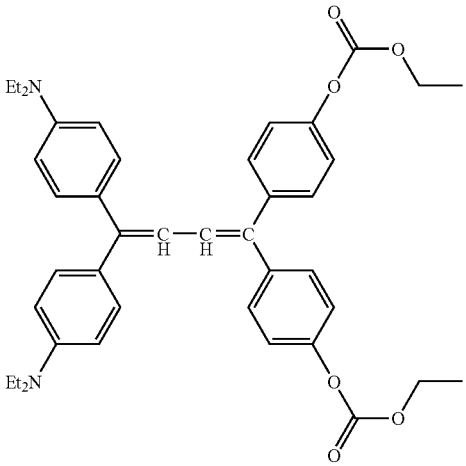
(CTV-40)
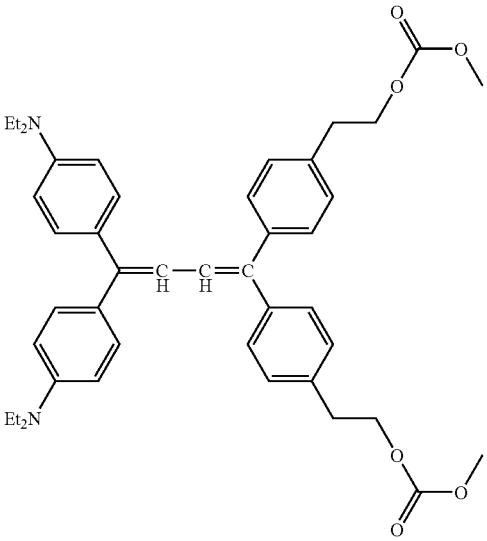

-continued
(CTV-41)
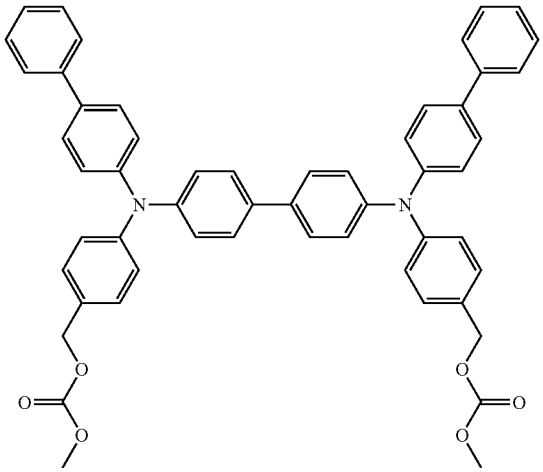
(CTV-42)
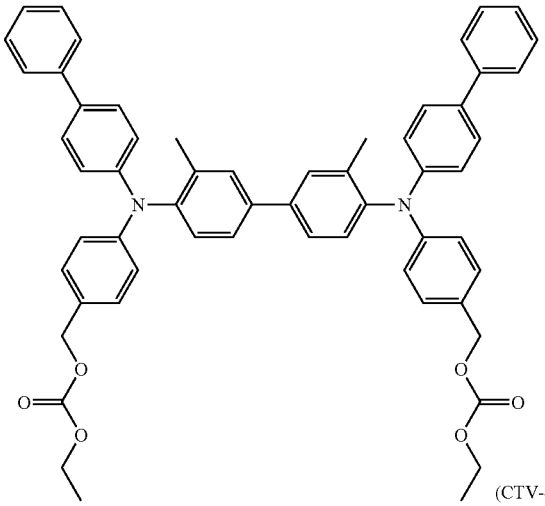
(CTV-43)
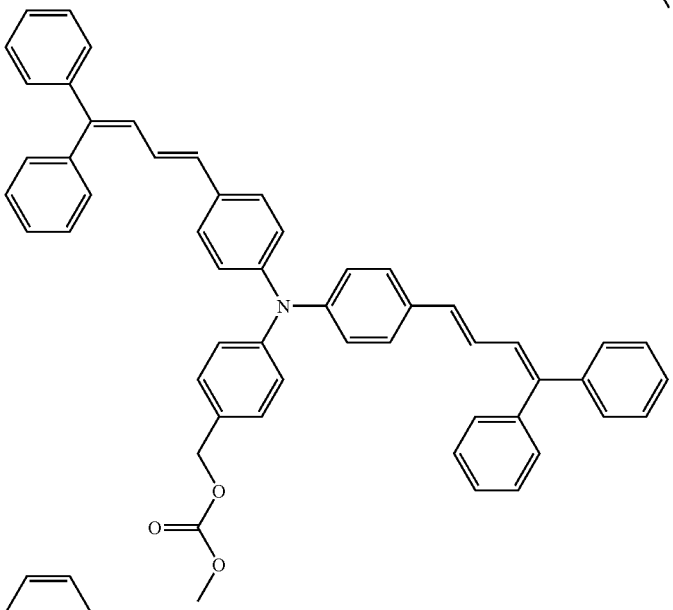
(CTV-44)
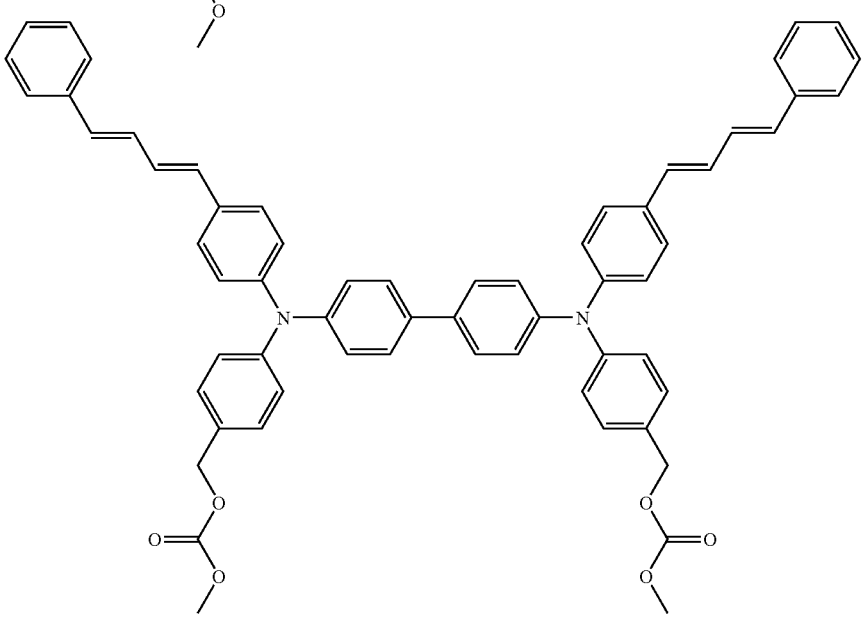

-continued
(CTV-45)
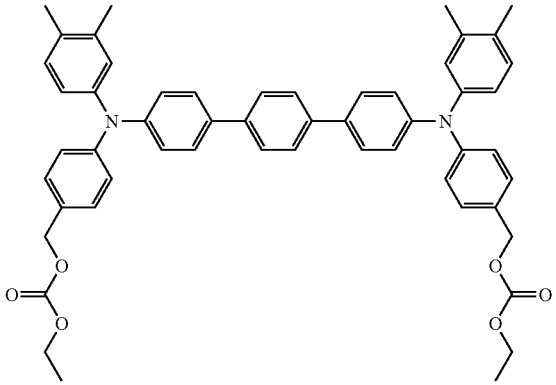
(CTV-46)
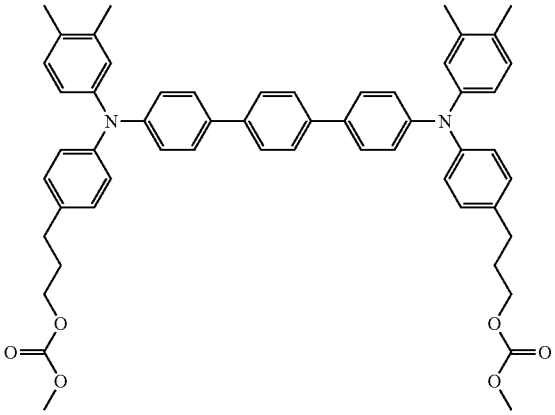
(CTV-47)
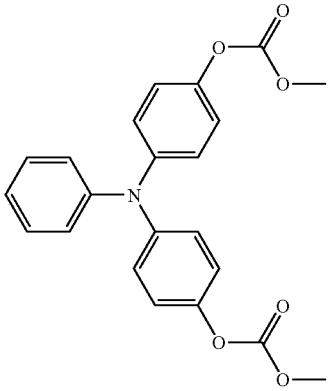
(CTV-48)
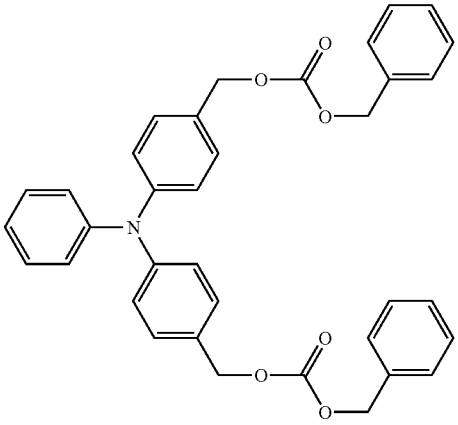
(CTV-49)
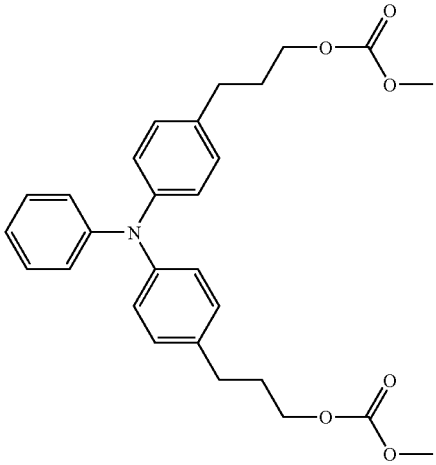
(CTV-50)
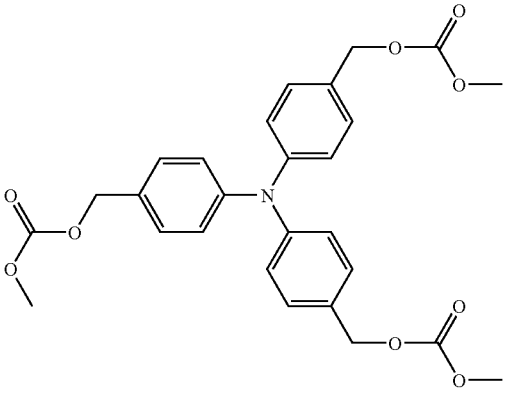

-continued
(CTV-51)
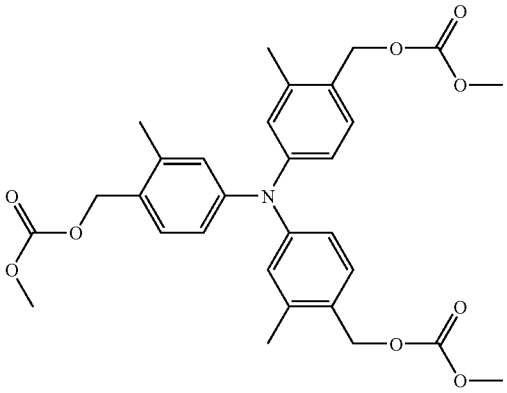
(CTV-52)
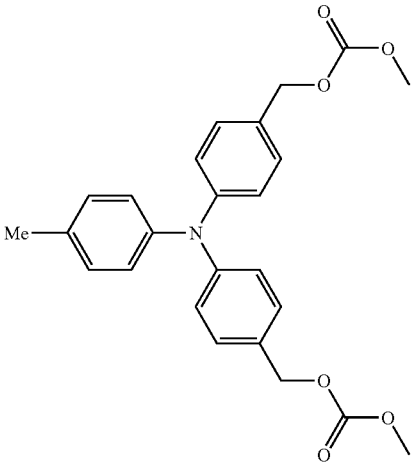
(CTV-53)
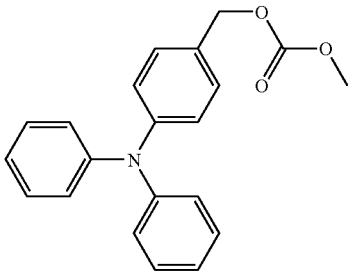
(CTV-54)
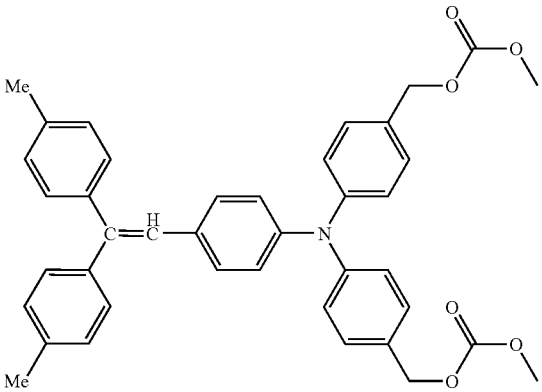
(CTV-55)
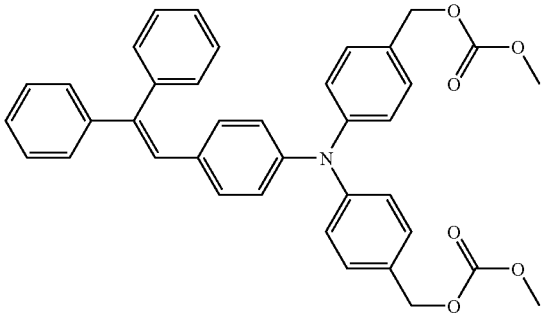
Compounds (CTVI-1) to (CTVI-17) represented below are examples that may be given of compounds represented by the above Formula (CTVI). In the following table, Me or a bond (—) are shown, but where a substituent is not indicated then these represent a methyl group, and Et represents an ethyl group.

CTVI-1
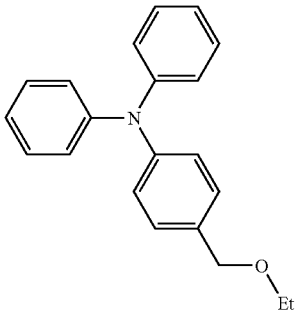
CTVI-2
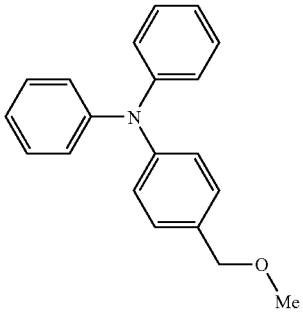
CTVI-3
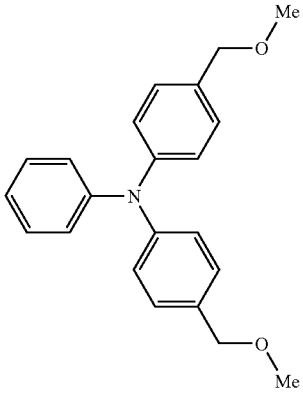
CTVI-4
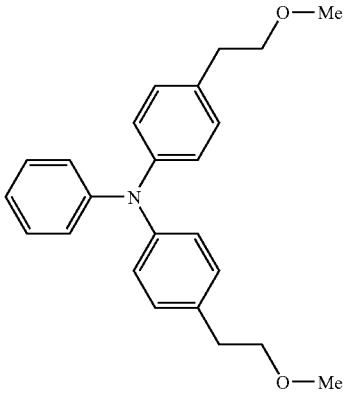
-continued
CTVI-5
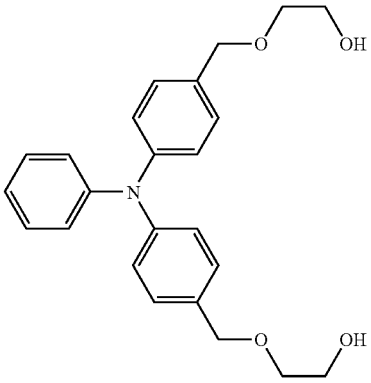
CTVI-6
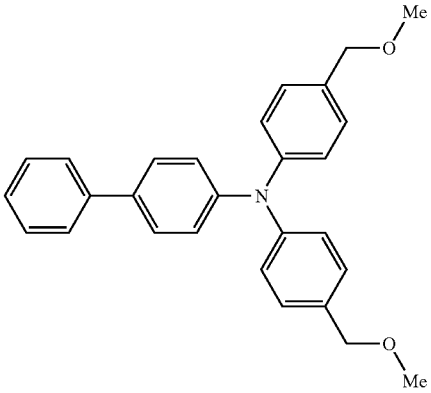
CTVI-7
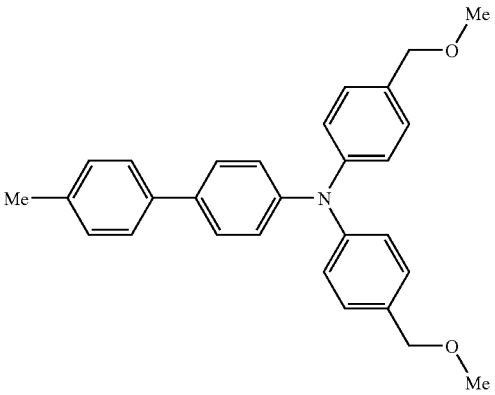
CTVI-8
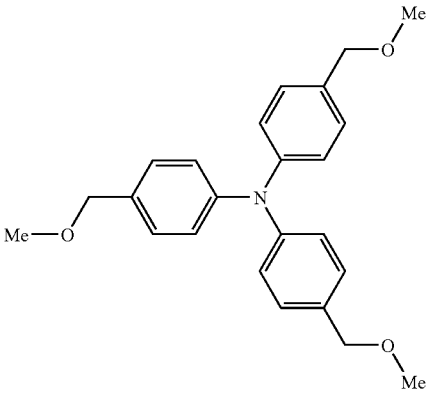

-continued
CTVI-9
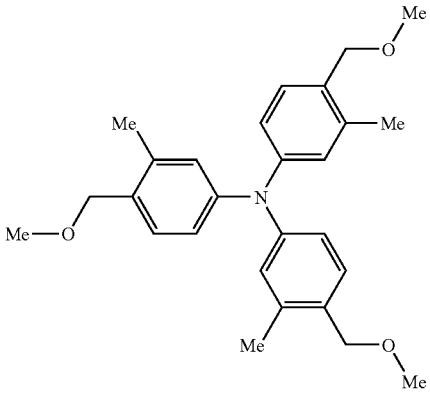
CTVI-10
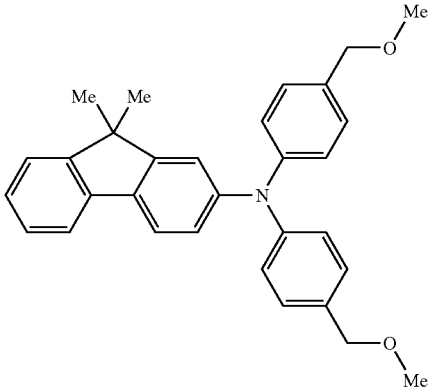
CTVI-11
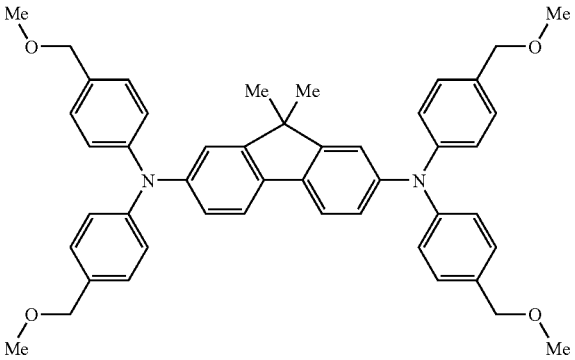
CTVI-12
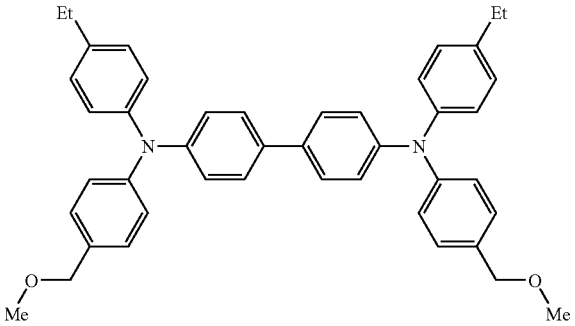
-continued
CTVI-13
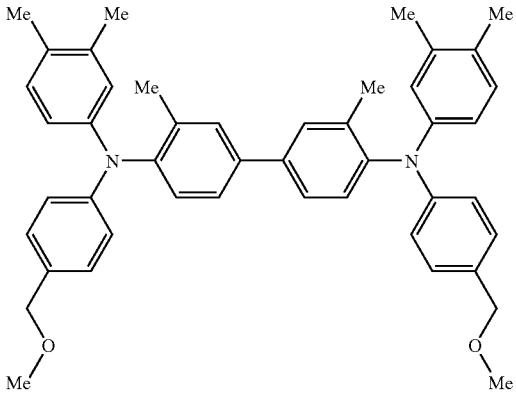
CTVI-14
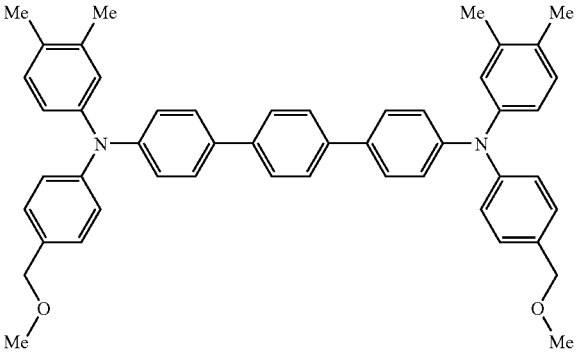
CTVI-15
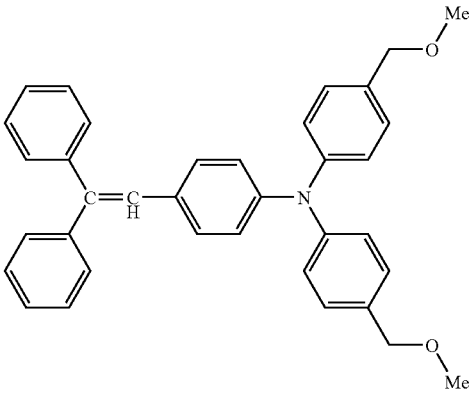
CTVI-16
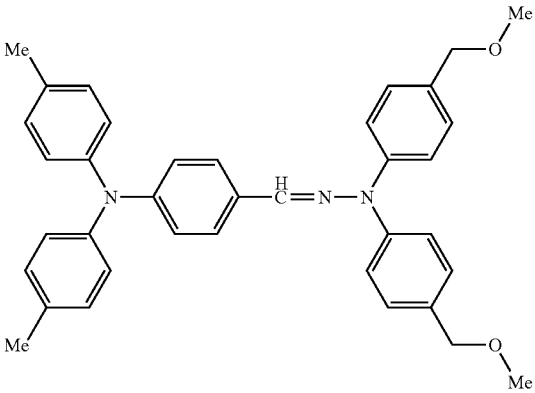

-continued

CTVI-17

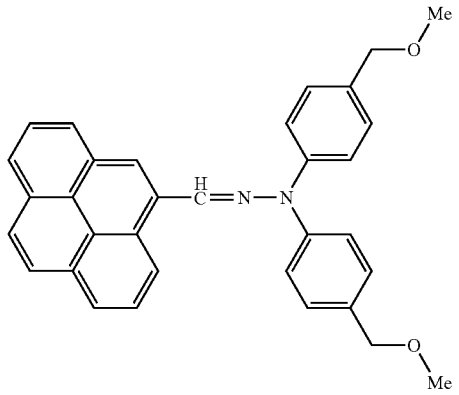

The compound represented by the following Formula (IV) may be added to the protective layer 7, in order to control various physical properties, such as the strength of the protective layer 7, and the film resistance.

$$Si(R^{30})_{(4-g)}Q_g \quad (IV)$$

In Formula (IV), $R^{30}$ represents a hydrogen atom, an alkyl group, or a substituted or unsubstituted aryl group; Q represents a hydrolyzable group; and g represents an integer of 1 to 4.

The following silane coupling agents may be given as specific examples of the compounds represented by the above Formula (IV).

Examples that may be given of silane coupling agents include: tetrafunctional alkoxysilanes (g=4); methyltrimetoxysilane, such as tetramethoxy silane and tetraethoxy silane; trifunctional alkoxysilanes (g=3), such as methyl triethoxysilane, ethyltrimethoxysilane, methyltrimethoxyethoxysilane, yinyltrimetoxysilane, vinyltriethoxysilane, phenyltrimethoxysilane, γ-glycidoxypropylmethyldiethoxysilane, γ-glycidoxypropyltrimethoxysilane, γ-aminopropyltriethoxysilane, γ-aminopropyltriethoxysilane, γ-aminopropylmethyldimethoxysilane, N-β(aminoethyl)-γ-aminopropyltriethoxysilane, (tridecafluoro-1,1,2,2-tetrahydrooctyl) triethoxysilane, (3,3,3-trifluoro-propyl) trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane; bifunctional alkoxysilanes (g=2), such as dimethyldimethoxysilane, diphenyldimethoxysilane and methylphenyldimethoxysilane; monofunctional alkoxysilanes (g=1), such as trimethylmethoxysilane, and the like. In order to raise the film strength, trifunctional and tetrafunctional alkoxysilanes are preferable, and in order to raise flexibility and film forming ability, monofunctional and difunctional alkoxysilanes are preferable.

Silicon system hard coat agent mainly produced from these coupling agents may also be used. Commercial hard coat agents, such as KP-85, X-40-9740, X-40-2239 (Trade Names, made by Shin Etsu Silicones) and AY42-440, AY42-441, AY49-208 (Trade Names, made by Dow Corning Toray Silicone Co., Ltd.), and the like may be used.

It is also preferable to use a compound which has two or more silicon atoms represented by the following Formula (V), in order to raise the strength of the protective layer 7.

$$B—(Si(R^{40})_{(3-a)}Q_a)_2 \quad (V)$$

In Formula (V), B represents a divalent organic group; $R^{40}$ represents a hydrogen atom, an alkyl group, or a substituted or unsubstituted aryl group; Q represents a hydrolyzable group; and a represents an integer of 1 to 3.

Specifically, the following compounds (V-1) to (V-16) may be given as preferable examples of the compounds represented by the above Formula (V).

V-1 $(MeO)_3Si—(CH_2)_2—Si(OMe)_3$

V-2 $(MeO)_2MeSi—(CH_2)_2—SiMe(OMe)_2$

V-3 $(MeO)_2MeSi—(CH_2)_6—SiMe(OMe)_2$

V-4 $(MeO)_3Si—(CH_2)_6—Si(OMe)_3$

V-5 $(EtO)_3Si—(CH_2)_6—Si(OEt)_3$

V-6 $(MeO)_2MeSi—(CH_2)_{10}—SiMe(OMe)_2$

V-7 $(MeO)_3Si—(CH_2)_3—NH—(CH_2)_3—Si(OMe)_3$

V-8 $(MeO)_3Si—(CH_2)_3—NH—(CH_2)_2—NH—(CH_2)_3—Si(OMe)_3$

V-9

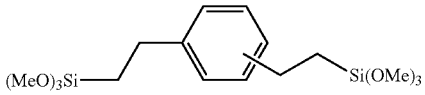

V-10

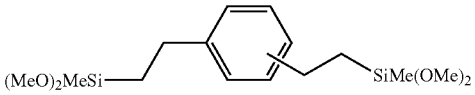

V-11

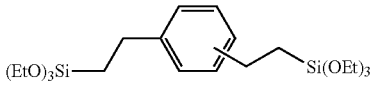

V-12

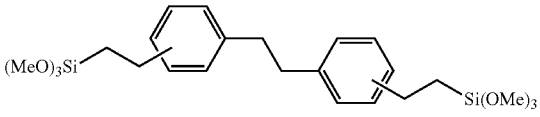

V-13

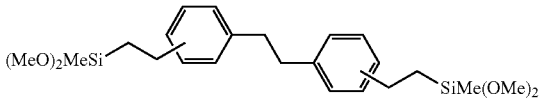

V-14

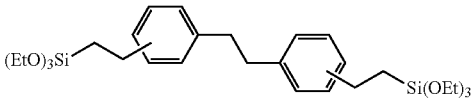

V-15 $(MeO)_3SiC_3H_6—O—CH_2CH(—O—C_3H_6Si(OMe)_3)—CH_2(—O—C_3H_6Si(OMe)_3)$

V-16 $(MeO)_3SiC_2H_4—SiMe_2—O—SiMe_2—O—SiMe_2—C_2H_4Si(OMe)_3$

It is preferable to include at least one cyclic compound which has a repeating structural unit represented by the following Formula (VI), or a derivative thereof, in the protective layer 7 in order to extend pot-life, control film characteristics, and reduce torque.

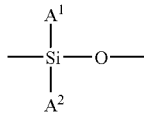

(VI)

In the above Formula (VI), $A^1$ and $A^2$ each independently represents a monovalent organic group. Commercial cyclic siloxanes may be given as examples of the cyclic compound with a repeating structural unit represented by the above Formula (VI). Specific examples that may be given are cyclic dimethylcyclosiloxanes, such as hexamethylcyclotrisiloxane, octamethylcyclotetrasiloxane, decamethylcyclopentasiloxane and dodecamethylcyclohexasiloxane; cyclic methylphenylcyclosiloxanes, such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane; phenylcyclosiloxanes, such as hexaphenylcyclotrisiloxane; cyclic fluorine containing cyclosiloxanes, such as 3-(3,3,3-trifluoropropyl) methylcyclotrisiloxane; methylhydrosiloxane mixtures; hydrosilyl group containing cyclosiloxanes, such as pentamethylcyclopentasiloxane and phenylhydrocyclosiloxane; vinyl group containing cyclosiloxanes, such as pentavinylpentamethylcyclopentasiloxane; and the like. These cyclic siloxane compounds may uses singly, but combinations of two or more sorts may also be used.

Conductive particles may be added to the protective layer 7 in order to lower the residual potential. Examples that may be given of such conductive particles include metals, metal oxides, carbon black, and the like. Among these metals or metal oxides are more preferable. Examples that may be given of such metals include aluminum, zinc, copper, chromium, nickel, silver, and stainless steel, and examples of the conductive particles also include plastic particles with these metals vapor-deposited of on their surfaces. Examples that may be given of metal oxides include zinc oxide, titanium oxide, tin oxide, antimony oxide, indium oxide, bismuth oxide, indium oxide doped with tin, tin oxide doped with antimony and tantalum, zirconium oxide doped with antimony, and the like. These may also be used singly or in combinations of two or more thereof. When using combinations of two or more, these combinations may be in the form of simple mixes thereof, solid solutions thereof, or fusions thereof. The average particle size of the conductive particles are preferably less than about 0.3 μm, and particularly preferably less than about 0.1 μm, from the viewpoint of the transparency of the protective layer 7.

Various particles may be added to the protective layer 7 in order to improve the resistance to contaminants adhering to the surface of an electrophotographic photoreceptor, the lubricating ability, the hardness, and the like. These may be used singly or in combinations thereof. Examples of such particles that may be given include particles containing silicon. Particles containing silicon are particles which contain silicon as a structural element thereof, and specific examples that may be given are colloidal silica, silicone particles, and the like. Generally commercially available colloidal silica may be used as particles containing silicon, and examples that may be given are colloidal silica particles with a mean particle size from about 1 nm to about 100 nm, preferably from about 10 nm to about 30 nm, dispersed in an acidic or alkaline aqueous dispersion, or in an organic solvent, such as an alcohol, ketone, or ester. Although the solid content of colloidal silica in the outermost surface layer is not particularly limited, when considering the film forming ability, the electrical properties, and the strength of the surface of the protective layer 7, colloidal silica used in the range of from about 0.1 weight % to about 50 weight % of total solids is suitable, and in the range of from about 0.1 weight % to about 30 weight % is preferable.

For silicone particles used as particles containing silicon generally commercially available silicone particles may be used, selected from spherical silicone resin particles, silicone rubber particles, or silicone surface treatment silica particles, with a mean particle size from about 1 nm to about 500 nm, preferably from about 10 nm to about 100 nm. Silicone particles are chemically inert and are small size particles which have excellent dispersibility in resins, and further, since the content thereof that is required in order to obtain sufficient characteristics is low, the surface state of an electrophotographic photoreceptor may be improved without impeding any cross-linking reaction. That is, in a state in which such particles are uniformly incorporated into a strong cross-linked structure, the lubricating ability of the surface of an electrophotographic photoreceptor and the water repellence thereof may be increased, and good abrasion resistance and resistance to contaminant adherence may be maintained over a long period of time. The content of the silicone particles in the protective layer 7 of an electrophotographic photoreceptor may be the range of the from about 0.1 weight % to about 30 weight % in the total solids of the protective layer 7, and is preferably in the range of from about 0.5 weight % to about 10 weight %.

Examples that may be given of other particles include: fluorine based particles, such as tetrafluoroethylene, trifluoroethylene, hexafluoroethylene, vinyl fluoride and vinylidene fluoride; particles which consist of a resin that is one of the above fluororesins with which copolymerization of a monomer which has a hydroxyl group has been carried out, like those described in "Eighth Polymer Material Forum, Lecture Paper Compilation p89"; and metal oxides with semi-conducting characteristics, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO, and MgO.

Oils, such as silicone oils, may be added to the protective layer 7 for the same purpose. Examples that may be given of silicone oils include, for example: silicone oils, such as dimethylpolysiloxane, diphenylpolysiloxane, and phenylmethylsiloxane; and reactive silicone oils, such as, amino modified polysiloxane, epoxy modified polysiloxane, carboxyl modified polysiloxane, and carbinol modified polysiloxane, methacrylic modified polysiloxane, mercapto modified polysiloxane, and phenol modified polysiloxane; and the like. Such oils may be added to the composition for forming the protective layer 7 in advance, or, after producing a photoreceptor, impregnation treatment of these oils may be carried out under reduced pressure or under pressurization and the like.

Various additives may be added to the protective layer 7, such as plasticizers, surface modifiers, antioxidants, and photodegradation inhibitors. Examples that may be given of plasticizers include, for example: biphenyls, chlorinated biphenyls, terphenyl, dibutylphthalate, diethylene glycol phthalate, dioctyl phthalate, triphenylphosphate, methylnaphthalene, benzophenone, chlorinated paraffins, polypropylenes, polystyrenes, various fluorohydrocarbons, and the like. Antioxidants which have a hindered phenol, a hindered amine, a thioether, or a phosphite in their partial structures may be added to the protective layer 7, and these are effective for improving the stability of the electric potential and improving image quality when there are variations in environmental conditions.

The following compounds may be given as examples of antioxidants. Hindered phenol antioxidants, for example: "Sumilizer BHT-R", "Sumilizer MDP-S", "Sumilizer BBM-S", "Sumilizer WX-R", "Sumilizer NW", "SUMILIZER BP-76", "SUMILIZER BP-101", "Sumilizer GA-80", "Sumilizer GM", "Sumilizer GS", (Trade Names, made by Sumitomo Chemical Co., Ltd.); "IRGANOX1010", "IRGANOX1035", "IRGANOX1076", "IRGANOX1098", "IRGANOX1135", "IRGANOX1141", "IRGANOX1222", "IRGANOX1330", "IRGANOX1425WL", "IRGANOX1520L", "IRGANOX245", "IRGANOX259", "IRGANOX3114", "IRGANOX3790", "IRGANOX5057", and "IRGANOX565" (Trade Names, made by Ciba Specialty Chemicals); and "ADK STAB AO-20", "ADK STAB AO-30", "ADK STAB AO-40", "ADK STAB AO-50", "ADK STAB AO-60", "ADK STAB AO-70", "ADK STAB AO-80", "ADK STAB AO-330" (Trade Names, made by ADEKA Corporation). Hindered amine based antioxidants, for example: "SANOL LS 2626", "SANOL LS 765", "SANOL LS 770", "SANOL LS 744" (Trade Names, made by Sankyo Lifetech Co., Ltd.), "TINUVIN 144", "TINUVIN 622LD" (Trade Name, made by Ciba Specialty Chemicals); "MARK LA57", "MARK LA67", "MARK LA62", "MARK LA68", "MARK LA63" (Trade Names, made by ADEKA Corporation); and "SUMILIZER TPS" (Trade Name, made by Sumitomo Chemical Co., Ltd.). Thioether series antioxidants, for example "SUMILIZER TP-D" (Trade Name, made by Sumitomo Chemical Co., Ltd.), and phosphite based antioxidants, for example "MARK 2112", "MARK PEP.8", "MARK PEP.24G", "MARK PEP.36", "MARK 329K", AND "MARK HP.10" (Trade Names, made by ADEKA Corporation). Hindered phenol and hindered amine based antioxidant are especially preferable. Furthermore, for example, by modifying substituents, such as alkoxy silyl groups, these may be made into materials for forming cross-linking films, or made cross-link reactable.

The protective layer 7 described above may be formed by coating a protective layer forming coating liquid, containing the above described components mentioned above, onto a lower layer (in the present exemplary embodiment this is the charge transport layer 6), and then curing it, by as required, for example, heating or using an acid or the like to cause polymerization or cross-linking.

An organic solvent may, as required, be included in the protective layer forming coating liquid for forming the protective layer 7. Examples that may be given of such an organic solvent include various solvents, such as: alcohols, such as methanol, ethanol, propanol, and butanol; ketones, such as acetone and methyl ethyl ketone; tetrahydrofuran; ethers, such as diethylether, and dioxane; and the like. It should be noted that in order to be applied by a dip coating method that is generally used to produce electrophotographic photoreceptors, it is preferable to use alcohols, ketones, or mixed solvents thereof, and it is preferable for the boiling point of the solvent to be from about 50° C. to about 150° C. The above solvents may be used by mixing as desired. Although the amount of solvent used may be selected, however, since if the amount of solvent is too small then the compound represented by the above Formula (I) may precipitate out, undertake solid-liquid separation, and so obtaining the desired film thickness may become difficult, it is preferable that the amount of solvent is from about 0.5 parts by weight to about 30 parts by weight relative to one parts by weight of the total solid content contained in the protective layer forming coating liquid for forming the protective layer 7, and more preferably from about 1 part by weight to about 20 parts by weight.

It is preferable to use a curing catalyst in order to cure the compound represented by above Formula (I) and any cross-linking resin contained in the protective layer forming coating liquid for forming the protective layer 7. The mechanism of curing of the compound represented by above Formula (I) is not completely clear, however, by heating a composition containing the compound represented by above Formula (I) and an acidic compound, a cross-linking reaction of the above compound may be promoted, and a cured layer (the protective layer 7) with excellent electrical properties and mechanical strength may be formed. When doing so, a finer cross-linking structure may be formed by using together with a cross-linking resin (for example, a phenol resin or the like), and a cured layer with particularly excellent mechanical strength may be formed.

Although the curing temperature set as desired, preferably it is from about room temperature (for example, 24° C.) to about 200° C., with about 100° C. to about 150° C. more preferable.

An acid catalyst, or neutralized substance therefrom, is preferable as a curing catalyst. By the function exhibited by such an acid catalyst, or neutralized substance therefrom, as a curing catalyst to a cross-linking resin (for example, phenol resin), a curing reaction may be promoted with the cross-linking resin, with any charge-transporting agent, or with both, further improving the mechanical strength of the functional layer (the protective layer in the present exemplary embodiment). Furthermore, an acid catalyst, or neutralized substance therefrom, also exhibits an excellent function as a dopant to a substance with charge-transporting properties, and further raises the electrical properties of the obtained functional layer (the present exemplary embodiment protective layer).

Examples that may be given of such an acid catalyst include: Lewis acids, such as aluminum chloride, iron chloride, and zinc chloride; hydrochloric acid; sulfuric acid; phosphoric acid; organic acids, such as acetic acid, phenol, benzoic acid, toluenesulfonic acid, phenolsulfonic acid, methanesulfonic acid, and trifluoroacetic acid; and the like. However, the acid catalyst is not limited to these. Among these, phenol and sulfonic acid are preferable, from the viewpoint of film forming characteristics and electrical properties.

Although the amount of a curing catalyst (an acid catalyst or neutralized substance therefrom) may be set as desired within the range from about 0.0001 parts by weight to about 300 parts by weight relative to 100 parts by weight of the compound represented by the Formula (I), it is preferably from about 0.001 parts by weight to about 150 parts by weight.

Other curing catalysts which may be used other than the above acidic compounds, and examples that may be given of other curing catalysts include: bissulfonyldiazomethanes such as bis(isopropylsulfonyl) diazomethane; bissulfonylmethanes, such as methylsulfonyl p-toluene sulfonylmethane; sulfonylcarbonyl diazomethanes, such as cyclohexylsulfonylcyclohexyl carbonyldiazomethane; sulfonylcarbonyl alkanes, such as 2-methyl-2-(4-methylphenylsulfonyl) propiophenone; nitrobenzyl sulfonates, such as 2-nitrobenzyl p-toluenesulfonate; alkyl and aryl sulfonates, such as pyrogallol tris(methanesulfonate); benzoin sulfonates, such as benzoin tosylate; N-sulfonyloxyimides, such as N-(trifluoromethylsulfonyloxy) phthalimide; pyridones, such as (4-fluoro-benzenesulfonyloxy)-3,4,6-trimethyl-2-pyridone; sulfonate esters, such as 2,2,2-trifluoro-1-trifluoromethyl-1-(3-vinylphenyl)-ethyl 4-chlorobenzenesulfonate; photo-acid generating agents, such as onium salts like triphenylsulfonium methanesulfonate and diphenyliodonium trifluoromethane sulfonate; compounds that are a neutralized protonic acid or a Lewis acid by a Lewis base; a mixture of a Lewis acid and trialkyl phosphate; sulfonate esters; phosphate esters; onium compounds; anhydrous carboxylic acid compounds, and the like.

Examples that may be given compounds which are neutralized protonic acids or Lewis acids by a Lewis base include: compounds of halogen carboxylic acids, sulfonic acids, sulfuric acid monoesters, monoester or diester phosphates, polyphosphate esters, monoester or diester borates, neutralized by ammonia, or by various amines such as monoethyl amine, triethylamine, pyridine, piperidine, aniline, morpholine, cyclohexylamine, n-butylamine, monoethanolamine, diethanolamine and triethanolamine, or by trialkylphosphines, triarylphosphine, trialkylphosphite, or triaryl phosphate; and further include NACURE 2500X, 4167, X-47-110, 3525, and 5225 (Trade Names, made by King Industries Co., Ltd.) marketed as acid-base blocked catalysts, and the like. Examples that may be given of compounds which are neutralized Lewis acids by a Lewis base include compounds of a Lewis acid, such as $BF_3$, $FeCl_3$, $SnCl_4$, $AlCl_3$, and $ZnCl_2$, neutralized by one of the above Lewis bases.

Examples that may be given of onium compounds include triphenylsulfonium methanesulfonate, diphenyliodonium trifluoromethane sulfonate, and the like. Examples that may be given of anhydrous carboxylic acid compounds include: acetic anhydride, propionic anhydride, butyric anhydride, isobutyric anhydride, lauric anhydride, oleic anhydride, stearic anhydride, n-caproic anhydride, n-caprylic anhydride, n-capric anhydride, palmitic anhydride, myristic anhydride, trichloroacetic anhydride, dichloroacetic anhydride, a monochloroacetic anhydride, trifluoroacetic anhydride, heptafluoro butanoic anhydride, and the like.

Examples that may be given of Lewis acids include: metal halides, such as boron trifluoride, aluminum trichloride, titanium (I) chloride, titanium (II) chloride, iron (II) chloride, iron (III) chloride, zinc chloride, zinc bromide, tin (I) chloride, tin (II) chloride, tin (I) bromide, and tin (II) bromide; organometallic compounds, such as trialkyl boron, trialkylaluminum, dialkyl aluminum halide, monoalkyl aluminum halide and tetraalkyltin; metal chelate compounds, such as diisopropoxy aluminum ethylacetoacetate, tris (ethylacetoacetate) aluminum, tris(acetylacetonate) aluminum, diisopropoxy bis(ethylacetoacetate) titanium, diisopropoxy bis (acetylacetonate) titanium, tetrakis (n-propylacetoacetate) zirconium, tetrakis(acetylacetonate) zirconium, tetrakis (ethylacetoacetate) zirconium, dibutylbis(acetylacetonate) tin, tris(acetylacetonate) iron, tris (acetylacetonate) rhodium, bis(acetylacetonate) zinc, and tris(acetylacetonate) cobalt; metallic soaps, such as dibutyltin dilaurate, dioctyl tin ester malate, magnesium naphthenate, calcium naphthenate, manganese naphthenate, iron naphthenate, cobalt naphthenate, copper naphthenate, zinc naphthenate, zirconium naphthenate, lead naphthenate, calcium octylate, manganese octylate, iron octylate, cobalt octylate, zinc octylate, zirconium octylate, tin octylate, lead octylate, zinc laurate, magnesium stearate, aluminum stearate, calcium stearate, cobalt stearate, zinc stearate, and lead stearate. These may be used singly or in combinations of two or more.

Although the amount of these other curing catalysts used is not particularly limited, it is preferable that it is from about 0.1 parts by weight to about 20 parts by weight relative to 100 parts by weight of the total solid content contained in the protective layer coating liquid, and it is particularly preferable that it is from about 0.3 parts by weight to about 10 parts by weight.

When coating the protective layer coating liquid for forming the protective layer 7 onto the charge transport layer 6, as a coating method, the ordinary methods may be used, such as a blade coating method, a Mayer bar coating method, a spray coating method, a dip coating method, a bead coating method, an air knife coating method, and a curtain coating method. The protective layer 7 is formed by drying the coating film after coating.

When coating, if the required film thickness is not obtainable by a single coating, the required film thickness may be obtained by carrying out coating multiple times. When performing coating multiple times, heat-treatment may be carried out with each coating, or carried out after coating multiple times.

When cross-linking the above protective layer coating liquid and forming the protective layer 7, the curing temperature is preferably from about 100° C. thing to about 170° C., and more preferably from about 100° C. to about 160° C. Furthermore, the duration of curing is preferably about 30 minutes to about 2 hours, and more preferably about 30 minutes to about 1 hour, and the heating temperature may be changed in stages.

Deterioration of the electrical properties may be prevented by carrying out such a cross-linking reaction in an inert-to-oxidation gas atmosphere, such as an atmosphere of nitrogen, helium, argon, or the like. When performing the cross-linking reaction in an inert gas atmosphere, the curing temperature can be higher than when in an air atmosphere, and the curing temperature in such a case is preferably from about 110° C. to about 180° C., and more preferably from about 100° C. to about 160° C. The duration of curing is preferably about 30 minutes to about 2 hours, and more preferably from about 30 minutes to about 1 hour.

The film thickness of the protective layer 7 is preferably from about 0.5 μm to about 15 μm, with from about 1 μm to about 10 μm being more preferable, and from about 1 μm to about 7 μm is still more preferable.

Additives, such as antioxidants, light stabilizers, and/or thermostabilizers, may be added to one or more of the layers in the above described photosensitive layer 3 (the undercoating layer 4, the charge generating layer 5, the charge transport layer 6, and the protective layer 7) in order to prevent deterioration of the photoreceptor, due to ozone and oxidizing gases emitted in an image-forming apparatus, or light or heat. These additives may be added to one or more of the layers that configure the photosensitive layer 3.

Examples that may be given of such antioxidants include, for example: hindered phenols, hindered amines, paraphenylenediamines, arylalkanes, hydroquinones, spirochroman, spiroindanone, and derivatives thereof, organosulfur compounds, organophosphorus compounds, and the like.

Examples that may be given of such light stabilizers include, for example, derivatives of benzophenone, benzotriazol, dithiocarbamate, tetramethylpiperidine and the like.

Also, one or more electron accepting substance may be included in one or more layer of the photosensitive layer 3 (the undercoating layer 4, the charge generating layer 5, the charge transport layer 6 and the protective layer 7), in order to improve sensitivity, reduce the residual potential, and reduce fatigue with repeated use, and the like. Examples that may be given of such electron acceptor substance include, for example: succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitro anthraquinone, trinitrofluorenone, picric acid, o-nitrobenzoic acid, p-nitrobenzoic acid, phthalic acid, and the like. Benzene derivatives which have electron withdrawing substituents, such as a fluorenone system, a quinone system, Cl, CN, or $NO_2$, are particularly preferable.

Figure 2:
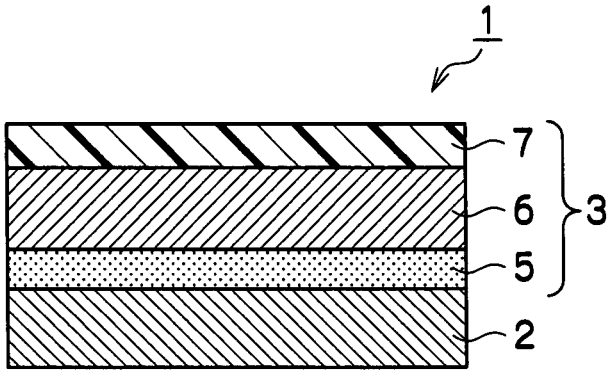
FIG. 2 is a schematic cross-section showing an electrophotographic photoreceptor according to another exemplary embodiment.
Figure 3:
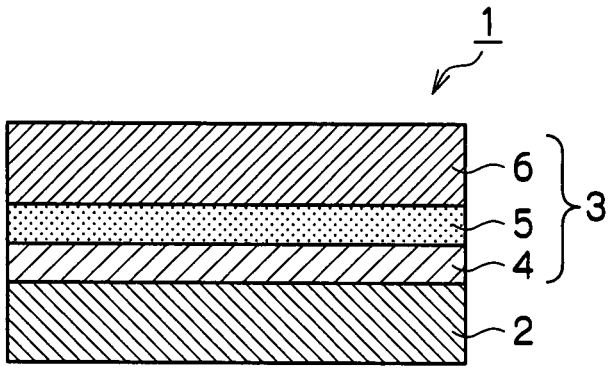
FIG. 3 is a schematic cross-section showing an electrophotographic photoreceptor according to another exemplary embodiment.
Figure 4:
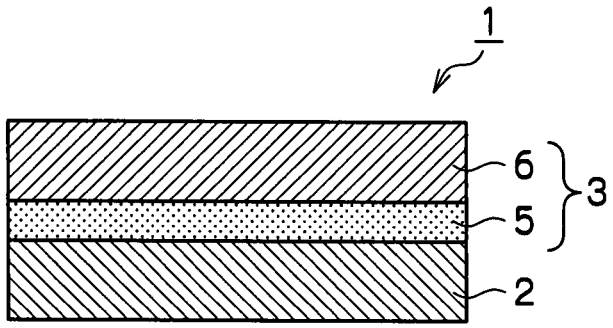
FIG. 4 is a schematic cross-section showing an electrophotographic photoreceptor according to another exemplary embodiment.

Explanation has been given above of a suitable example of the electrophotographic photoreceptor according to the present exemplary embodiment, however, the invention is not limited thereto. For example, the electrophotographic photoreceptor 1 according to the present exemplary embodiment as shown in FIG. 1 has a structure where the undercoating layer 4, the charge generating layer 5, the charge transport layer 6, and the protective layer 7 stacked in that order on the conductive substrate 2, however, as shown in FIG. 2, the electrophotographic photoreceptor 1 according to the present exemplary embodiment does not need to have an undercoating layer, like the electrophotographic photoreceptor 1 as shown in FIG. 2. Furthermore, the electrophotographic photoreceptor 1 according to the present exemplary embodiment does not need to have a protective layer, as shown in FIG. 3, and it does not need to have either an undercoating layer or a protective layer, as shown in FIG. 4. In the electrophotographic photoreceptor according to the present exemplary embodiment as shown in FIG. 1 to FIG. 4, the sequence of disposing the charge generating layer 5 and the charge transport layer 6 may be reversed, and either the charge generating layer 5 or the charge transport layer 6 may be the upper of the two layers.

In the electrophotographic photoreceptor 1 according to the present exemplary embodiment, when it does not have a protective layer, as shown in FIG. 3 and FIG. 4, the charge transport layer 6 may be configured with the composition (or the cured material) containing the compound represented by above Formula (I), this then being the first functional layer. In such a case, the compound represented by above Formula (I) may be used on its own as the charge transporting material used for the charge transport layer 6, however, it may be used in combination with the charge transporting materials mentioned above in the description of the charge transport layer 6. Furthermore, in order to control the film strength, the film forming properties, and the electrical properties, selected thermosetting resins or thermoplastics may be mixed therewith.

In the electrophotographic photoreceptor 1 according to the present exemplary embodiment, any one of the layers which configure the photosensitive layer 3 may be the first functional layer configured with the composition (or the cured material) which includes the compound represented by above Formula (I), and as shown in FIG. 1 and FIG. 2, it may be the protective layer 7 is the first functional layer, or instead of the protective layer 7, for example, the charge transport layer 6 may be the first functional layer. Furthermore, two or more layers among the layers which configure the photosensitive layer 3 may be the first functional layer, for example, both the protective layer 7 and the charge transport layer 6 may be the first functional layer.

Figure 5:
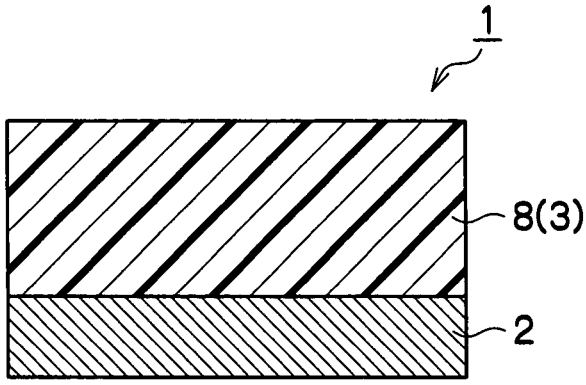
FIG. 5 is a schematic cross-section showing an electrophotographic photoreceptor according to another exemplary embodiment.

Also, the electrophotographic photoreceptor 1 according to the present exemplary embodiment may be configured with what is called a monolayer type photoreceptor layer 8 (photosensitive layer 6) disposed onto the conductive base 3, as shown in FIG. 5. This monolayer type photoreceptor layer 8 is configured to include the charge generating material and binder resin, and this monolayer type photoreceptor layer 8 becomes the first functional layer configured with the composition (or that cured material) including the compound represented by above Formula (I). In such a case, as the charge generating material, the same materials may be used as in the charge generating layer 5 in the photosensitive layer 3 of function separated type, and as the binder resin the same materials may be used as for the charge generating layer 5 and the charge transport layer 6 in the function separated type photosensitive layer 3. The content of the charge generating material in the monolayer type photoreceptor layer 8 is preferably from about 10 weight % to about 85 weight % relative to the total amount of solids in the monolayer type photoreceptor layer 8, and from about 20 weight % to about 50 weight % is more preferable.

Furthermore, in the monolayer type photoreceptor layer 8, charge transporting materials and polymer charge transporting materials may be added for the purpose of improving photoelectrical characteristics. The addition amount thereof is preferably from about 5 weight % to about 50 weight % relative to the total amount of solids in the monolayer type photoreceptor layer 8. The solvent used for coating and the coating method may be the same as those for each of the above layers. The film thickness of the monolayer type photoreceptor layer 8 is preferable from about 5 μm to about 50 μm, and still more preferably from about 10 μm to about 40 μm.

It is thought that oxidation deterioration products, which cause the problem of adhering to the surface of a long lasting photoreceptor, are caused, for example, by $NO_x$ and ozone gases permeating into the photosensitive layer, and chemical deterioration of part of the photosensitive layer occurring. Therefore, the harder it is for gas to penetrate the outermost surface layer, that is to say, the lower the oxygen permeability coefficient thereof, the less readily oxidation deterioration products occur, which is advantageous to high image quality and the life span of the photoreceptor. On the other hand, if oxidation deterioration products do arise, and they are in the state of being adhered to the electrophotographic photoreceptor outermost surface, then this will have a bad influence on image quality. Therefore, it is necessary to remove these oxidation deterioration products and the like by some method or other, such as a cleaning blade or a brush, however, in order to stabilize the functionality of a cleaning member over a long period of time, it is effective for the surface of the electrophotographic photoreceptor 1 according to the present exemplary embodiment to be imparted with a lubricant, such as a metallic soap, a higher alcohol, a wax, or a silicone oil.

(An Image-Forming Apparatus and Process Cartridge)

Figure 6:
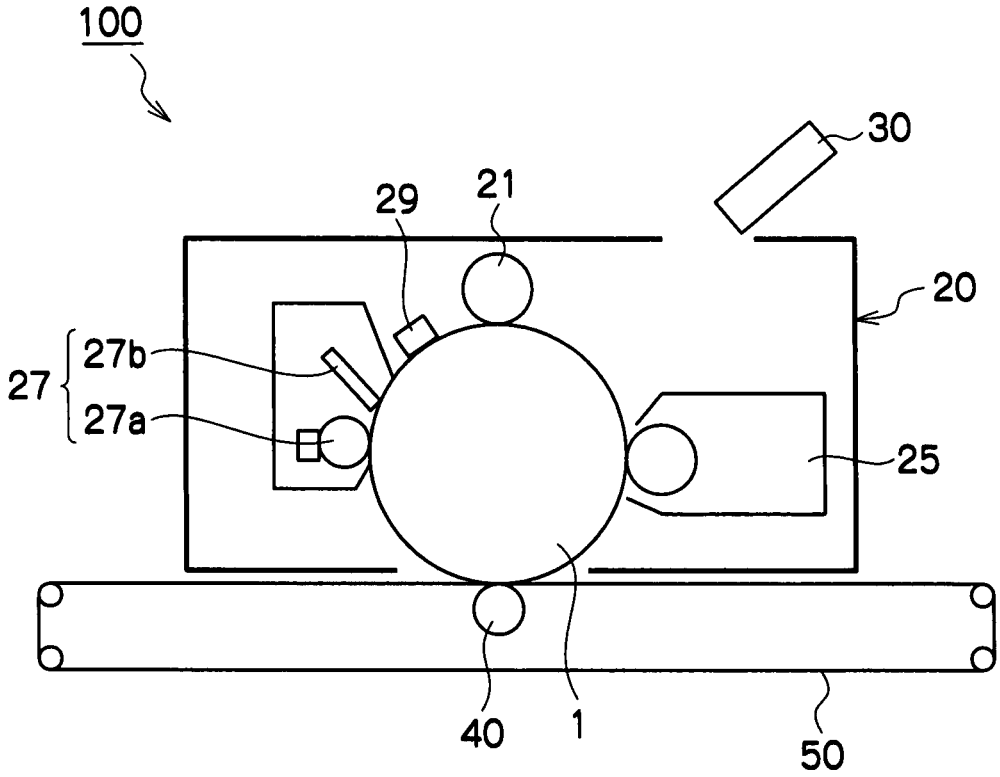
FIG. 6 is a schematic diagram showing an electrophotographic photoreceptor according to an exemplary embodiment.

FIG. 6 is a schematic diagram showing an image-forming apparatus according to an exemplary embodiment. In an image-forming apparatus 100, as shown in FIG. 6, an image-forming device body (not shown) is provided with a process cartridge 20 equipped with the electrophotographic photoreceptor 1 according to one of the above present exemplary embodiments, a light exposure device 30, a transfer device 40, and an intermediate transfer body 50. In the image-forming apparatus 100, the light exposure device 30 is arranged in the position which the electrophotographic photoreceptor 1 can be exposed through the opening of the process cartridge 20. The transfer device 40 is arranged in a position which opposes the electrophotographic photoreceptor 1 via the intermediate transfer body 50, and the intermediate transfer body 50 is arranged so that at least a portion thereof contacts the electrophotographic photoreceptor 1.

The process cartridge 20 combines and integrates together in a case the electrophotographic photoreceptor 1 with a charging device 21, a developing device 25, a cleaning device 27, and a fiberous shaped member (the shape of a flat brush) 29 with an mounting rail. An opening for exposure is provided in the case.

Here, the charging device 21 charges the electronic copy photoreceptor 1 using a contact method. The developing device 25 develops an electrostatic latent image on the electrophotographic photoreceptor 1, and forms a toner image.

The toner used in the developing device 25 will now be explained. It is preferable for the average shape coefficient ($(ML^2/A)\times(\pi/4)\times100$, wherein ML represents the maximum length of particles, and A represents the projected area of the particles) of such a toner to be from about 100 to about 150, and it is more preferable that it is from about 100 to about 140. It is preferable for the volume average particle size of the toner to be from about 2 μm to about 12 μm, it is more preferable that it is from about 3 μm to about 12 μm, and it is still more preferable that it is from about 3 μm to about 9 μm. By using a toner which satisfies the above average shape coefficient and volume average particle size ranges, high development, transfer properties, and images of high quality may be obtained compared with other toners.

There are no particular limitations to the manufacturing method for the toner as long as the toner is within a range that satisfies the above average shape coefficient and volume average particle size ranges, and toners manufactured by the following methods, for example, may be used: a kneading grinding method of adding together a binder resin, a colorant and a release agent, and as required a charge control agent, and the like, kneading, grinding and classifying; a method by which particles obtained by a kneading grinding method are changed in shape by mechanical impact force or thermal energy; an emulsion-polymerization aggregation method in which a monomer of a binder resin is emulsion polymerized, and the dispersion liquid formed is mixed with a dispersion liquid of a colorant and a release agent, and as required a charge control agent and the like, aggregated, heat fused, and toner particles obtained; a suspension polymerization method in which a monomer for obtaining a binder resin is suspended in an aqueous medium of a liquid of a colorant and a release agent, and as required a charge control agent or the like, and polymerized; a dissolution suspension method in which particles are formed by suspending a binder resin and a liquid of a colorant and a release agent, and as required a charge control agent and the like, in an aqueous medium.

A toner obtained with one of the above described methods may be used as a core, and well known methods used, such as a manufacturing method in which aggregate particles are adhered thereto, and heat fusion carried out, so as to give a core/shell structure. From the viewpoint of shape control and particle size distribution control, manufacturing through an aqueous solvent is preferable as the manufacturing method of the toner, such as in the suspension polymerization method, the emulsion-polymerization aggregation method, and the dissolution suspension method, with the emulsion-polymerization aggregation method being particularly preferable.

Toner mother particles may be configured to include a binder resin, a colorant, and a release agent, and if required, silica and a charge control agent.

Examples that may be given of binder resins which may be used for the toner mother particles include homopolymers and copolymers of: styrenes, such as styrene and chlorostyrene; monoolefins, such as ethylene, propylene, butylene and isoprene; vinyl esters, such as vinyl acetate, vinyl propionate, vinyl benzoate and vinyl butyrate; α-methylene aliphatic monocarboxylic acid esters, such as methyl acrylate, ethyl acrylate, butyl acrylate, dodecyl acrylate, octyl acrylate, phenyl acrylates, methyl methacrylate, ethyl methacrylate, butyl methacrylate, dodecyl methacrylate; vinyl ethers, such as vinylmethyl ether, vinylethyl ether, and vinylbutyl ether; vinyl ketones, such as vinyl methyl ketone, vinyl hexyl ketone, and vinyl isopropenyl ketone; and polyester resins by copolymerization of a dicarboxylic acid with a diol.

Examples that may be given of particularly typical binder resins include: polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, polyester resins, and the like. In addition there are: polyurethanes, epoxy resins, silicone resins, polyamides, modified rosin, paraffin waxes, and the like.

Examples that may be given of typical colorants include: magnetic powders, such as magnetite and ferrite, carbon black; aniline blue, chalco oil blue, chrome yellow, ultra marine blue, DuPont oil red, quinoline yellow, methylene blue chloride, phthalocyanine blue, malachite green oxalate, lamp black, rose bengal, C. I. pigment red 48:1, C.I. pigment red 122, C.I. pigment red 57:1, C.I. pigment yellow 97, C.I. pigment yellow 17, C.I. pigment blue 15:1, C.I. pigment blue 15:3, and the like.

Examples that may be given of typical release agents include: low-molecular polyethylene, low-molecular polypropylene, Fischer-Tropsch Wax, montan wax, carnauba wax, rice wax, candelilla wax, and the like.

Well known charge control agents may be used, and azo metal complex compounds, metal complex compounds of salicylic acid, and resin type charge control agents containing a polar group may be used. When manufacturing toner by a wet process, it is preferable to use materials which do not readily dissolve in water so to control the ionic strength and so as to reduce waste water contamination. Also, both magnetic toners that include magnetic material, and nonmagnetic toners that do not include magnetic material, may be used.

Toners used for the developing device 25 may be manufactured by mixing the above toner mother particles and the above external additives with a Henschel mixer or V blender. When manufacturing toner mother particles by a wet process, additives may also be added in the wet process.

Lubrication particles may be added to the toner used for the developing device 25. Examples that may be given of lubrication particles include: solid lubricants, such as graphite, molybdenum disulfide, talc, fatty acids, and fatty acid metal salts; low molecular weight polyolefines, such as polypropylene, polyethylene, polybutene; silicones which have a softening temperature with heating; aliphatic amides such as oleic amides, amide erucates, ricinoleic acid amide, stearic acid amide; vegetable waxes, such as carnauba wax, rice wax, candelilla wax, Japan wax, jojoba oil; animal waxes, such as bees wax; mineral waxes, such as montan wax, ozokerite, ceresin, paraffin wax, microcrystalline wax, Fischer Tropsch wax; and modified products thereof. These may be used singly or in combinations of two or more. The volume average particle diameter thereof is preferably from about 0.1 μm to about 10 μm, and substances of the above chemical constitutions may be may ground to adjust the particle size thereof. The amount of additives to toner is preferably from about 0.05 weight % to about 2.0 weight %, and the range from about 0.1 weight % to about 1.5 weight % is more preferable.

Inorganic particles, organic particles, composite particles, made from inorganic particles with organic particles adhered thereto, may be added to the toner used for the developing device 25 in order to remove adhered matter and deteriorated matter on the surface of an electrophotographic photoreceptor.

Examples that may be given of suitably used inorganic particles include various inorganic oxides, carbides, nitrides, borides, and the like, such as: silica, alumina, titania, zirconia, barium titanate, aluminum titanate, strontium titanate, magnesium titanate, zinc oxide, chrome oxide, cerium oxide, antimony oxide, tungsten oxide, tin oxide, tellurium oxide, manganese oxide, boron oxide; silicon carbide, boron carbide, titanium carbide, silicon nitride, titanium nitride, and boron nitride.

The above inorganic particles may be processed with: titanium coupling agents, such as tetrabutyl titanate, tetraoctyl titanate, isopropyltriisostearoyl titanate, isopropyltridecylbenzenesulfonyl titanate, bis(dioctylpyrophosphate)oxyacetate titanate; and silane coupling agents, such as γ-(2-aminoethyl) aminopropyl trimethoxysilane, γ-(2-aminoethyl) aminopropylmethyldimethoxysilane, γ-methacryloxpropyltrimethoxysilane, N-β-(N-vinylbenzylaminoethyl) γ-aminopropyltriethoxysilane hydrochloride, hexamethyldisilazane, methyltrimetoxysilane, butyltrimethoxysilane, isobutyl trimethoxysilane, hexyltrimethoxysilane, octyl trimethoxysilane, decyltrimetoxysilane, dodecyltrimethoxysilane, phenyltrimethoxysilane, o-methylphenyltrimethoxysilane, and p-methylphenyltrimethoxysilane. Hydrophobing treatment may also be preferably carried out with higher fatty acid metal salts, such as silicone oils, aluminum stearate, zinc stearate, and calcium stearate.

Examples that may be given of organic particles include styrene resin particles, styrene-acrylic resin particles, polyester resin particles, urethane resin particles, and the like.

The particle size used is preferably from about 5 to about 1000 by volume average particle size, more preferably from about 5 to about 800 nm, and most preferably from about 5 nm to about 700 nm. When the volume average particle size is less than the above lower limits there is a tendency for there to be a lack of polishing capability therein, but on the other hand if volume average particle size is above the upper limits there is a tendency for scratches to be readily generated on the electrophotographic photoreceptor surface. It is preferable for the total addition amount of the above particles and lubrication particles to be about 0.6 weight % or more.

It is preferable that, for other inorganic oxides particles added to the toner, small inorganic oxide particles with a primary particle size of 40 nm or less are used for flowability, and charge control, and for larger diameter inorganic oxide particles to be added to reduce the adhesion force and for charge control. Well known inorganic oxide particles may be used, and in order to perform precise charge control it is preferable to use a combination of silica and titanium oxide together. By carrying out surface treatment to small size inorganic particles, dispersibility is increased and there is an increased particle flowability improving effect therefrom. It is preferable to also add carbonates, such as calcium carbonate and magnesium carbonate, and inorganic minerals, such as hydrotalcite, in order to remove substances generated by charge discharge.

A carrier may also be mixed in and used with an electrophotographic color toner, and as such a carrier surface iron powder, glass beads, ferrite powder, nickel powder, or a resin surface coated with these may be used. The mixing ratio of a carrier may be set according to the requirements.

The cleaning device 27 is provided with a fiberous shaped member (roll shaped) 27*a* and a cleaning blade (blade member) 27*b*.

The cleaning device 27 is provided with both the fiberous shaped member 27*a* and the cleaning blade 27*b*, however, one or other of the cleaning devices may be provided. As the fiberous shaped member 27*a*, besides a roll shape a toothbrush shape may also be used. The fiberous shaped member 27*a* may be fixed to the main part of the cleaning device, or may be supported so as to be pivotable, and furthermore may be supported so as to be able to oscillate in the photoreceptor axial direction. Examples that may be given of the fiberous shaped member 27*a* include a cloth-like construction consisting of ultrafine fibers, such as polyester, nylon, and acrylic, or TORAYSEE (Trade Name, made by Toray Industries, Inc.), or a brush-like construction with resin fibers such as nylon, acrylic, polyolefine, and polyester or the like inserted into a substrate or carpet. As the fiberous shaped member 27*a*, conductivity may be imparted thereto by blending a conductive powder or an ion conducting agent with the above substances, or by using fibers with a conductive layer formed inside or to the exterior of each fiber. When conductivity is imparted thereto, the resistance is preferably from about $10^2\Omega$ to about $10^9\Omega$. The thickness of the fibers for the fiberous shaped member 27*a* is preferably 20 d (denier) or less, more preferably 30 d or less, and the density of such fibers is preferably about 20,000 fibers/inch or above, and more preferably about 30,000 fibers/inch$^2$ or above.

It is desirable that the cleaning device 27 removes adhered matter on the surface of a photoreceptor (for example, substances generated by charge discharge) with a cleaning blade and/or a cleaning brush. In order to attain this purpose over a long period of time and to stabilize the functioning of the cleaning member, it is preferable to supply to the cleaning member lubricative substances (lubricating components), such as metallic soaps, higher alcohols, waxes, or silicone oils.

For example, when using a roll-shaped fiberous shaped member 27*a*, it is preferable to contact lubricative substances, such as a metallic soap or a wax, to the roll-shaped fiberous shaped member 27*a*, and thereby supply a lubrication component to the electrophotographic photoreceptor surface. Usually a rubber blade is used as the cleaning blade 27*b*. Thus, when using a rubber blade as the cleaning blade 27*b*, it is especially effective to supply a lubrication component to the electrophotographic photoreceptor surface in order to suppress defects of the blade and abrasion.

The process cartridge 20 explained above is made attachable and detachable to an image-forming device body, and configures an image-forming apparatus together with the image-forming device body.

Suitable as the light exposure device 30 is a device that is able to expose the charged electrophotographic photoreceptor 1, and form an electrostatic latent image. It is preferable to use a surface emission laser of a multi beam system as a light source for the light exposure device 30.

Suitable as the transfer device 40 is a device that is able to transfer a toner image that is on the electrophotographic photoreceptor 1 onto the medium to be transferred onto (the intermediate transfer body 50), and a normally used roll shape may be used for the transfer device 40.

Suitable for use as the intermediate transfer body 50 is a belt shape (intermediate transfer belt) made from a material such as polyimide, polyamidoimide, polycarbonate, polyarylate, polyester, rubber, or the like, to which semiconducting characteristics have been imparted. The shape of the intermediate transfer body 50 may, in addition to the shape of a belt, also be that of a drum. It should be noted that there are also image-forming apparatuses using a direct transfer method that are not provided with such an intermediate transfer body, and the electrophotographic photoreceptor built according to the present exemplary embodiment is also suitably applied to such image-forming apparatuses.

There are no particular limitations to the medium to be transferred onto, as long as it is a medium onto which a toner image formed on the electrophotographic photoreceptor 1 may be transferred. For example, when transferring onto paper and the like directly from the electrophotographic photoreceptor 1, paper and the like are the medium to be transferred onto, and when using the intermediate transfer body 50, the intermediate transfer body becomes the medium to be transferred onto.

Figure 7:
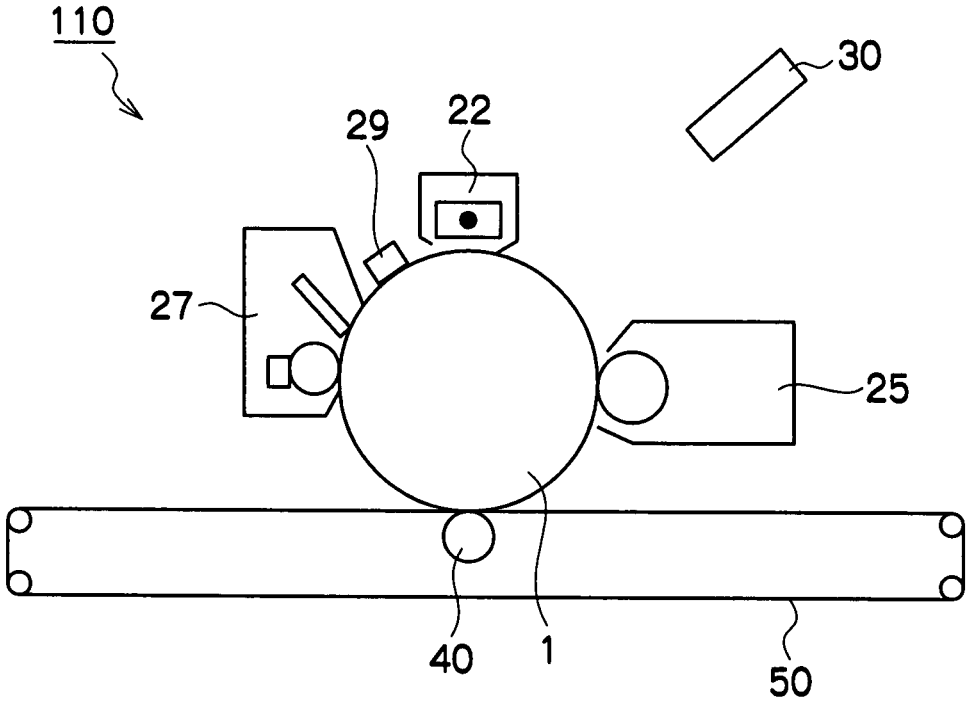
FIG. 7 is a schematic diagram showing an electrophotographic photoreceptor according to another exemplary embodiment.

FIG. 7 is a schematic diagram showing the image-forming apparatus according to another exemplary embodiment. In an image-forming apparatus 110 as shown in FIG. 7, the electrophotographic photoreceptor 1 is fixed to an image-forming device body, a charging device 22, a developing device 25, and a cleaning device 27 are each respectively made into cartridges, to form, respectively, independent cartridges of a charging cartridge, a developing cartridge, and a cleaning cartridge. The charging device 22 is provided with a charging device that charges with a corona method.

In the image-forming apparatus 110, the electrophotographic photoreceptor 1 and each other device are separate, and the charging device 22, the developing device 25, and the cleaning device 27 are not fixed to the image-forming device body by screws, rivets, adhesive, or welding, but rather they are detachably and attachable thereto/therefrom by pulling or pushing manipulation.

Since the electrophotographic photoreceptor according to the present exemplary embodiment is excellent in durability, it is not always necessary to form the electrophotographic photoreceptor into a cartridge. When the charging device 22, the developing device 25, or the cleaning device 27 are configured such that they may be respectively attached and detached by pushing and pulling manipulation, without being fixed to the main body by screws, rivets, adhesive, or welding, the component cost per print may be reduced. Furthermore, more than one of these devices may be made attachable/detachable as a cartridge and, thereby, the component cost per print may be reduced further.

It should be noted that the image-forming apparatus 110 has the same composition as that of the image-forming apparatus 100, except that the charging device 22, the developing device 25, and the cleaning device 27 have been formed into cartridges, respectively.

Figure 8:
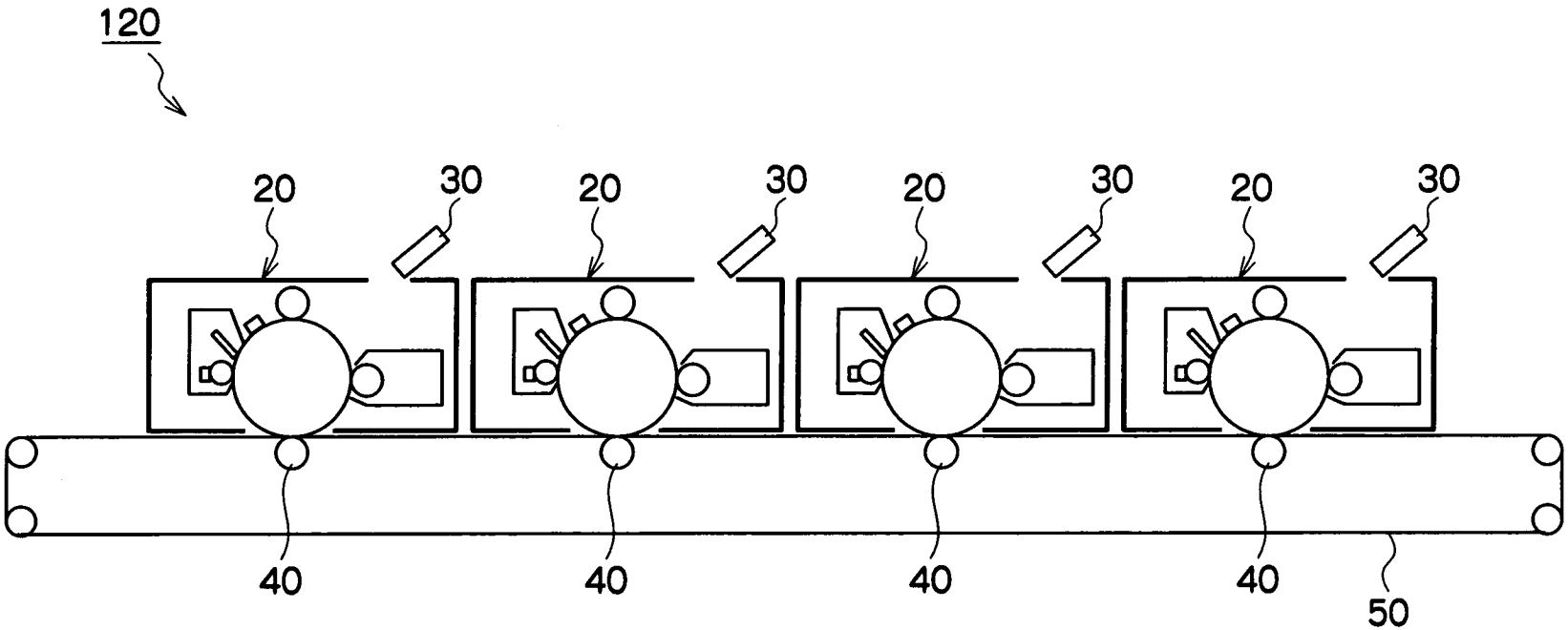
FIG. 8 is a schematic diagram showing an electrophotographic photoreceptor according to another exemplary embodiment.

FIG. 8 is a schematic diagram showing the image-forming apparatus according to another exemplary embodiment. An image-forming apparatus 120 is a tandem full color image-forming apparatus mounted with four process cartridges 20. In the image-forming apparatus 120, the four process cartridges 20 are arranged on the intermediate transfer body 50 and respectively parallel to each other, and for each color there is configured one electrophotographic photoreceptor. It should be noted that, other than being a tandem system, the image-forming apparatus 120 may be configured as per the image-forming apparatus 100.

In the tandem image-forming apparatus 120, since the amount of abrasion of each electrophotographic photoreceptor changes with operating rates of each color, there is a tendency for the electrical properties of each electrophotographic photoreceptor to differ. In connection with this, toner development characteristics gradually change from the initial condition, the condition of print images changes, and there is the tendency for it to become impossible to acquire a stable image. There is a tend towards using electrophotographic photoreceptors of small diameter, especially in order to reduce the size of image-forming apparatuses, and the above tendency becomes significant when electrophotographic photoreceptor of 30 mm diameter or less are used. Here, if the composition of the electrophotographic photoreceptor according to the present exemplary embodiment is adopted for the electrophotographic photoreceptor, even when the diameter less than 30 mm diameter, abrasion of the surface thereof may be suppressed. Therefore, the electrophotographic photoreceptor according to the present exemplary embodiment is especially effective for such a tandem image-forming apparatus.

Figure 9:
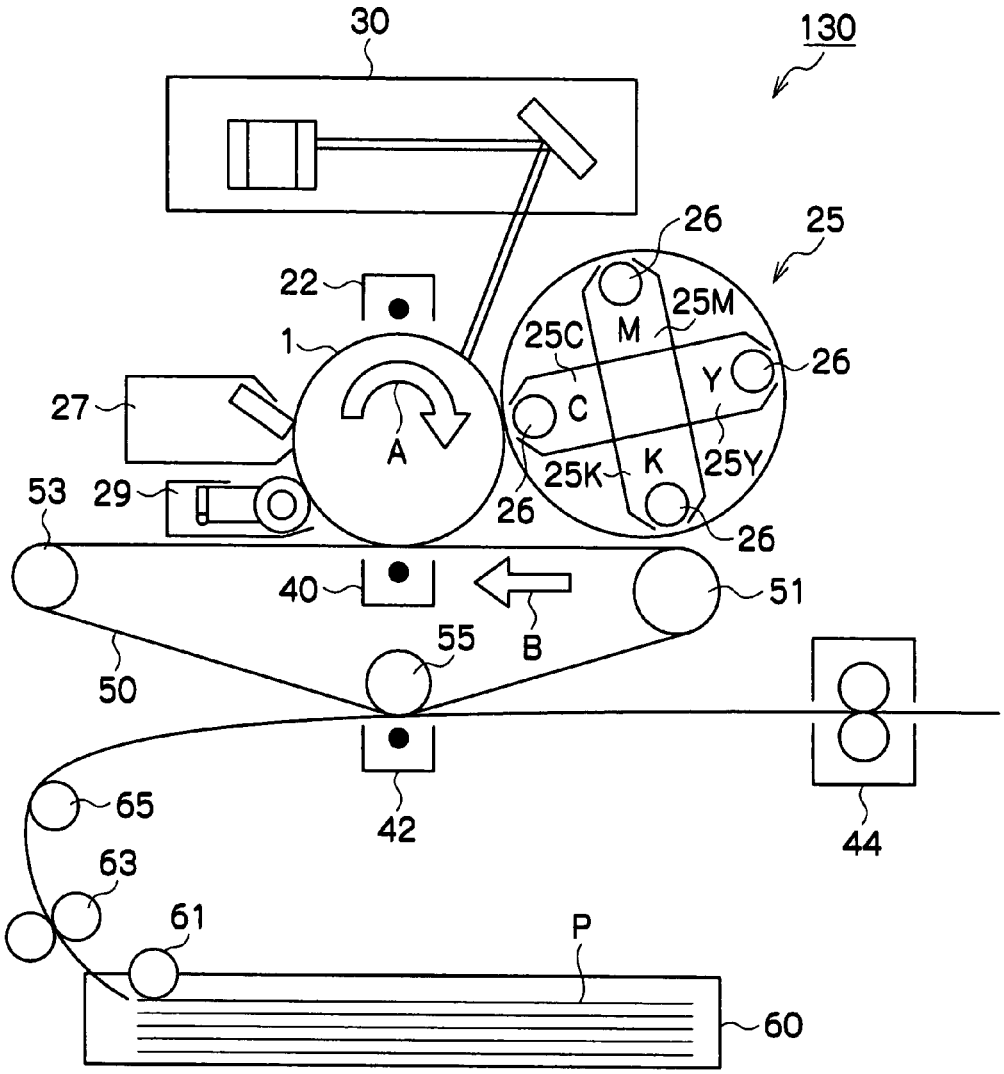
FIG. 9 is a schematic diagram showing an electrophotographic photoreceptor according to another exemplary embodiment.

FIG. 9 is a schematic diagram showing the image-forming apparatus according to another exemplary embodiment. An image-forming apparatus 130 as shown in FIG. 9 is a so-called four-cycle image-forming apparatus, in which toner images of two or more colors are formed by one electrophotographic photoreceptor. The image-forming apparatus 130 is provided with a photoreceptor drum 1, which is rotated in the direction of arrow A in the figure with a predetermined rotational speed by a driving device (not shown), and a charging device 22, which charges the outer peripheral surface of the photoreceptor drum 1, provided above the photoreceptor drum 1.

There is a light exposure device 30 provided with a surface light laser array as an exposure light source arranged above the charging device 22. The light exposure device 30 scans, in a scanning direction parallel to the axis of the photoreceptor drum 1, plural laser beams emitted from light source(s), while modifying the beams according to the image to be formed, deflecting the beams onto the peripheral surface of the photoreceptor drum 1. Thereby, an electrostatic latent image is formed on the outer peripheral surface of the charged photoreceptor drum 1.

A developing device 25 is arranged to the side of the photoreceptor drum 1. The developing device 25 is provided with a receiving body of the shape of a roller that is arranged so as to be rotatable. Four accommodating portions are formed in the inside of this receiving body, and developing units 25Y, 25M, 25C, and 25K are provided in respective accommodating portions. Each of the developing units 25Y, 25M, 25C, and 25K are provided with a developing roller 26, and yellow (Y), magenta (M), cyan (C), and black (K) color toners are filled respectively therein.

In the image-forming apparatus 130, image formation of a full color image is carried out while the photoreceptor drum 1 rotates four times. Namely, while the photoreceptor drum 1 rotates four times, the charging device 22 charges the outer peripheral surface of the photoreceptor drum 1, and, the light exposure device 30 scans the laser beams, which have been modulated according to color image data, switched for each revolution to correspond to the image data that represents whichever of the images for Y, M, C, or K that is to be formed, onto the outer peripheral surface of the photoreceptor drum 1. The developing device 25, in the state where one or other of the developing rollers 26 of the developing units 25Y, 25M, 25C, and 25K faces the outer peripheral surface of the photoreceptor drum 1, operates the developing unit 25 that is facing the outer peripheral surface, and develops the electrostatic latent image formed to the outer peripheral surface of the photoreceptor drum 1 in the specific color, and the photoreceptor drum 1 carries out repeated rotations, such that for each revolution the toner image of the specific color on the outer peripheral surface of the photoreceptor drum 1 is formed, by rotating the receiving body so that the developing unit used for the development of the electrostatic latent image is changed between revolutions. By this configuration, for each revolution the photoreceptor drum 1 carries out toner images of Y, M, C, and K are formed in sequence on the outer peripheral surface of the photoreceptor drum 1 so as to be superimposed on each other, and when the photoreceptor drum 1 has rotated four times, a full color toner image is formed on the outer peripheral surface of the photoreceptor drum 1.

An endless intermediate transfer belt 50 is disposed below the photoreceptor drum 1. The intermediate transfer belt 50 is wrapped around rollers 51, 53, and 55, and it is arranged so that an outer peripheral surface of the intermediate transfer belt 50 contacts the outer peripheral surface of the photoreceptor drum 1. The driving force of a non illustrated motor is transmitted, rotating the rollers 51, 53, and 55, and the intermediate transfer belt 50 rotates in the direction of arrow B in the figure.

A transfer device (transfer unit) 40 is arranged on the opposite side of the intermediate transfer belt 50 to that of the photoreceptor drum 1, and the toner image formed on the outer peripheral surface of the photoreceptor drum 1 is transferred by the transfer device 40 to the image-forming face of the intermediate transfer belt 50.

A lubricant supply device 29 and a cleaning device 27 are arranged to one side of the photoreceptor drum 1, the side thereof that is opposite to the side of the developing device 25, and at the outer peripheral surface of the photoreceptor drum 1. When the toner image formed on the outer peripheral surface of the photoreceptor drum 1 has been transferred by the intermediate transfer belt 50, a lubricant is supplied to the outer peripheral surface of the photoreceptor drum 1 by lubricant supply device 29, and the region of the outer peripheral surface of the photoreceptor drum 1 that held the toner image that has been transferred therefrom is cleaned by the cleaning device 27.

A sheet feeding device 60 is arranged below the intermediate transfer belt 50, and paper P as a recording material is accommodated in the sheet feeding device 60, in a state in which plural sheets are stacked therein. There is a feed roller 61 arranged diagonally above the sheet feeding device 60, and there is a roller pair 63 and a roller 65 arranged in sequence along the feed out direction to the downstream side of the feed roller 61. By rotation of the feed roller 61 the sheet of recording paper P that is positioned at the top of the stack is fed out from the sheet feeding device 60, and conveyed by the roller pair 63 and the roller 65.

Furthermore, there is a transfer device 42 arranged at the other side of the intermediate transfer belt 50 to that of the roller 55. The paper P that has been conveyed by the roller 65 is conveyed between the intermediate transfer belt 50 and the transfer device 42, and the toner image that has been formed on the image-forming face of the intermediate transfer belt 50 is transferred onto the paper P by the transfer device 42. There is a fixing device 44, provided with a fixing roller, arranged at the downstream side in the conveying relative to the transfer device 42, and the paper P onto which the toner image has been transferred, after the toner image that has been fixed by fusing with the fixing device 44, is ejected out from the image-forming apparatus 130, and placed into a non illustrated paper catcher.

EXAMPLES

The invention will now be explained using Examples thereof, however, the invention is not limited by these Examples in any way. In the following Examples, "part" means parts by weight. Also, within the formulae, Me represents a methyl group and Pr represents an n-propyl group.

(Preparation of Type-I Hydroxygallium Phthalocyanine)

30 parts by weight of 1,3-diiminoisoindoline and 9.1 parts by weight of gallium trichloride are added to 230 parts by weight of dimethyl sulfoxide, and they are reacted while stirring at 160° C. for 6 hours, and red-purple color crystals are obtained. After washing the obtained crystals with dimethyl sulfoxide, the crystals are washed with ion exchange water and dried, and 28 parts by weight of raw crystals of Type-I chlorogallium phthalocyanine are obtained. Next, 10 parts by weight of the obtained Type-I chlorogallium phthalocyanine raw crystals are heated at 60° C. and dissolved in 300 parts by weight of sulfuric acid (97% concentrate), and this solution is dripped into a mixed solution of 600 parts by weight of 25% aqueous ammonia and 200 parts by weight of ion-exchange-water. Precipitated crystal are extracted by filtration, further washed and dried with ion exchange water, and 8 parts by weight of Type-I hydroxygallium phthalocyanine is obtained.

Figure 10:
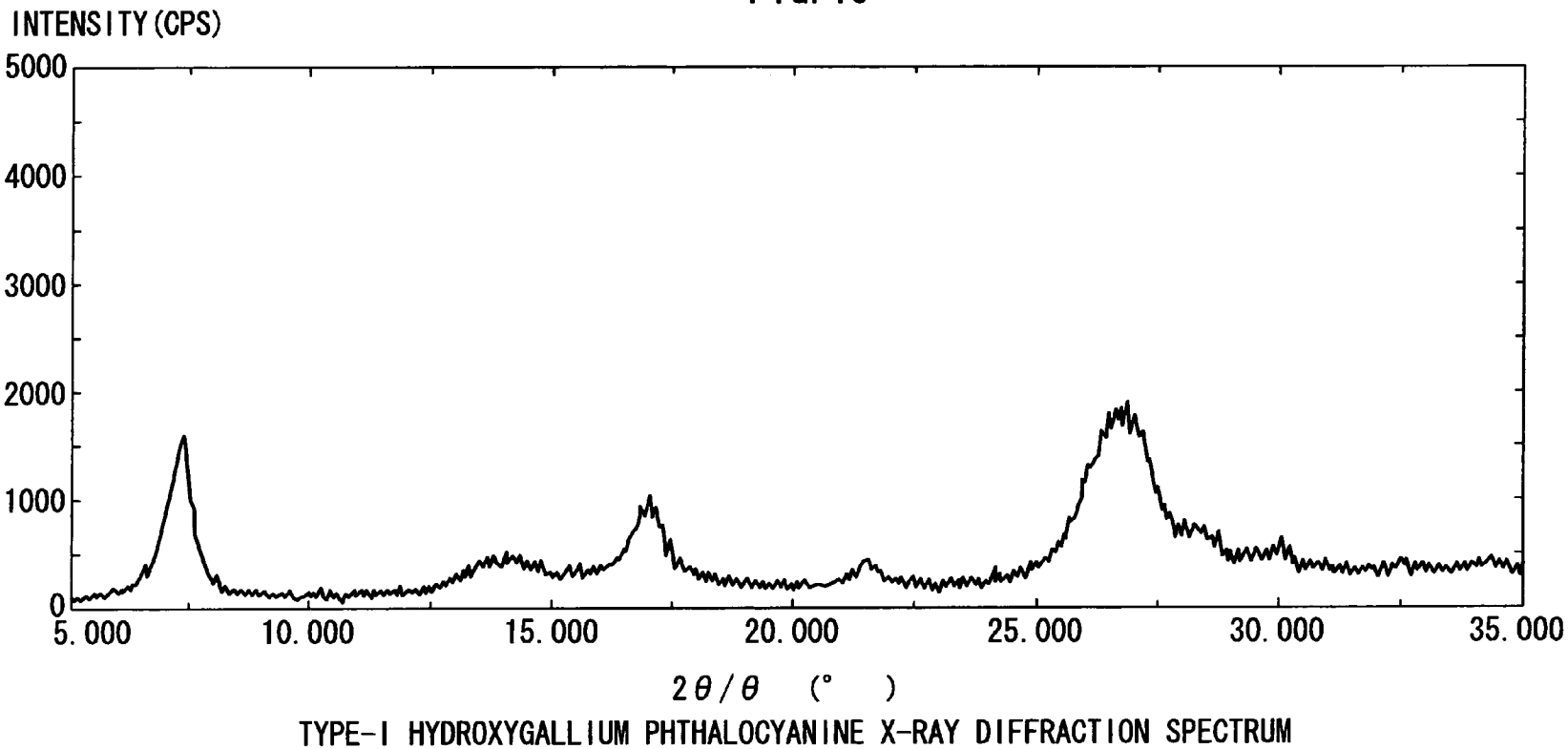
FIG. 10 is a graph showing an X-ray diffraction spectrum of Type-I hydroxygalliumphthalocyanine.

The X diffraction spectrum of the thus obtained Type-I hydroxygallium phthalocyanine is measured. The results are as shown in FIG. 10.

Measurement of the X diffraction spectrum in this example is performed under the following conditions using CuKα X-ray powder diffraction.

—Conditions—

Measuring instrument MINIFLEX X-ray diffractometer used: (Trade Name; made by Rigaku Corporation)
X-ray tube: Cu
Tube current: 15 mA
Scanning speed: 5.0 deg./min
Sampling period: 0.02 deg.
Start angle (2θ): 5 deg.
Stop angle (2θ): 35 deg.
Step angle (2θ): 0.02 deg.

The spectral absorption-spectrum is measured using a U-2000 spectrophotometer (Trade Name; manufactured by Hitachi Ltd.), with a measuring liquid at room temperature (24° C.), and a dispersion of 0.6 g of hydroxygallium phthalocyanine is prepared in n-butyl acetate 8 mL. The grain shape state of the obtained hydroxygallium phthalocyanine is observed using a transmission electron microscope (H-9000, Trade Name, made by Hitachi Ltd.).

(Preparation of Type-V Hydroxygallium Phthalocyanine HPC-1)

Wet grinding treatment of 6 parts by weight of the Type-I hydroxygallium phthalocyanine obtained from the above process is carried out at 25° C. for 48 hours using a glass ball mill with 80 parts by weight of N,N-dimethylformamide and 350 parts by weight of glass spherical shape media with an outside diameter of 1 mm. The degree of completion of crystal conversion is monitored by measuring the absorption wavelength of the wet-grinding treatment liquid, and it is checked that the absorption maximum wavelength λMAX in the spectral absorption spectrum of hydroxygallium phthalocyanine is 838 nm. Subsequently, the obtained crystals are washed using acetone, dried and 5.5 parts by weight of hydroxygallium phthalocyanine is obtained with diffraction peaks at Bragg angles to CuKα X-ray (2θ±0.2°) of 7.5°, 9.9°, 12.5°, 16.3°, 18.6°, 25.1°, and 28.3° and diffraction full width at half maximum of 0.63 at the diffraction peak of 7.5°.

Figure 11:
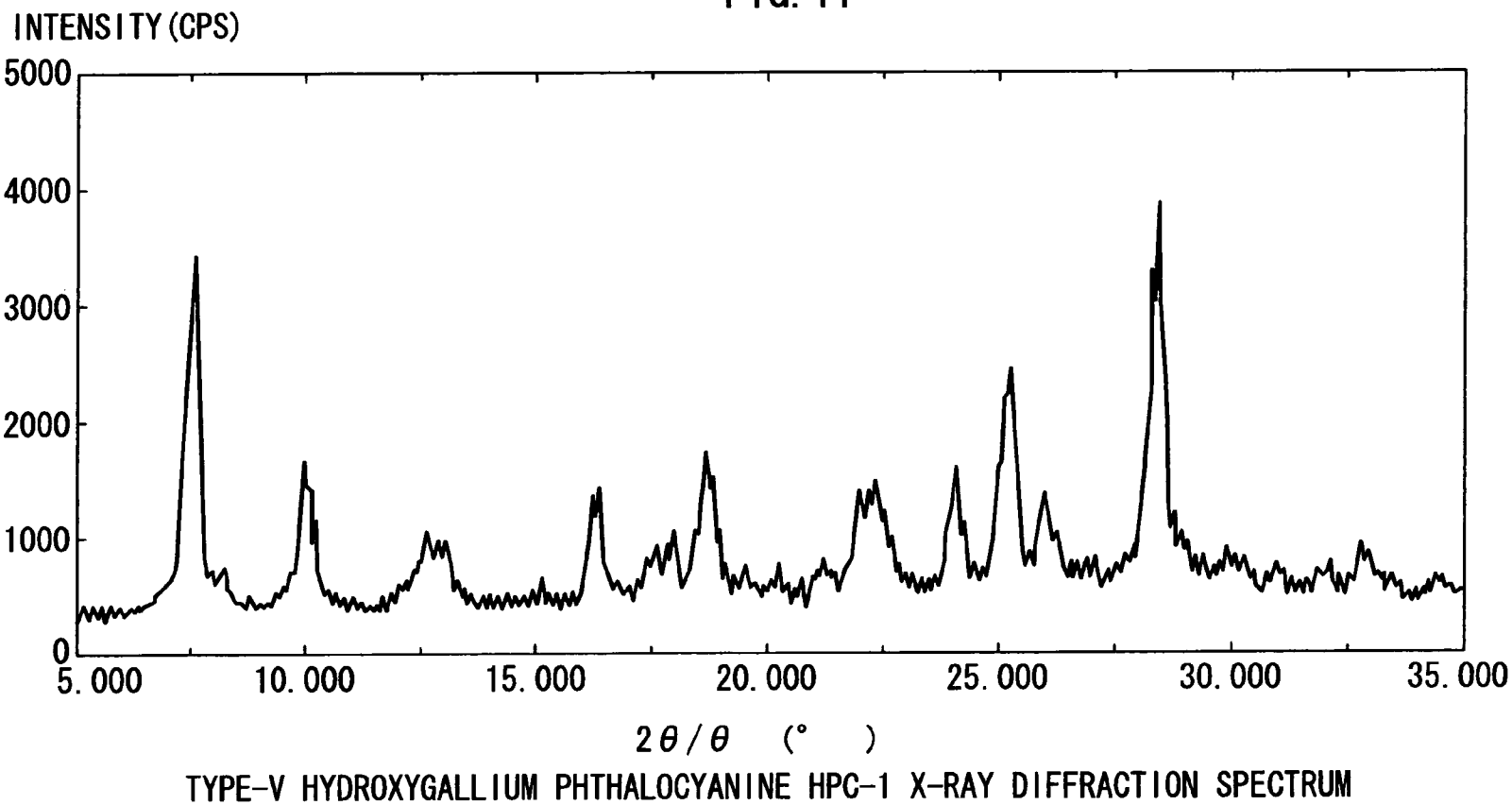
FIG. 11 is a graph showing an X-ray diffraction spectrum of Type-V hydroxygalliumphthalocyanine HPC-1.

The X diffraction spectrum of the above obtained Type-V hydroxygallium phthalocyanine HPC-1 is measured. The result is as shown in FIG. 11.

Figure 12:
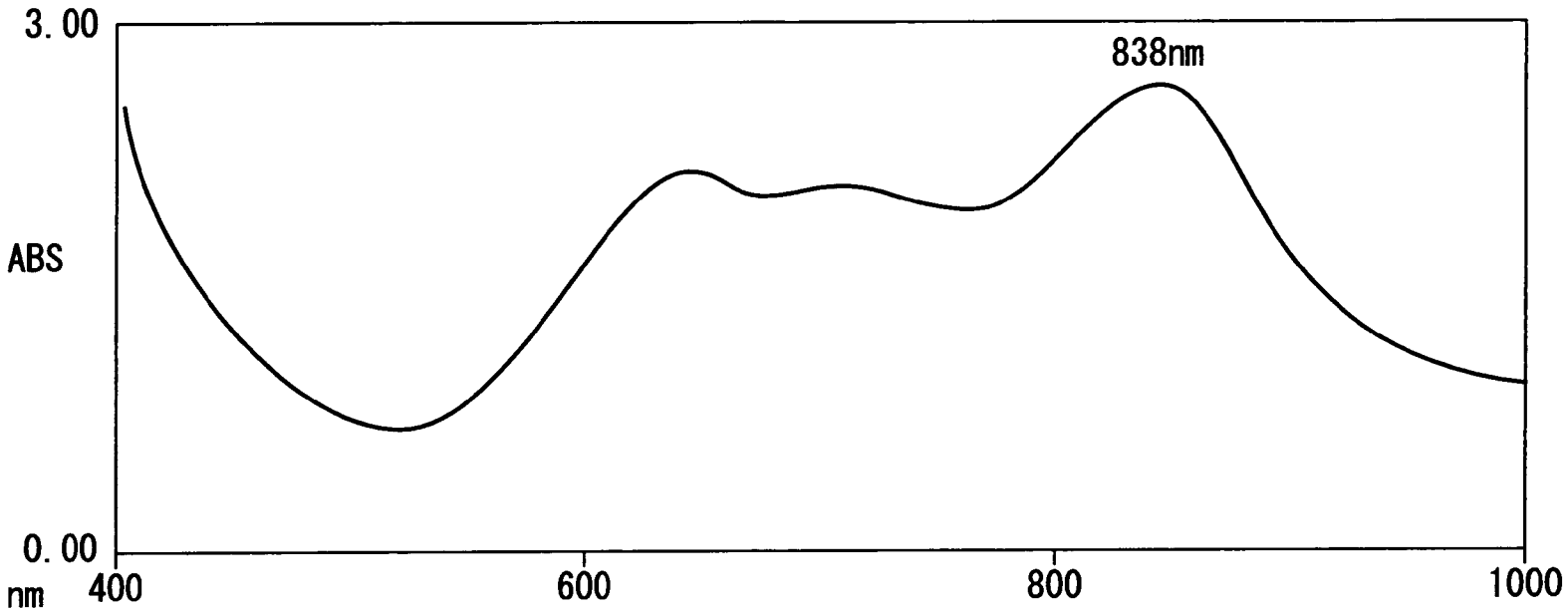
FIG. 12 is a graph showing a spectral absorption spectrum of Type-V hydroxygalliumphthalocyanine HPC-1.

The spectral absorption spectrum of the Type-V hydroxygallium phthalocyanine HPC-1 is also measured. The result is as shown in FIG. 12. This result shows that the maximum absorption wavelength is 838 nm in the spectral absorption spectrum in the wavelength band of from 600 nm to 900 nm.

(Preparation of V-Type Hydroxygallium Phthalocyanine HPC-2)

Figure 13:
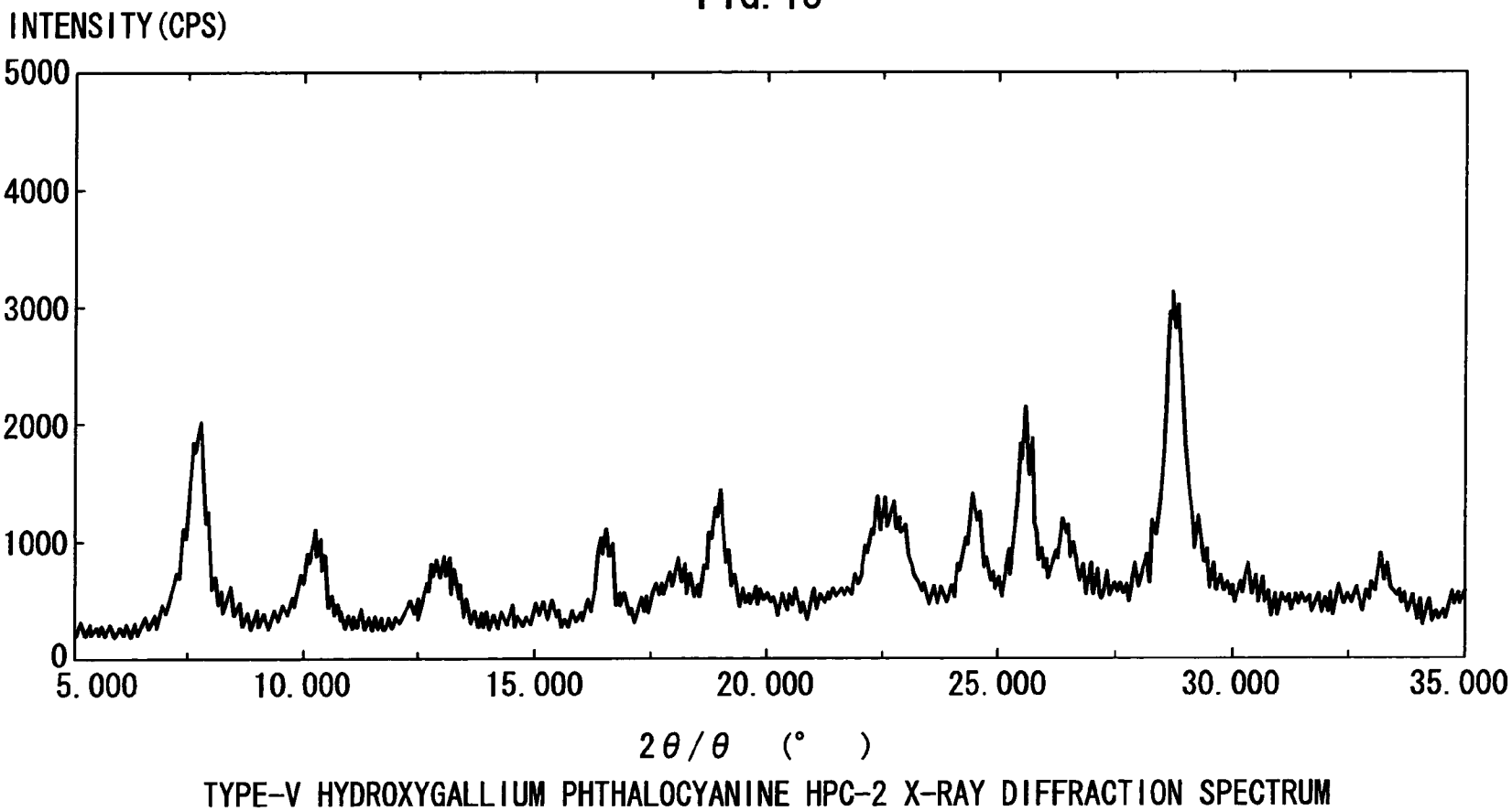
FIG. 13 is a graph showing an X-ray diffraction spectrum of Type-V hydroxygalliumphthalocyanine HPC-2.
Figure 14:
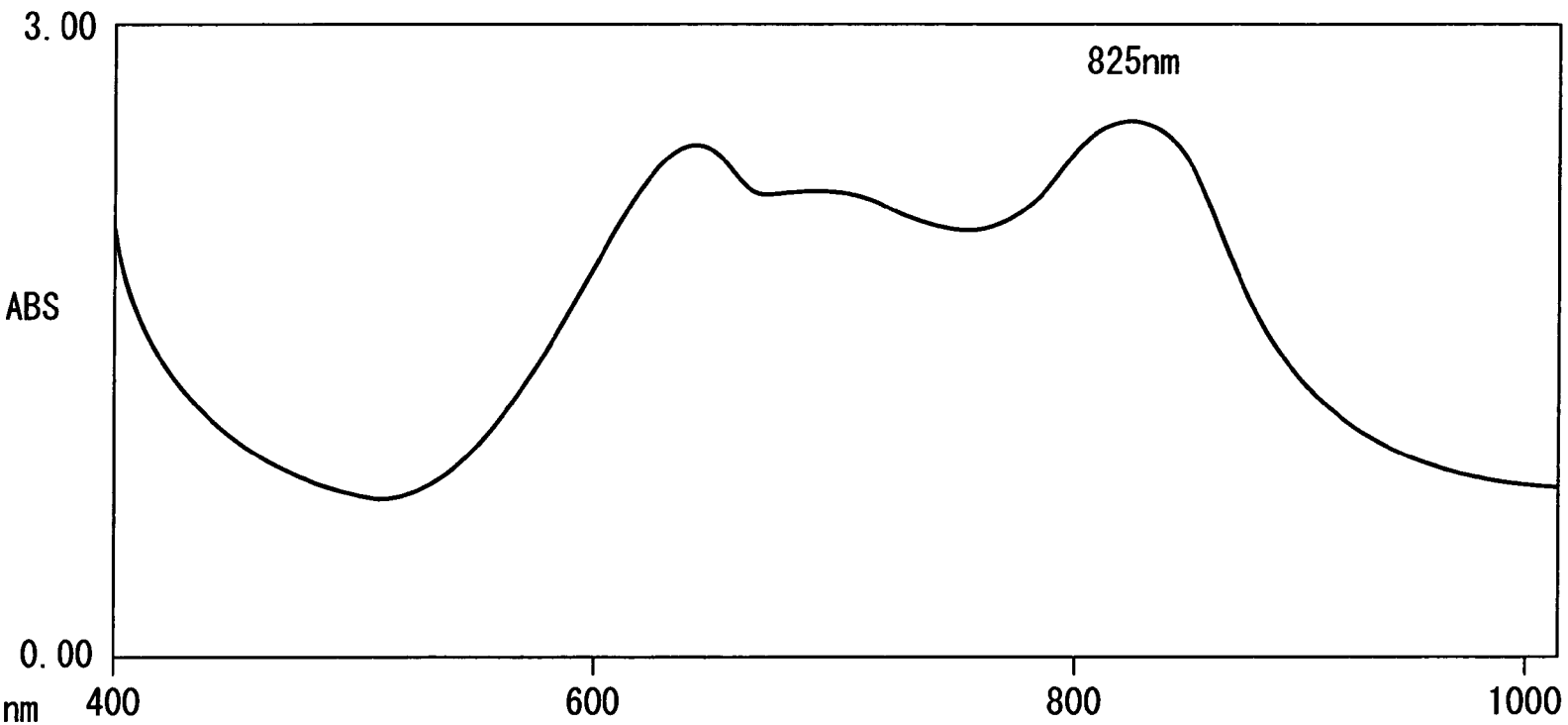
FIG. 14 is a graph showing a spectral absorption spectrum of Type-V hydroxygalliumphthalocyanine HPC-2.

Wet grinding treatment of 6 parts by weight of the Type-I hydroxygallium phthalocyanine obtained from the above process is carried out at 25° C. for 210 hours using a glass ball mill with 100 parts by weight of N,N-dimethylformamide and 350 parts by weight of glass spherical shape media with an outside diameter of 0.9 mm. The degree of completion of crystal conversion is monitored by measuring the absorption wavelength of the wet-grinding treatment liquid, and it is checked that the absorption maximum wavelength λMAX in the spectral absorption spectrum of the hydroxygallium phthalocyanine is 825 nm. Subsequently, the obtained crystals are washed using acetone, dried and 5.5 parts by weight of hydroxygallium phthalocyanine is obtained with diffraction peaks at Bragg angles to CuKαX-ray (2θ±0.2°) of 7.5°, 9.9°, 12.5°, 16.3°, 18.6°, 25.1°, and 28.3°. This is the Type-V hydroxygallium phthalocyanine HPC-2. The X diffraction spectrum of the above obtained Type-V hydroxygallium phthalocyanine HPC-2 is shown in FIG. 13, and the spectral absorption spectrum thereof in FIG. 14. This result shows that the maximum absorption wavelength is 825 nm in the spectral absorption spectrum in the wavelength band of from 600 nm to 900 nm.

(Preparation of V-Type Hydroxygallium Phthalocyanine HPC-3)

Figure 15:
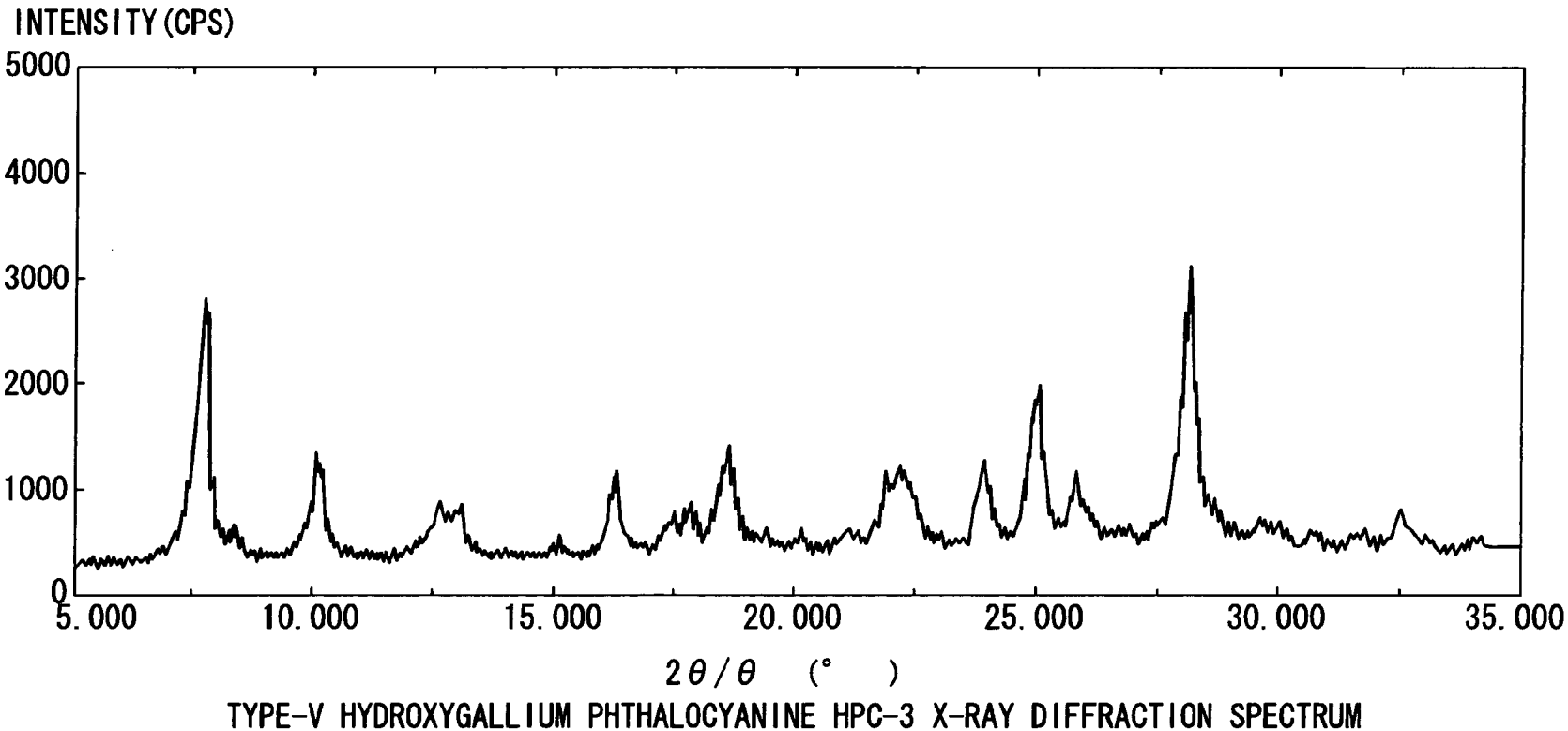
FIG. 15 is a graph showing an X-ray diffraction spectrum of Type-V hydroxygalliumphthalocyanine HPC-3.
Figure 16:
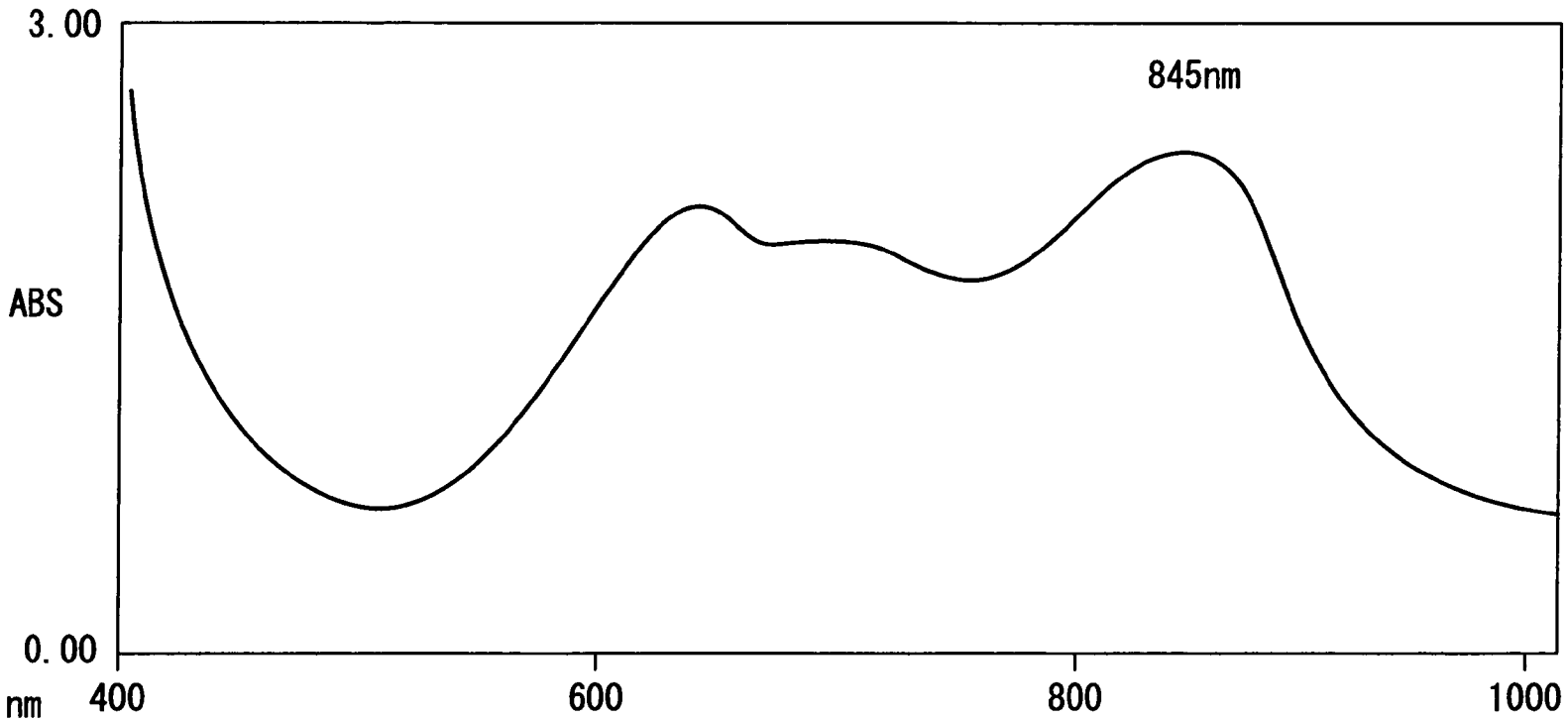
FIG. 16 is a graph showing an spectral absorption spectrum of Type-V hydroxygalliumphthalocyanine HPC-3.

Wet grinding treatment of 6 parts by weight of the Type-I hydroxygallium phthalocyanine obtained from the above process is carried out at 25° C. for 48 hours using a glass ball mill with 80 parts by weight of N,N-dimethylformamide and 350 parts by weight of glass spherical shape media with an outside diameter of 5.0 mm. The degree of completion of crystal conversion is monitored by measuring the absorption wavelength of the wet-grinding treatment liquid, and it is checked that the absorption maximum wavelength λMAX in the spectral absorption spectrum of hydroxygallium phthalocyanine is 845 nm. Subsequently, the obtained crystals are washed using acetone, dried and 5.5 parts by weight of hydroxygallium phthalocyanine is obtained with diffraction peaks at Bragg angles to CuKα X-ray (2θ±0.2°) of 7.5°, 9.9°, 12.5°, 16.3°, 18.6°, 25.1°, and 28.3°. This is the Type-V hydroxygallium phthalocyanine HPC-3. The X diffraction spectrum of the above obtained Type-V hydroxygallium phthalocyanine HPC-3 is shown in FIG. 15, and the spectral absorption spectrum thereof in FIG. 16. This result shows that the maximum absorption wavelength is 845 nm in the spectral absorption spectrum in the wavelength band of from 600 nm to 900 nm.

(Preparation of Compound I-7)

Figure 17:
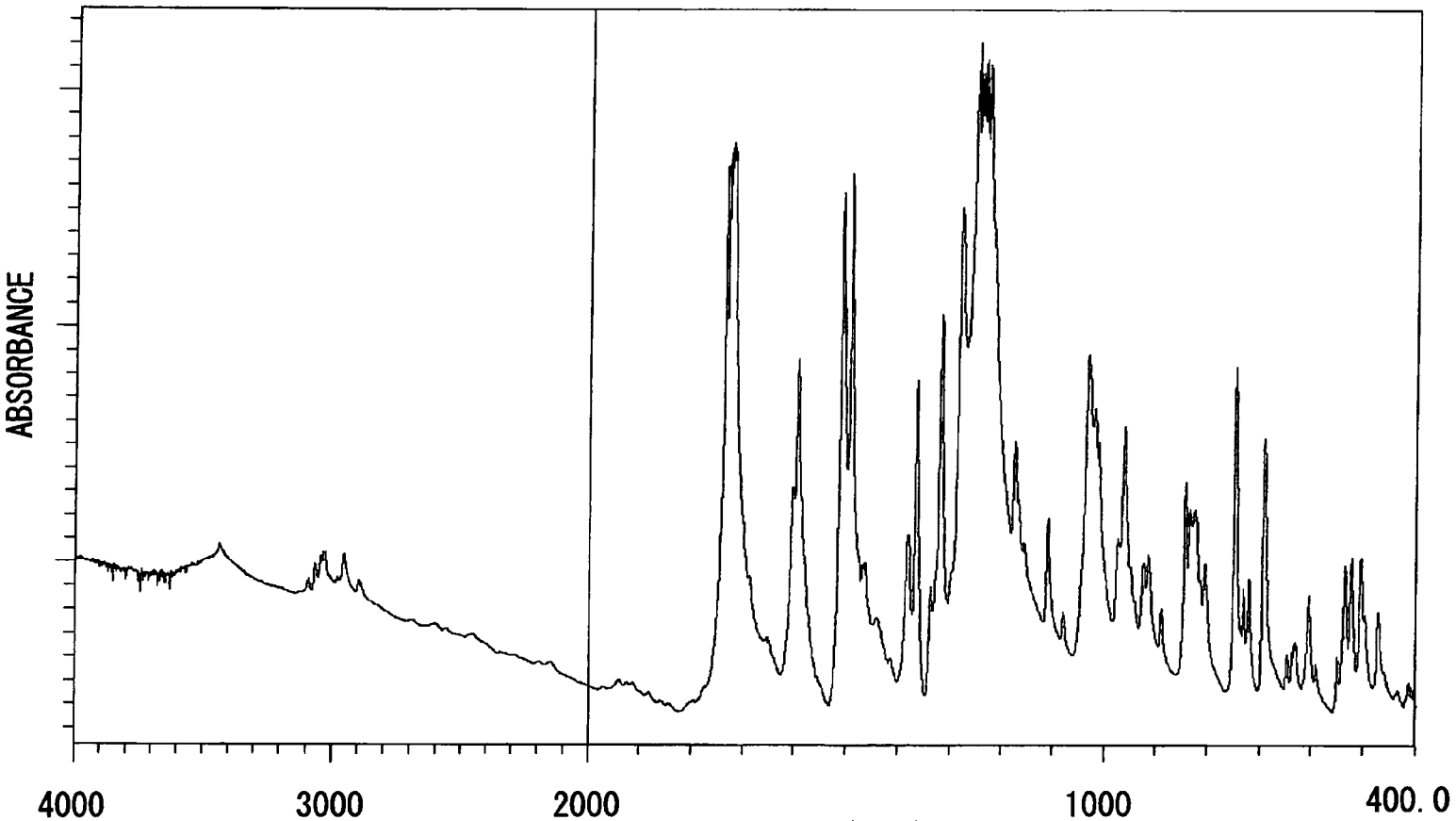
FIG. 17 is an IR spectrum of compound I-7.

20 g of compound represented by the following formula I-7-1 is placed in a flask and mixed with 70 g of pyridine. 80 g of acetic anhydride is dripped therein and stirred at room temperature (24° C.) for 5 hours. The reaction liquid is then poured into 500 ml of water and a further 500 ml of ethyl acetate is added, and the liquids stirred and separated in a separating funnel, and the organic layer extracted. After repeating three times the washing of the organic layer with 500 ml of water and the separation operation, the organic layer is dried under reduced pressure and 21 g of compound I-7 is obtained. The IR spectrum of the obtained compound is as shown in FIG. 17.

(I-7-1)

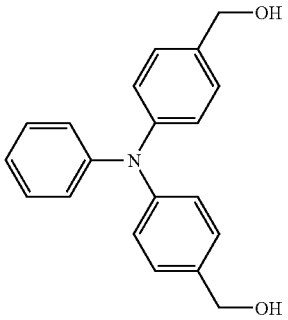

-continued (I-7)

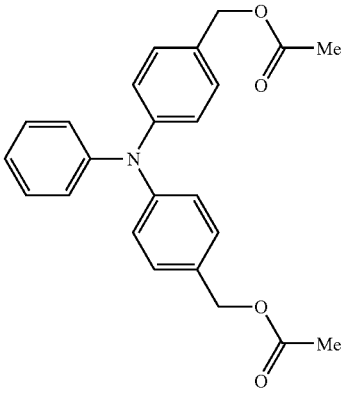

(Preparation of Compound I-11)

Figure 18:
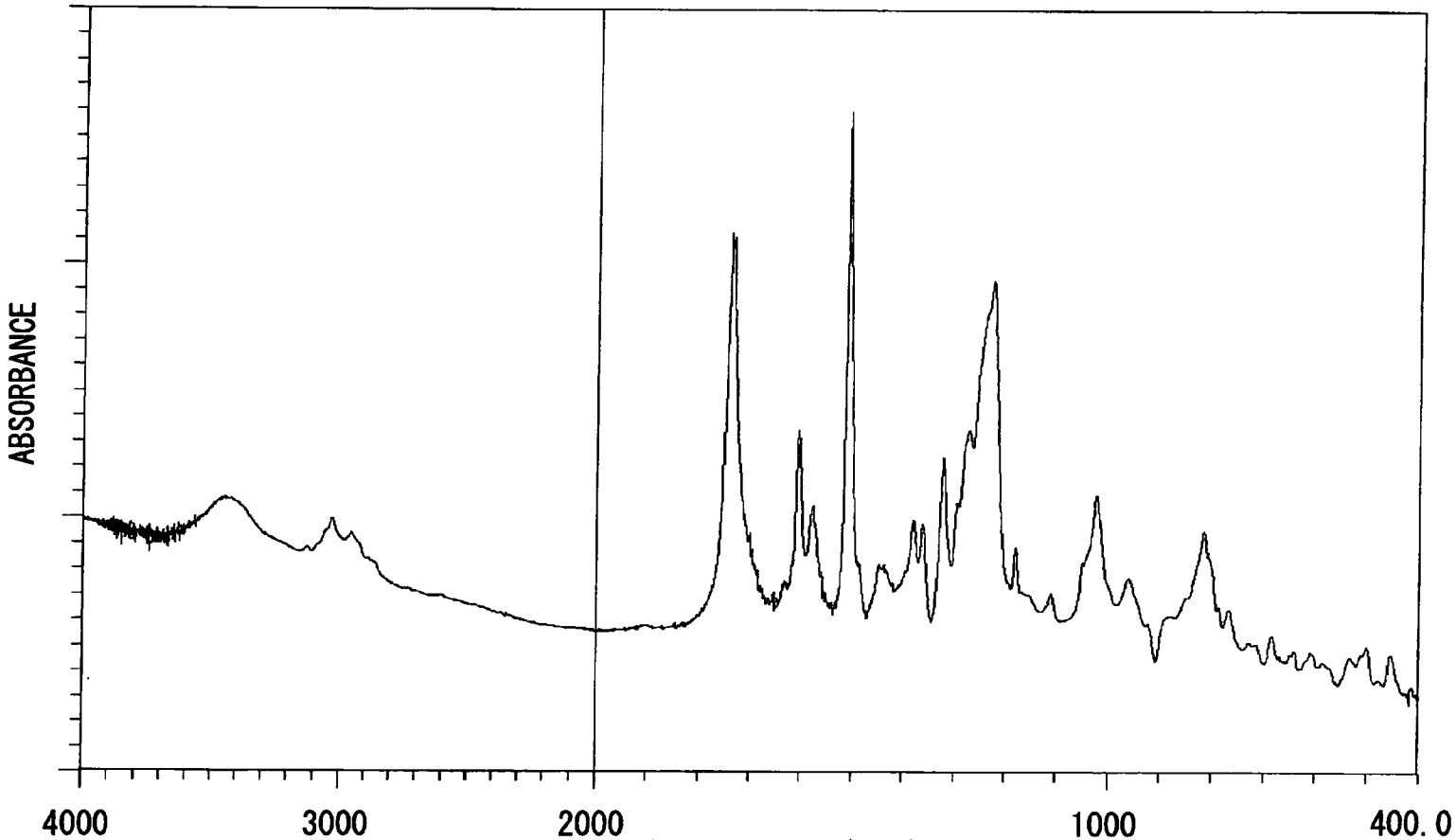
FIG. 18 is an IR spectrum of compound I-11.

20 g of compound represented by the following formula I-11-1 is placed in a flask and mixed with 80 g of pyridine. 90 g of acetic anhydride is dripped therein and stirred at room temperature (24° C.) for 5 hours. The reaction liquid is then poured into 500 ml of water and a further 500 ml of ethyl acetate is added, and the liquids stirred and separated in a separating funnel, and the organic layer extracted. After repeating three times the washing of the organic layer with 500 ml of water and the separation operation, the organic layer is dried under reduced pressure and 23 g of compound I-11 is obtained. The IR spectrum of the obtained compound is as shown in FIG. 18.

(I-11-1)

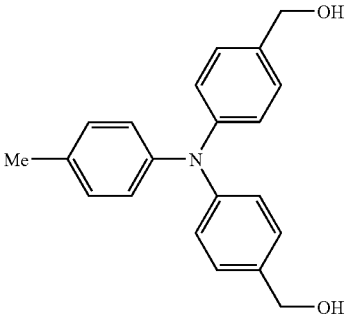

(I-11)

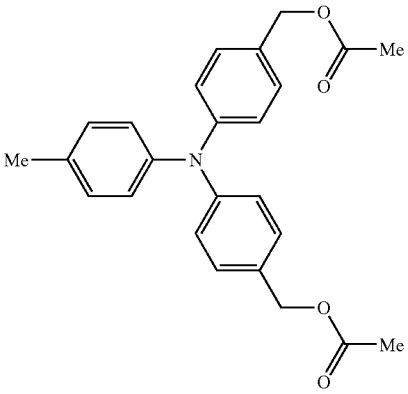

(Preparation of Compound I-29)

Figure 19:
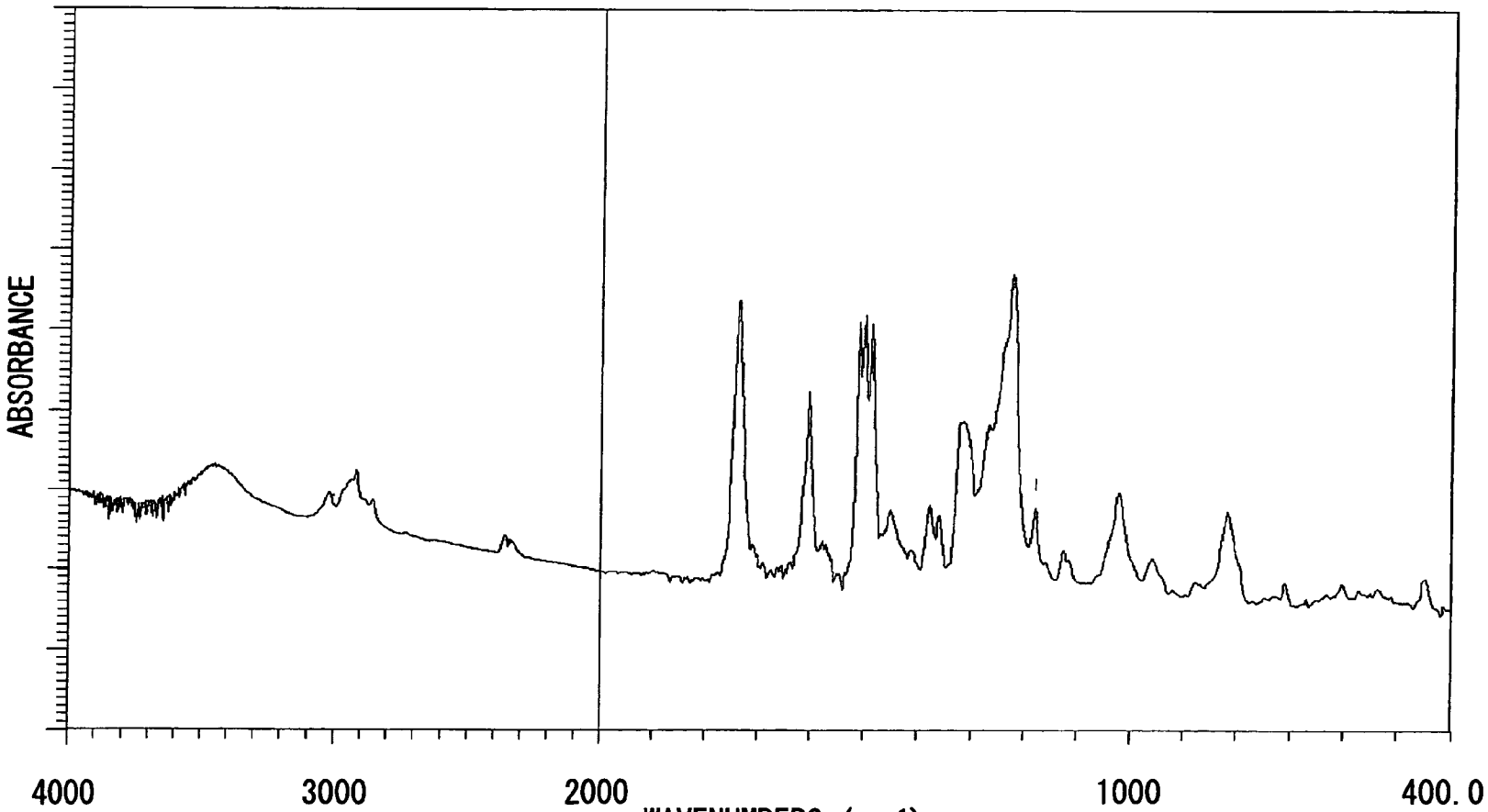
FIG. 19 is an IR spectrum of compound I-29.

20 g of compound represented by the following formula I-29-1 is placed in a flask and mixed with 50 g of pyridine. 65 g of acetic anhydride is dripped therein and stirred at room temperature (24° C.) for 5 hours. The reaction liquid is then poured into 500 ml of water and a further 500 ml of ethyl acetate is added, and the liquids stirred and separated in a separating funnel, and the organic layer extracted. After repeating three times the washing of the organic layer with 500 ml of water and the separation operation, the organic layer is dried under reduced pressure and 19 g of compound I-29 is obtained. The IR spectrum of the obtained compound is as shown in FIG. 19.

(I-29-1)

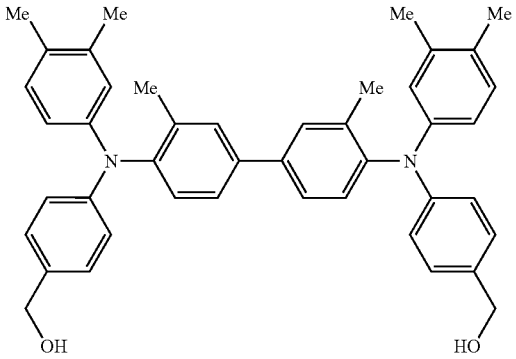

(I-29)

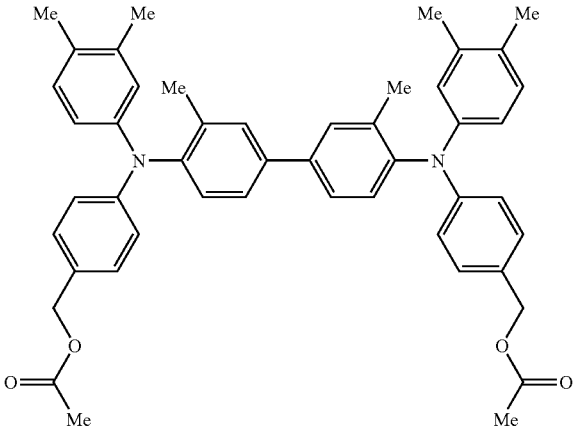

(Preparation of Compound I-30)

Figure 20:
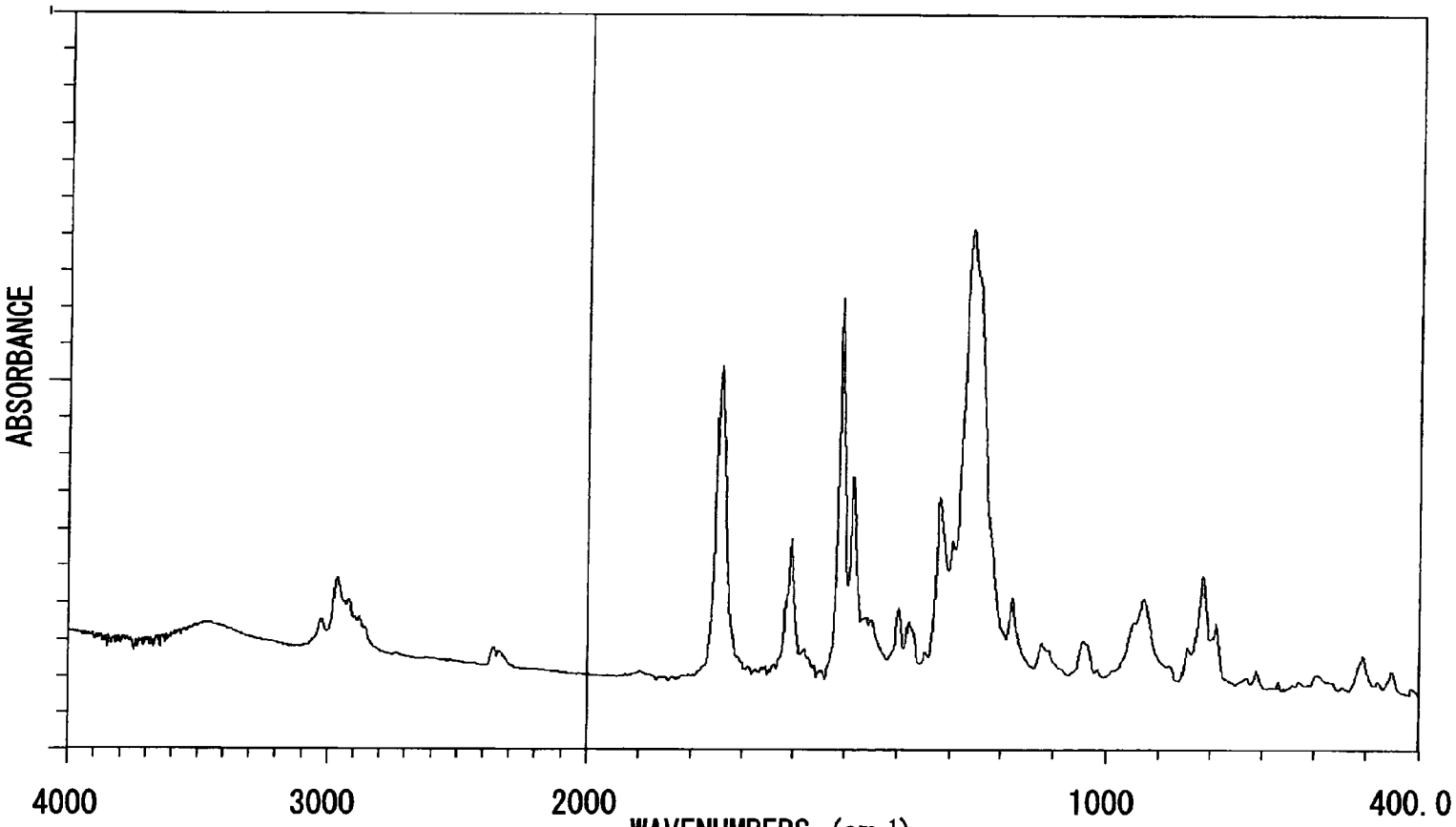
FIG. 20 is an IR spectrum of compound I-30.

20 g of compound represented by the following formula I-30-1 is placed in a flask and mixed with 50 g of pyridine and 100 ml of toluene. 77 g of propionyl chloride is dripped therein and stirred at room temperature (24° C.) for 5 hours. The reaction liquid is then poured into 500 ml of water and a further 500 ml of ethyl acetate is added, and the liquids stirred and separated in a separating funnel, and the organic layer extracted. After repeating three times the washing of the organic layer with 500 ml of water and the separation operation, the organic layer is dried under reduced pressure and 24 g of compound I-30 is obtained. The IR spectrum of the obtained compound is as shown in FIG. 20.

(I-30-1)

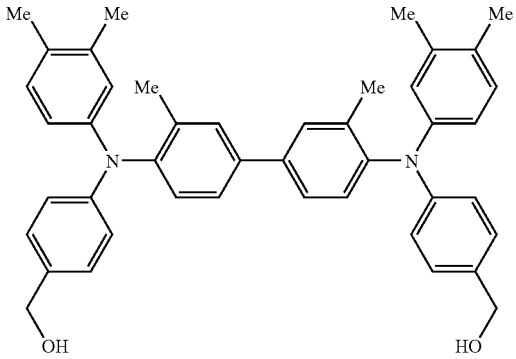

(I-30)

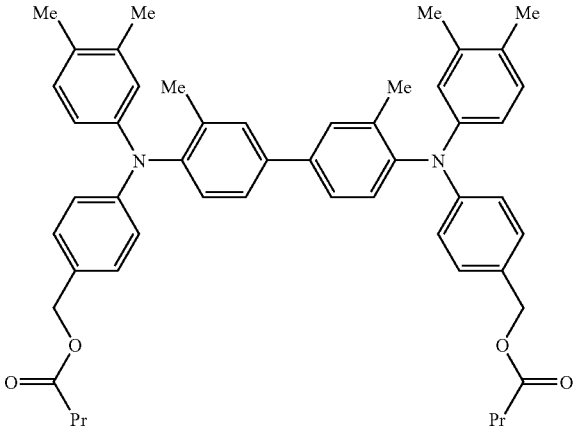

(Preparation of Compound I-31)

Figure 21:
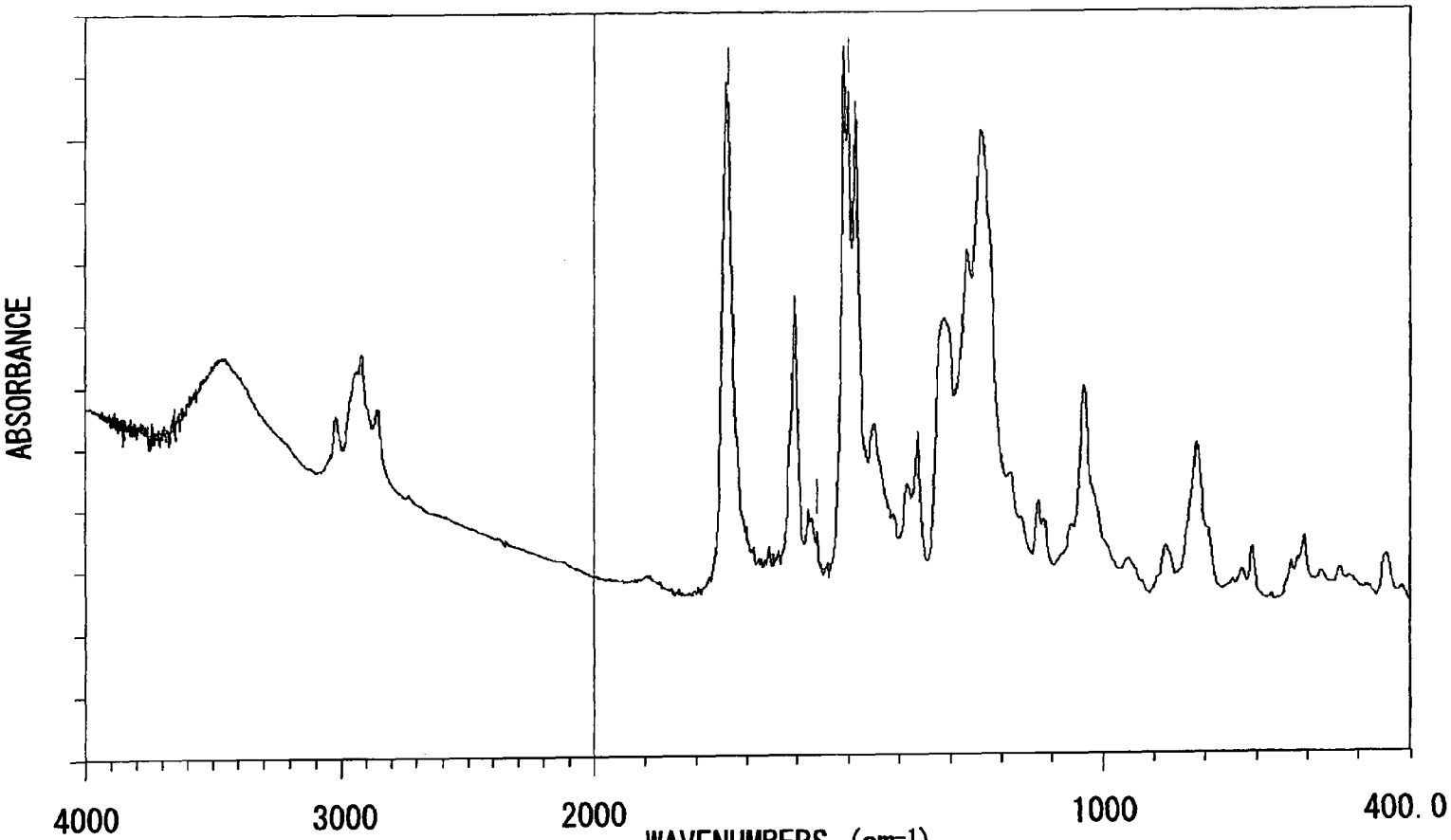
FIG. 21 is an IR spectrum of compound I-31.

20 g of compound represented by the following formula I-31-1 is placed in a flask and mixed with 50 g of pyridine. 65 g of acetic anhydride is dripped therein and stirred at room temperature (24° C.) for 5 hours. The reaction liquid is then poured into 500 ml of water and a further 500 ml of ethyl acetate is added, and the liquids stirred and separated in a separating funnel, and the organic layer extracted. After repeating three times the washing of the organic layer with 500 ml of water and the separation operation, the organic layer is dried under reduced pressure and 22 g of compound I-31 is obtained. The IR spectrum of the obtained compound is as shown in FIG. 21.

(I-31-1)

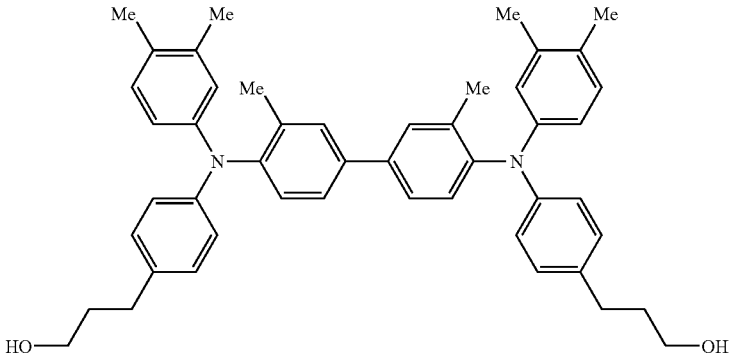

(I-31)

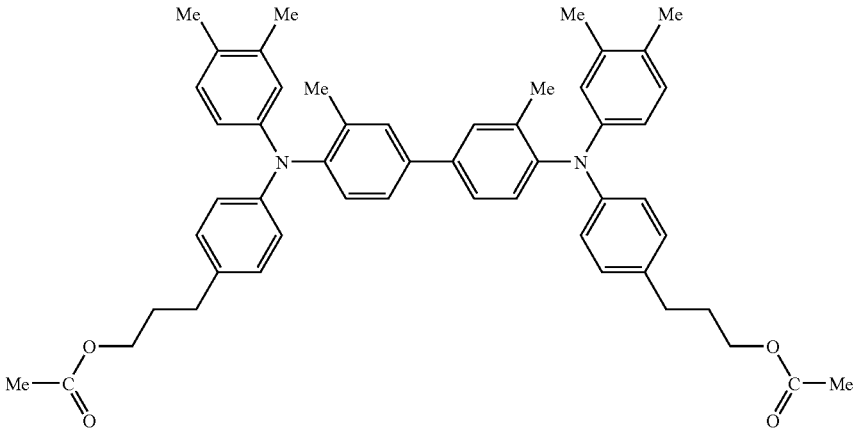

(Preparation of Phenol Resin Ph-1)

100 g of phenol (made by Wako Pure Chemical Industries, Ltd.), 172.4 g of formalin (made by Wako Pure Chemical Industries, Ltd.), and 2 g of triethylamine (made by Tokyo Chemical Industry Co., Ltd.) are placed in a flask, and heated and stirred at 80° C. for 5.5 hours. Then, the solvent is distilled off under reduced pressure. Subsequently, 50 g of methanol is added thereto, and after dissolving and mixing, the solvent is distilled off under reduced pressure. The series of operations from addition of methanol to solvent distillation are repeated a further two times, and a viscous phenol resin is obtained. This phenol resin is (Ph-1).

(Preparation of Phenol Resin Ph-2)

100 g of phenol (made by Wako Pure Chemical Industries, Ltd.), 172.4 g of formalin (made by Wako Pure Chemical Industries, Ltd.), and 2 g of barium hydroxide octahydrate are placed in a flask, and heated and stirred at 80° C. for 6.0 hours. Then 1.1 g of sulfuric acid is added, neutralized to between pH 3 to pH 4, 200 ml of methanol is added, it is allowed to stand at −10° C. for 16 hours, then the precipitate is removed, the solvent is distilled off under reduced pressure, and a viscous phenol resin is obtained. This phenol resin is (Ph-2).

Example 1

-Production of Photoreceptor-1 -

First, a cylindrical aluminum substrate is prepared as a conductive substrate. Next, 100 parts by weight of zinc oxide (Trade Name: SMZ-017N; made by Tayca Corporation) is stirred and mixed with 500 parts by weight of toluene, 2 parts by weight of a silane coupling agent (Trade Name: A 1100; made by Nippon Unicar Company Limited) is added thereto and stirred for 5 hours. The toluene is distilled off by vacuum distillation after that, and baking is performed at 120° C. for 2 hours. Fluorescent X-ray analysis of the obtained surface treated zinc oxide reveals that the ratio of silicon element intensity to the zinc element intensity is $1.8\times10^{-4}$.

35 parts by weight of the surface treated zinc oxide and 15 parts by weight of a curing agent (blocked isocyanate SUMIDUR 3175, made by Sumitomo Bayer Urethane Co., Ltd) are mixed with 6 parts by weight of a butyral resin (S-LEC BM-1, made by Sekisui Chemical Co., Ltd.) and 44 parts by weight of methyl ethyl ketone, and dispersion processing is carried out for 2 hours in a sand mill using glass beads of 1 mm ϕ, and a dispersion liquid is obtained. 0.005 parts by weight of dioctyltin dilaurate, as a catalyst, and 17 parts by weight of silicone particles (TOSPEARL 130, made by GE Toshiba Silicone Co., Ltd.) are added to the obtained dispersion liquid, and the liquid for undercoating layer coating is obtained. This coating liquid is coated on an aluminum substrate by a dip coating method, dry curing is performed for 100 minutes at 160° C. to obtain a 20 μm thick undercoating layer. The surface roughness of the undercoating layer is measured with a measurement distance of 2.5 mm, and scan speed of 0.3 mm/sec using a surface roughness profile measuring instrument (Trade name: SURFCOM 570A; made by Tokyo Seimitsu Co., Ltd.) and the ten point average roughness height Rz value is 0.24 μm.

Next, 1 part by weight of the hydroxygallium phthalocyanine HPC-1 produced by the above preparation example is mixed with 1 part by weight of polyvinyl butyral (S-LEC BM-S, Trade Name, manufactured by Sekisui Chemical Co., Ltd.) and 100 parts by weight of n-butyl acetate, and dispersion processing is carried out with 1 mm diameter glass beads in a paint shaker for 1 hour, and the coating liquid for charge generating layer formation is obtained. This coating liquid is dip coated onto the above undercoating layer, heated and dried for 10 minutes at 100° C., and thereby the charge generating layer of 0.15 μm film thickness is formed.

Next, 2 parts by weight of a benzidine compound (VII-1) represented by the following formula and 2.5 parts by weight of a polymer compound which has a structural unit represented by the following formula (VII-2) (viscosity average molecular weight 50,000) are dissolved in 20 parts by weight of chlorobenzene, and the coating liquid for the charge transport layer formation is thereby obtained.

(VII-1)

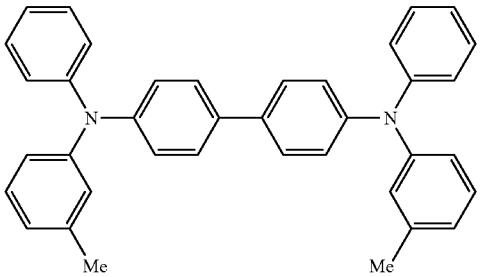

(VII-2)

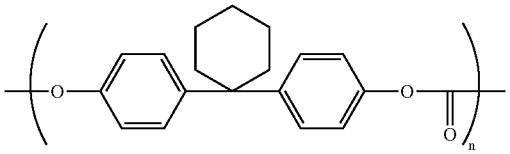

The obtained coating liquid is coated by a dip coating method on the above charge generating layer, and is heated and dried for 40 minutes at 120° C., and the charge transport layer of 20 μm film thickness is thereby formed.

Next, 2.5 parts by weight of the compound I-7 produced by the above manufacturing method, 3 parts by weight of the phenol resin Ph-1—produced by the above manufacturing method, 0.05 parts by weight of a polyether modified silicone oil (TSF 4452, Trade Name; made by Toshiba Silicone Co., K.K.), 0.05 parts by weight of NACURE5225 (made by Kusumoto Chemicals, Ltd: acid curing catalyst with amine blocked organic sulfonic acid structure), and 3.0 parts by weight of n-butanol are mixed, and the protective layer forming coating liquid thereby obtained. After coating this coating liquid on the charge transport layer using a ring dip coating method it is air-dried at room temperature (24° C.) for 30 minutes, heat-treated for 45 minutes at 150° C., and cured to form a protective layer of 6 μm film thickness, and the target electrophotographic photoreceptor (referred to below as "photoreceptor-1") is obtained.

(Evaluation)

—Electrophotographic Photoreceptor Properties Evaluation—

An image-forming apparatus is produced using the Photoreceptor-1. Elements other than the electrophotographic photoreceptor are the same as in a Fuji Xerox printer DOCUCENTRE COLOR 400CP (Trade Name, made by Fuji Xerox Co., Ltd.).

Next, for each image-forming apparatus, a 5000 sheet image-forming test (10% image density) is carried out in a high temperature high humidity environment (27° C., 85% RH), and, next a 5000 sheet image-forming test (10% of image density) is carried out in a low temperature low humidity environment (10° C., 25% RH). The existence or not of scratches on the electrophotographic photoreceptor outermost surface (this being the protective layer surface in the case of Example 1) and adhered matter thereto is evaluated after each of the tests. The toner cleaning ability (soiling and image quality deterioration due to deficient cleaning of the charging unit) in each environment and the image quality (existence or not of ghost image when electric discharge light exposure is stopped) is evaluated. The obtained Results are shown in Table 1. In the image-forming tests, J paper (A3 size) (Trade Name; made by Fuji Xerox Office Supply) is used.

The existence or not of the scratches of a photoreceptor is judged visually and evaluated based on the following evaluation scale.

A: No scratches

B: Partial scratching (but not a problem to image quality)

C: Scratches (causing a problem to image quality)

The existence of the adhered matter is judged visually and evaluated based on the following evaluation scale.

A: No adhered matter

B: Partial adhering (but not a problem to image quality)

C: Adhering (causing a problem to image quality)

Cleaning ability is judged visually and evaluated based on the following evaluation scale.

A: Good

B: Partial image quality defects, such as streaks (but not a problem to image quality)

C: Extensive image quality defects (causing a problem to image quality)

Image quality is evaluated based on the following evaluation scale.

A: Good

B: Partial ghosting (but not a problem in practice)

C: Defects (distinctly visible level of ghosting, problematic in practice)

Figure 22A:
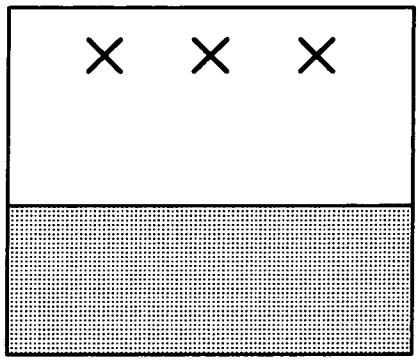
FIG. 22 is an explanatory view showing the scale for evaluating ghosting in the Examples.
Figure 22B:
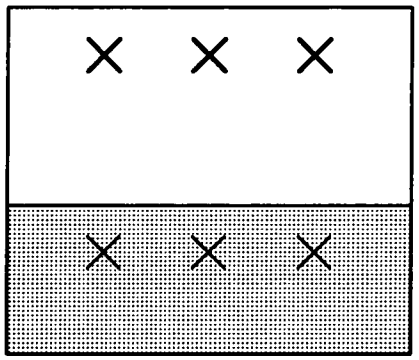
Figure 22C:
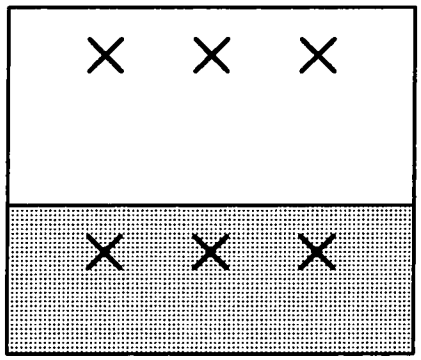

In the evaluation of ghosting, as shown in FIG. 22, a chart is output with a 100% output image pattern and characters "X", and the degree of visibility of the characters "X" in the 100% output image portion is evaluated according to the figure.

For the charge in the charging potential, a charging potential A in the exposure position before the above high temperature high humidity image-forming test, and a charging potential B in the exposure position after the low temperature low humidity image-forming test are measured with a surface potential meter, and the absolute value of the change in charging potential (=|charging potential B−charging potential A|(V)) is evaluated according to the following scale.

A: Less than 10V

B: 10V to 20V

C: 20V or more

The charging potential is initialized so as to be set to −700V before the image-forming tests, and the image-forming tests are carried out without changing the conditions.

Example 2

-Production of Photoreceptor-2 -

Photoreceptor-2 is produced in the same manner as in Example 1 except in that the compound I-11 is used, instead of the compound I-7 of Example 1. The same testing is carried out as in Example 1. Results are shown in Table 1.

Example 3

-Production of Photoreceptor-3 -

Photoreceptor-3 is produced in the same manner as in Example 1 except in that the compound I-29 is used, instead of the compound I-7 of Example 1. The same testing is carried out as in Example 1. Results are shown in Table 1.

Example 4

-Production of Photoreceptor-4 -

Photoreceptor-4 is produced in the same manner as in Example 1 except in that the compound I-30 is used, instead of the compound I-7 of Example 1. The same testing is carried out as in Example 1. Results are shown in Table 1.

Example 5

-Production of Photoreceptor-5 -

Photoreceptor-5 is produced in the same manner as in Example 1 except in that the compound I-31 is used, instead of the compound I-7 of Example 1. The same testing is carried out as in Example 1. Results are shown in Table 1.

Example 6

-Production of Photoreceptor-6 -

Photoreceptor-6 is produced in the same manner as in Example 1 except in that the hydroxygallium phthalocyanine HPC-2 is used, instead of the hydroxygallium phthalocyanine HPC-1 of Example 1. The same testing is carried out as in Example 1. Results are shown in Table 1.

Example 7

-Production of Photoreceptor-7 -

Photoreceptor-7 is produced in the same manner as in Example 1 except in that the hydroxygallium phthalocyanine HPC-3 is used, instead of the hydroxygallium phthalocyanine HPC-1 of Example 1. The same testing is carried out as in Example 1. Results are shown in Table 1.

Example 8

-Production of Photoreceptor-8 -

Photoreceptor-8 is produced in the same manner as in Example 1 except in that a polymer compound of viscosity average molecular weight 39,000 is used, instead of the 2.5 parts by weight of polymer compound (viscosity average molecular weight 50,000). The same testing is carried out as in Example 1. Results are shown in Table 1.

Example 9

-Production of Photoreceptor-9 -

First, a cylindrical aluminum substrate to which a honing process has been carried out is prepared as a conductive substrate. Next, 100 parts by weight of a zirconium compound (ORGATICS ZC540, Trade Name, manufactured by Matsumoto Chemical Industry Co., Ltd.), 10 parts by weight of a silane compound (A1100, made by Nippon Unicar Company Limited), 3 parts by weight of a polyvinyl butyral (S-LEC BM-S, made by Sekisui Chemical Co., Ltd.), 380 parts by weight of isopropanol, and 200 parts by weight butanol are mixed together, and the coating liquid for undercoating layer formation is thus obtained. This coating liquid is dip coated on the outer peripheral surface of the above aluminum substrate, and then heated and dried for 10 minutes at 150° C. and an undercoating layer of 0.17 μm film thickness is formed thereby. Except for the above aspects, the Photoreceptor-9 is produced in the same manner as in Example 1. The same testing is carried out as in Example 1. Results are shown in Table 1.

Example 10

-Production of Photoreceptor-10 -

Photoreceptor-10 is produced in the same manner as in Example 1 except in that phenol resin Ph-2 is used, instead of the phenol resin Ph-I in Example 1. The same testing is carried out as in Example 1. Results are shown in Table 1.

Example 11

-Production of Photoreceptor-11 -

A cylindrical aluminum substrate is ground with a centerless grinding device, and the surface roughness thereof is made Rz (ten point average roughness height)=0.6 μm. In order to wash the aluminum substrate to which the centerless grinding treatment has been carried out, a degreasing treatment is carried out by, in this sequence, etching for 1 minute with a 2 weight % sodium hydroxide solution, neutralizing, and then washing with pure water. Next, an anode oxide film is formed on the substrate surface of the aluminum substrate using a 10 weight % sulfuric acid solution (current density 1.0 $A/dm^2$). After washing with water, the aluminum substrate is immersed in 1 weight % nickel acetate solution at 80° C. for 25 minutes, and pore sealing treatment is thereby performed. Washing with pure water and a drying process is further performed. Thereby an aluminum substrate with an about 7.5 μm thick anode oxide film formed thereon is obtained.

Next, 1 part by weight of a titanylphthalocyanine with a strong X-ray diffraction peak at a Bragg angle (2θ±0.2°) of 27.2° is mixed with 1 part by weight of polyvinyl butyral (S-LEC BM-S, Trade Name, made by Sekisui Chemical Co., Ltd.) and 100 parts by weight n-butyl acetate, and dispersion processing is carried out for one hour in a paint shaker with glass beads, and the coating liquid for charge generating layer formation thereby obtained. The obtained coating liquid is dip coated onto the above aluminum substrate, is heated and dried for 10 minutes at 100° C., and a charge generating layer of about 0.15 μm film thickness is thereby formed.

Next, 2 parts by weight of a compound represented by the following formula (VIII-1) and 3 parts by weight of a polymer compound (viscosity average molecular weight 50,000) which has a structural unit represented by the following formula (VIII-2) are dissolved in 20 parts by weight of chlorobenzene, and the coating liquid for the charge transport layer formation is thereby obtained. The obtained coating liquid is coated by a dip coating method on the above charge generating layer, heating is performed for 45 minutes at 130° C., and a charge transport layer of 25 μm film thickness is formed.

Then, Photoreceptor-11 is produced in the same manner as in Example 1. The same testing is carried out as in Example 1. Results are shown in Table 1.

(VIII-1)

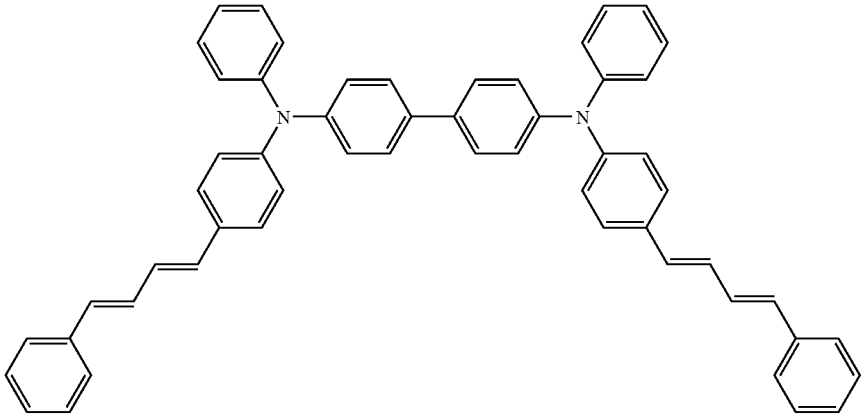

(VIII-2)

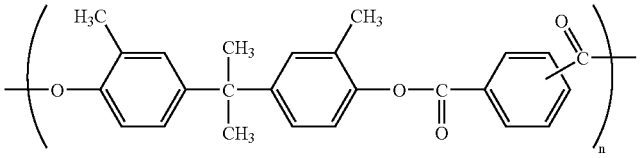

Example 12

-Production of Photoreceptor-12 -

Photoreceptor-12 is produced in the same manner as in Example 1 except in that aluminum tris isopropoxide is used, instead of the NACURE5225 in Example 1. The same testing is carried out as in Example 1. Results are shown in Table 1.

Example 13

-Production of Photoreceptor-13 -

The charge generating layer is produced in the same manner as in Example 1. Then, 3 parts by weight of a polymer compound (viscosity average molecular weight 50,000) with a structural unit represented by the above formula (VIII-2) and 2.5 parts by weight of the compound (1-7) are dissolved in chlorobenzene 20 parts by weight, and the coating liquid for charge transport layer formation is obtained. The obtained coating liquid is coated by a dip coating method on the above charge generating layer, heating is performed for 45 minutes at 130° C., a charge transport layer of 20 μm film thickness is formed, and the Photoreceptor-13 is produced. The same testing is carried out as in Example 1. Results are shown in Table 1.

Comparative Example 1

Comparative Photoreceptor-1 is produced in the same manner as in Example 7 except in that a compound of the following Formula CTI-I is used, instead of the compound I-7 in Example 7. The same testing is carried out as in Example 1. Results are shown in Table 1.

TABLE 1

(CTI-1)

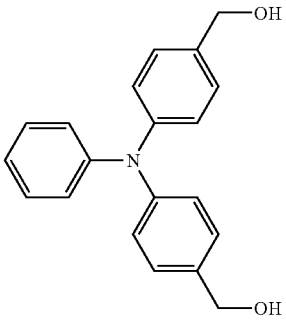

| | | After Print Test | | | | |
|---|---|---|---|---|---|---|
| Example No. | Photoreceptor | Photoreceptor Surface Scratches | Matter Adhering to Photoreceptor Surface | Cleaning Ability High Temp. & Humidity/Low Temp. & Humidity | Image quality (ghosting) High Temp. & Humidity/Low Temp. & Humidity | Charging Potential |
| Example 1 | Photoreceptor-1 | A | A | A/A | A/A | A |
| Example 2 | Photoreceptor-2 | A | A | A/A | A/A | A |

TABLE 1-continued (CTI-1)

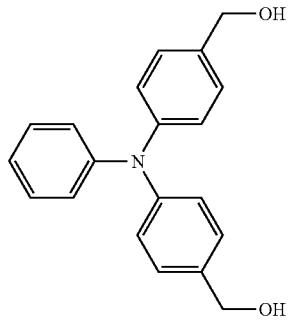

| Example No. | Photoreceptor | After Print Test: Photoreceptor Surface Scratches | Matter Adhering to Photoreceptor Surface | Cleaning Ability High Temp. & Humidity/Low Temp. & Humidity | Image quality (ghosting) High Temp. & Humidity/Low Temp. & Humidity | Charging Potential |
|---|---|---|---|---|---|---|
| Example 3 | Photoreceptor-3 | A | A | A/A | A/A | A |
| Example 4 | Photoreceptor-4 | A | A | A/A | A/A | A |
| Example 5 | Photoreceptor-5 | B | A | A/A | A/A | A |
| Example 6 | Photoreceptor-6 | A | A | A/A | A/A | A |
| Example 7 | Photoreceptor-7 | A | A | A/A | B/B | B |
| Example 8 | Photoreceptor-8 | A | A | A/A | A/A | A |
| Example 9 | Photoreceptor-9 | A | A | A/A | A/A | A |
| Example 10 | Photoreceptor-10 | B | A | A/A | B/B | B |
| Example 11 | Photoreceptor-11 | A | A | A/A | A/A | A |
| Example 12 | Photoreceptor-12 | B | A | A/A | B/B | B |
| Example 13 | Photoreceptor-13 | B | A | A/B | A/B | B |
| Comparative Example 1 | Comparative Photoreceptor-1 | B | B | B/B | C/C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising:

a conductive substrate; and a photosensitive layer provided on or above the conductive substrate, the photosensitive layer comprising a first functional layer that includes:

(i) a compound represented by the following Formula (I):

(I)

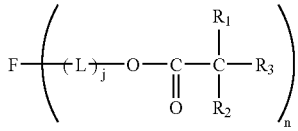

wherein, in Formula (I), F represents an n-valent organic group having hole transportation ability;

R1, R2, and R3 each independently represents a hydrogen atom, a halogen atom, or a monovalent organic group having from 1 to 18 carbon atoms;

L represents an alkylene group having from 1 to 18 carbon atoms, which may be branched;

n represents an integer of 1 to 4; and j represents an integer of 1, or (ii) a cured material of a composition including a compound represented by Formula (I) in which n is an integer of 2 to 4.

2. The electrophotographic photoreceptor according to claim 1, wherein the alkylene group represented by L in the Formula (I) is a methylene group.

3. The electrophotographic photoreceptor according to claim 1, wherein the compound represented by the Formula (I) is also represented by the following Formula (II):

(II)

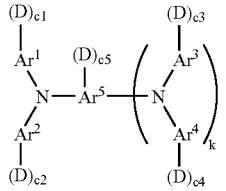

wherein, in Formula (II), Ar1, Ar2, Ar3, and Ar4 each independently represents a substituted or unsubstituted aryl group or a substituted or unsubstituted allylene group;

Ar5 represents a substituted or unsubstituted aryl group or a substituted or unsubstituted allylene group;

c1, c2, c3, c4, and c5 each independently represents 0 or 1;

k represents 0 or 1;

D represents a monovalent organic group represented by the following Formula (III); and the total of c1, c2, c3, c4, and c5 is from 1 to 4:

(III)

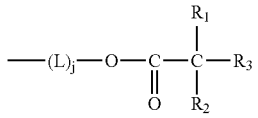

wherein, in Formula (III), R1, R2, and R3 each independently represents a hydrogen atom, a halogen atom, or a monovalent organic group having from 1 to 18 carbon atoms;

L represents an alkylene group having from 1 to 18 carbon atoms, which may be branched; and j represents 1.

4. The electrophotographic photoreceptor according to claim 3, wherein the alkylene group represented by L in Formula (III) is a methylene group.

5. The electrophotographic photoreceptor according to claim 1, wherein the first functional layer is the outermost surface layer of the photosensitive layer.

6. The electrophotographic photoreceptor according to claim 1, wherein the first functional layer includes cured material of a composition including a compound represented by the Formula (I) in which n is an integer of 2 to 4.

7. The electrophotographic photoreceptor according to claim 1, wherein the first functional layer includes a cross-linking resin.

8. The electrophotographic photoreceptor according to claim 7, wherein the cross-linking resin is a phenol resin.

9. The electrophotographic photoreceptor according to claim 1, wherein the first functional layer includes an acid catalyst or neutralized substance therefrom.

10. The electrophotographic photoreceptor according to claim 1, wherein the photosensitive layer further comprises a second functional layer comprising a hydroxygallium phthalocyanine pigment which has a maximum absorption wavelength in the range of from 810 nm to 839 nm in the spectral absorption spectrum in the wavelength band of from 600 nm to 900 nm.

11. A process cartridge, comprising:

the electrophotographic photoreceptor according to claim 1; and at least one of the following group of units, the group consisting of: a charging unit that charges the electrophotographic photoreceptor; a developing unit that develops with toner an electrostatic latent image formed at the electrophotographic photoreceptor and forms a toner image; and a toner removing unit that removes the toner remaining on the surface of the electrophotographic photoreceptor.

12. An image-forming apparatus comprising:

the electrophotographic photoreceptor according to claim 1;

a charging unit that charges the electrophotographic photoreceptor;

an electrostatic image-forming unit, that forms an electrostatic latent image;

a developing unit, that develops with toner an electrostatic latent image formed at the electrophotographic photoreceptor and forms a toner image; and a transfer unit that transfers the toner image to a transfer body.

13. The electrophotographic photoreceptor according to claim 1, wherein in Formula (I), R1, R2, and R3 each independently represent a hydrogen atom, a halogen atom, an alkyl group having from 1 to 4 carbon atoms, or a group represented by —(CH2)r-O—R4, where R4 represents a hydrocarbon group having from 1 to 6 carbon atoms that may form a ring; and r represents an integer of 1 to 12.

14. The electrophotographic photoreceptor according to claim 3, wherein in Formula (III), R1, R2, and R3 each independently represent a hydrogen atom, a halogen atom, an alkyl group having from 1 to 4 carbon atoms, or a group represented by —(CH2)r-O—R4, where R4 represents a hydrocarbon group having from 1 to 6 carbon atoms that may form a ring; and r represents an integer of 1 to 12.

15. The process cartridge according to claim 11, wherein in Formula (I), R1, R2, and R3 each independently represent a hydrogen atom, a halogen atom, an alkyl group having from 1 to 4 carbon atoms, or a group represented by —(CH2)r-O—R4, where R4 represents a hydrocarbon group having from 1 to 6 carbon atoms that may form a ring; and r represents an integer of 1 to 12.

16. The image-forming apparatus according to claim 12, wherein in Formula (I), R1, R2, and R3 each independently represent a hydrogen atom, a halogen atom, an alkyl group having from 1 to 4 carbon atoms, or a group represented by —(CH2)r-O—R4, where R4 represents a hydrocarbon group having from 1 to 6 carbon atoms that may form a ring; and r represents an integer of 1 to 12.

* * * * *